US007399378B2

(12) United States Patent
Edwards et al.

(10) Patent No.: US 7,399,378 B2
(45) **Date of Patent: *Jul. 15, 2008**

(54) FABRIC CREPE PROCESS FOR MAKING ABSORBENT SHEET

(75) Inventors: Steven L. Edwards, Fremont, WI (US); Guy H. Super, Menasha, WI (US); Stephen J. McCullough, Mount Calvary, WI (US); Dean J. Baumgartner, Cecil, WI (US); Richard W. Eggen, Green Bay, WI (US); David P. Duggan, Green Bay, WI (US); Jeffrey E. Krueger, Oconto, WI (US); David W. Lomax, Bury (GB); Colin A. Jones, Pennington (GB)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 492 days.

This patent is subject to a terminal disclaimer.

(21) Appl. No.: 10/679,862

(22) Filed: Oct. 6, 2003

(65) Prior Publication Data

US 2004/0238135 A1 Dec. 2, 2004

Related U.S. Application Data

(60) Provisional application No. 60/416,666, filed on Oct. 7, 2002.

(51) Int. Cl.
*B31F 1/16* (2006.01)
*B31F 1/07* (2006.01)

(52) U.S. Cl. ..... 162/111; 162/117; 162/123; 156/183; 264/282

(58) Field of Classification Search ..... 162/109, 162/111–113, 115–117, 123–133; 156/183; 264/282–283

See application file for complete search history.

(56) References Cited

U.S. PATENT DOCUMENTS 3,432,936 A 3/1969 Cole et al. ..... 34/6
3,994,771 A 11/1976 Morgan, Jr. et al. ..... 162/113

(Continued)

FOREIGN PATENT DOCUMENTS

WO WO 00/14330 3/2000

*Primary Examiner*—José A Fortuna
(74) *Attorney, Agent, or Firm*—Michael W. Ferrell

(57) ABSTRACT

A process for making absorbent cellulosic paper products such as sheet for towel, tissue and the like, includes compactively dewatering a nascent web followed by wet belt creping the web at an intermediate consistency of anywhere from about 30 to about 60 percent under conditions operative to redistribute the fiber on the belt, which is preferably a fabric. In preferred embodiments, the web is thereafter adhesively applied to a Yankee dryer using a creping adhesive operative to enable high speed transfer of the web of intermediate consistency such as a poly(vinyl alcohol)/polyamide adhesive. An absorbent sheet so prepared from a papermaking furnish exhibits an absorbency of at least about 5 g/g, a CD stretch of at least about 4 percent, and an MD/CD tensile ratio of less than about 1.1, and also exhibits a maximum CD modulus at a CD strain of less than 1 percent and sustains a CD modulus of at least 50 percent of its maximum CD modulus to a CD strain of at least about 4 percent. Products of the invention may also exhibit an MD modulus at break 1.5 to 2 times their initial MD modulus.

72 Claims, 40 Drawing Sheets

U.S. PATENT DOCUMENTS

| | | | | | |
|---|---|---|---|---|---|
| 4,102,737 | A | | 7/1978 | Morton | 162/113 |
| 4,225,382 | A | | 9/1980 | Kearney et al. | |
| 4,356,059 | A | | 10/1982 | Hostetler | 162/111 |
| 4,420,372 | A | | 12/1983 | Hostetler | 162/280 |
| 4,440,597 | A | * | 4/1984 | Wells et al. | 162/111 |
| 4,448,638 | A | | 5/1984 | Klowak | 162/112 |
| 4,482,429 | A | | 11/1984 | Klowak | 162/111 |
| 4,529,480 | A | | 7/1985 | Trokhan | 162/109 |
| 4,551,199 | A | | 11/1985 | Weldon | 162/109 |
| 4,552,709 | A | | 11/1985 | Koger, II et al. | 264/504 |
| 4,556,450 | A | | 12/1985 | Chuang et al. | 162/204 |
| 4,614,679 | A | | 9/1986 | Farrington, Jr. et al. | 428/138 |
| 4,637,859 | A | | 1/1987 | Trokhan | 162/109 |
| 4,689,119 | A | | 8/1987 | Weldon | 162/281 |
| 4,795,530 | A | | 1/1989 | Soerens et al. | 162/111 |
| 4,834,838 | A | | 5/1989 | Klowak | 162/109 |
| 4,849,054 | A | | 7/1989 | Klowak | 162/109 |
| 4,942,077 | A | | 7/1990 | Wendt et al. | 428/152 |
| 5,087,324 | A | | 2/1992 | Awofeso et al. | 162/111 |
| 5,129,988 | A | | 7/1992 | Farrington, Jr. | 162/123 |
| 5,314,584 | A | | 5/1994 | Grinnell et al. | 162/109 |
| 5,336,373 | A | | 8/1994 | Scattolino et al. | 162/116 |
| 5,348,620 | A | | 9/1994 | Hermans et al. | 162/9 |
| 5,366,785 | A | | 11/1994 | Sawdai | 428/156 |
| 5,411,636 | A | | 5/1995 | Hermans et al. | 162/109 |
| 5,492,598 | A | | 2/1996 | Hermans et al. | 162/113 |
| 5,494,554 | A | | 2/1996 | Edwards et al. | 162/111 |
| 5,501,768 | A | | 3/1996 | Hermans et al. | 162/9 |
| 5,503,715 | A | | 4/1996 | Trokhan et al. | 162/296 |
| 5,505,818 | A | | 4/1996 | Hermans et al. | 162/113 |
| 5,508,818 | A | | 4/1996 | Hamma | 358/403 |
| 5,510,001 | A | | 4/1996 | Hermans et al. | 162/113 |
| 5,510,002 | A | | 4/1996 | Hermans et al. | 162/113 |
| 5,549,790 | A | | 8/1996 | Van Phan | 162/109 |
| 5,556,509 | A | | 9/1996 | Trokhan et al. | 162/111 |
| 5,601,871 | A | | 2/1997 | Krzysik et al. | 427/288 |
| 5,607,551 | A | | 3/1997 | Farrington, Jr. et al. | 162/109 |
| 5,609,725 | A | | 3/1997 | Van Phan | 162/117 |
| 5,614,293 | A | | 3/1997 | Krzysik et al. | 428/211 |
| H1672 | H | | 8/1997 | Hermans et al. | 162/148 |
| 5,656,132 | A | | 8/1997 | Farrington, Jr. et al. | 162/117 |
| 5,667,636 | A | | 9/1997 | Engel et al. | 162/117 |
| 5,672,284 | A | | 9/1997 | Devanathan et al. | 219/121.64 |
| 5,674,590 | A | | 10/1997 | Anderson et al. | 428/154 |
| 5,695,607 | A | | 12/1997 | Oriaran et al. | 162/112 |
| 5,725,734 | A | * | 3/1998 | Herman et al. | 162/111 |
| 5,746,887 | A | | 5/1998 | Wendt et al. | 162/109 |
| 5,772,845 | A | | 6/1998 | Farrington, Jr. et al. | 162/109 |
| 5,814,190 | A | | 9/1998 | Van Phan | 162/111 |
| 5,830,321 | A | * | 11/1998 | Lindsay et al. | 162/204 |
| 5,840,403 | A | | 11/1998 | Trokhan et al. | 428/154 |
| 5,851,353 | A | | 12/1998 | Fiscus et al. | 162/113 |
| 5,888,347 | A | | 3/1999 | Engel et al. | 162/117 |
| 5,932,068 | A | | 8/1999 | Farrington, Jr. et al. | 162/117 |
| 5,935,381 | A | | 8/1999 | Trokhan et al. | 162/109 |
| 6,017,417 | A | | 1/2000 | Wendt et al. | 162/109 |
| 6,080,279 | A | | 6/2000 | Hada et al. | 162/290 |
| 6,083,346 | A | | 7/2000 | Hermans et al. | 162/115 |
| 6,093,284 | A | | 7/2000 | Hada et al. | 162/290 |
| 6,096,169 | A | | 8/2000 | Hermans et al. | 162/115 |
| 6,117,525 | A | | 9/2000 | Trokhan et al. | 428/154 |
| 6,136,146 | A | | 10/2000 | Van Phan et al. | 162/109 |
| 6,139,686 | A | | 10/2000 | Trokhan et al. | 162/109 |
| 6,143,135 | A | | 11/2000 | Hada et al. | 162/290 |
| 6,149,767 | A | | 11/2000 | Hermans et al. | 162/109 |
| 6,149,769 | A | | 11/2000 | Mohammadi et al. | 162/111 |
| 6,162,327 | A | | 12/2000 | Batra et al. | 162/109 |
| 6,171,442 | B1 | | 1/2001 | Farrington, Jr. et al. | 162/129 |
| 6,187,137 | B1 | | 2/2001 | Druecke et al. | 162/109 |
| 6,197,154 | B1 | | 3/2001 | Chen et al. | 162/109 |
| 6,210,528 | B1 | | 4/2001 | Wolkowicz | 162/111 |
| 6,228,220 | B1 | | 5/2001 | Hada et al. | 162/203 |
| 6,280,573 | B1 | | 8/2001 | Lindsay et al. | 162/198 |
| 6,287,426 | B1 | | 9/2001 | Edwards et al. | 162/281 |
| 6,306,257 | B1 | | 10/2001 | Hada et al. | 162/290 |
| 6,306,258 | B1 | | 10/2001 | Lange et al. | 162/290 |
| 6,318,727 | B1 | | 11/2001 | Hada | 277/345 |
| 6,331,230 | B1 | | 12/2001 | Hermans et al. | 162/207 |
| 6,350,349 | B1 | | 2/2002 | Hermans et al. | 162/111 |
| 6,420,013 | B1 | | 7/2002 | Vinson et al. | 428/154 |
| 6,436,234 | B1 | | 8/2002 | Chen et al. | 162/109 |
| 6,447,641 | B1 | | 9/2002 | Wolkowicz et al. | 162/109 |
| 6,454,904 | B1 | | 9/2002 | Hermans et al. | 162/205 |
| 6,461,474 | B1 | | 10/2002 | Lindsay et al. | 162/109 |
| 6,464,829 | B1 | | 10/2002 | Chen et al. | 162/109 |
| 6,478,927 | B1 | | 11/2002 | Chen et al. | 162/109 |
| 6,497,789 | B1 | | 12/2002 | Hermans et al. | 162/205 |
| 6,534,151 | B2 | | 3/2003 | Merker | 428/154 |
| 6,551,461 | B2 | | 4/2003 | Hermans et al. | 162/207 |
| 6,579,418 | B2 | | 6/2003 | Lindsay et al. | 162/198 |
| 6,585,855 | B2 | | 7/2003 | Drew et al. | 162/109 |
| 6,610,173 | B1 | | 8/2003 | Lindsay et al. | 162/109 |
| 2002/0062936 | A1 | | 5/2002 | Klerelid et al. | 162/116 |
| 2002/0088577 | A1 | | 7/2002 | Watson et al. | 162/109 |
| 2002/0134520 | A1 | | 9/2002 | Behnke et al. | 162/100 |
| 2003/0000664 | A1 | | 1/2003 | Drew et al. | 162/109 |
| 2003/0098134 | A1 | | 5/2003 | Scherb et al. | 162/117 |
| 2003/0102098 | A1 | | 6/2003 | Allen et al. | 162/203 |
| 2003/0111195 | A1 | | 6/2003 | Hu | 162/111 |
| 2003/0121626 | A1 | | 7/2003 | Hultzcrantz | 162/111 |
| 2004/0238135 | A1 | * | 12/2004 | Edwards et al. | 161/111 |
| 2005/0217814 | A1 | * | 10/2005 | Super et al. | 162/111 |
| 2005/0241786 | A1 | * | 11/2005 | Edwards et al. | 162/109 |
| 2005/0279471 | A1 | * | 12/2005 | Murray et al. | 162/111 |
| 2006/0000567 | A1 | * | 1/2006 | Murray et al. | 162/111 |
| 2006/0237154 | A1 | * | 10/2006 | Edwards et al. | 162/111 |
| 2007/0137807 | A1 | * | 6/2007 | Schulz et al. | 162/109 |

* cited by examiner

WET CREPED / THOROUGH DRIED
HIGH IMPACT FABRIC CREPED
VARIOUS COMMERCIAL
ABSORBANCY, SAT gm/gm
SPECIFIC VOLUME, cc/gm
12
11
10
9
8
7
6
5
4
3
2
2
4
6
8
10
12
14

CROSS-SECTIONAL VIEW OF FABRIC-CREPED BASESHEET

DIRECTION A

CROSS-SECTIONAL VIEW OF FABRIC-CREPED BASESHEET

DIRECTION B

TAD

FABRIC CREPED

CWP

FABRIC CREPE PROCESS FOR MAKING ABSORBENT SHEET

CLAIM FOR PRIORITY

This non-provisional application claims the benefit of the filing date of U.S. Provisional Patent Application Ser. No. 60/416,666, filed Oct. 7, 2002.

TECHNICAL FIELD

The present invention relates generally to papermaking processes for making absorbent sheet and more particularly to a method of making belt-creped absorbent cellulosic sheet by way of compactively dewatering a papermaking furnish to form a nascent web having a generally random apparent distribution of papermaking fiber; applying the dewatered web to a translating transfer surface moving at a first speed; belt-creping the web from the transfer surface at a consistency of from about 30 to about 60 percent utilizing a patterned creping belt, the creping step occurring under pressure in a belt creping nip defined between the transfer surface and the creping belt wherein the belt is traveling at a second speed slower than the speed of said transfer surface. The belt pattern, nip pressure, other nip parameters, velocity delta and web consistency are selected such that the web is creped from the surface and redistributed on the creping belt to form a web with a reticulum having a plurality of interconnected regions of different local basis weights including at least (i) a plurality of fiber enriched pileated regions of high local basis weight, interconnected by way of (ii) a plurality of lower local basis weight linking regions whose fiber orientation is biased toward the direction between pileated regions spanned by the linking portions of the web. The process produces an absorbent product of relatively high bulk and absorbency as compared with conventional compactively dewatered products and which products exhibit unique mechanical properties as hereinafter described.

BACKGROUND

Methods of making paper tissue, towel, and the like are well known, including various features such as Yankee drying, throughdrying, fabric creping, dry creping, wet creping and so forth. Conventional wet pressing processes have certain advantages over conventional through-air drying processes including: (1) lower energy costs associated with the mechanical removal of water rather than transpiration drying with hot air; and (2) higher production speeds which are more readily achieved with processes which utilize wet pressing to form a web. On the other hand, through-air drying processes have become the method of choice for new capital investment, particularly for the production of soft, bulky, premium quality tissue and towel products.

Fabric creping has been employed in connection with papermaking processes which include mechanical or compactive dewatering of the paper web as a means to influence product properties. See, U.S. Pat. Nos. 4,689,119 and 4,551,199 of Weldon; U.S. Pat. No. 4,849,054 of Klowak; and U.S. Pat. No. 6,287,426 of Edwards et al. Operation of fabric creping processes has been hampered by the difficulty of effectively transfering a web of high or intermediate consistency to a dryer. Further patents relating to fabric creping include the following: U.S. Pat. Nos. 4,834,838; 4,482,429 as well as 4,445,638. Note also U.S. Pat. No. 6,350,349 to Hermans et al. which discloses wet transfer of a web from a rotating transfer surface to a fabric.

In connection with papermaking processes, fabric molding has also been employed as a means to provide texture and bulk. In this respect, there is seen in U.S. Pat. No. 6,610,173 to Lindsay et al. a method for imprinting a paper web during a wet pressing event which results in asymmetrical protrusions corresponding to the deflection conduits of a deflection member. The '173 patent reports that a differential velocity transfer during a pressing event serves to improve the molding and imprinting of a web with a deflection member. The tissue webs produced are reported as having particular sets of physical and geometrical properties, such as a pattern densified network and a repeating pattern of protrusions having asymmetrical structures. With respect to wet-molding of a web using textured fabrics, see, also, the following U.S Pat. Nos.: 6,017,417 and 5,672,248 both to Wendt et al.; 5,508,818 to Hermans et al. and 4,637,859 to Trokhan. With respect to the use of fabrics used to impart texture to a mostly dry sheet, see U.S. Pat. No. 6,585,855 to Drew et al., as well as United States Publication No. US 2003/0000664.

U.S. Pat. No. 5,503,715 to Trokhan et al. discloses a cellulosic fibrous structure having multiple regions distinguished from one another by basis weight. The structure is reported as having an essentially continuous high basis weight network, and discrete regions of low basis weight which circumscribe discrete regions of intermediate basis weight. The cellulosic fibers forming the low basis weight regions may be radially oriented relative to the centers of the regions. The paper may be formed by using a forming belt having zones with different flow resistances. The basis weight of a region of the paper is generally inversely proportional to the flow resistance of the zone of the forming belt, upon which such region was formed. The zones of different flow resistances provide for selectively draining a liquid carrier having suspended cellulosic fibers through the different zones of the forming belt. A similar structure is reported in U.S. Pat. No. 5,935,381 also to Trokhan et al. where the features are achieved by using different fiber types.

More generally, a method of making throughdried products is disclosed in U.S. Pat. No. 5,607,551 to Farrington, Jr. et al. wherein uncreped, throughdried products are described. According to the '551 patent, a stream of an aqueous suspension of papermaking fibers is deposited onto a forming fabric and partially dewatered to a consistency of about 10 percent. The wet web is then transferred to a transfer fabric traveling at a slower speed than the forming fabric in order to impart increased stretch into the web. The web is thereafter transferred to a throughdrying fabric where it is dried to a final consistency of about 95 percent or greater.

There is disclosed in U.S. Pat. No. 5,510,002 to Hermans et al. various throughdried, creped products. There is taught in connection with FIG. 2, for example, a throughdried/wet-pressed method of making creped tissue wherein an aqueous suspension of papermaking fibers is deposited onto a forming fabric, dewatered in a press nip between a pair of felts, then wet-strained onto a through-air drying fabric for subsequent through-air drying. The throughdried web is adhered to a Yankee dryer, further dried, and creped to yield the final product.

Throughdried, creped products are also disclosed in the following patents: U.S. Pat. No. 3,994,771 to Morgan, Jr. et al.; U.S. Pat. No. 4,102,737 to Morton; and U.S. Pat. No. 4,529,480 to Trokhan. The processes described in these patents comprise, very generally, forming a web on a foraminous support, thermally pre-drying the web, applying the web to a Yankee dryer with a nip defined, in part, by an impression fabric, and creping the product from the Yankee dryer. A relatively permeable web is typically required, making it difficult to employ recycle furnish at levels which may be desired. Transfer to the Yankee typically takes place at web consistencies of from about 60% to about 70%.

Conventional thoughdrying processes do not take full advantage of the drying potential of Yankee dryers because, in part, it is difficult to adhere a partially dried web of intermediate consistency to a surface rotating at high speed, particularly from an open mesh fabric where the fabric contacts typically less than 50% of the web during transfer to the cylinder. The dryer is thus constrained to operate at speeds below its potential and with heated air impingement jet velocities in the hood well below those employed in connection with conventional wet-press ("CWP") technologies.

As noted in the above, throughdried products tend to exhibit enhanced bulk and softness; however, thermal dewatering with hot air tends to be energy intensive and requires a relatively permeable substrate. Thus, wet-press operations wherein the webs are mechanically dewatered are preferable from an energy perspective and are more readily applied to furnishes containing recycle fiber which tends to form webs with less permeability than virgin fiber. A Yankee dryer can be more effectively employed because a web is transferred thereto at consistencies of 30 percent or so which enables the web to be firmly adhered for drying.

Wet press/wet or dry crepe processes have been employed widely as is seen throughout the papermaking literature as noted below. Many improvements relate to increasing the bulk and absorbency of compactively dewatered products which are typically dewatered in part with a papermaking felt.

U.S. Pat. No. 5,851,353 to Fiscus et al. teaches a method for can drying wet webs for tissue products wherein a partially dewatered wet web is restrained between a pair of molding fabrics. The restrained wet web is processed over a plurality of can dryers, for example, from a consistency of about 40 percent to a consistency of at least about 70 percent. The sheet molding fabrics protect the web from direct contact with the can dryers and impart an impression on the web.

U.S. Pat. No. 5,087,324 to Awofeso et al. discloses a delaminated stratified paper towel. The towel includes a dense first layer of chemical fiber blend and a second layer of a bulky anfractuous fiber blend unitary with the first layer. The first and second layers enhance the rate of absorption and water holding capacity of the paper towel. The method of forming a delaminated stratified web of paper towel material includes supplying a first furnish directly to a wire and supplying a second furnish of a bulky anfractuous fiber blend directly onto the first furnish disposed on the wire. Thereafter, a web of paper towel is creped and embossed.

U.S. Pat. No. 5,494,554 to Edwards et al. illustrates the formation of wet press tissue webs used for facial tissue, bath tissue, paper towels, or the like, produced by forming the wet tissue in layers in which the second formed layer has a consistency which is significantly less than the consistency of the first formed layer. The resulting improvement in web formation enables uniform debonding during dry creping which, in turn, provides a significant improvement in softness and a reduction in linting. Wet pressed tissues made with the process according to the '554 patent are internally debonded as measured by a high void volume index. See, also, U.S. Pat. No. 3,432,936 to Cole et al. The process disclosed in the '936 patent includes: forming a nascent web on a forming fabric; wet pressing the web; drying the web on a Yankee dryer; creping the web off of the Yankee dryer; and through-air drying the product; similar in many respects to the process described in U.S. Pat. No. 4,356,059 to Hostetler.

It has been found in accordance with the present invention that the absorbency, bulk and stretch of a wet-pressed web can be vastly improved by wet fabric creping a web, while preserving the high speed, thermal efficiency, and furnish tolerance to recycle fiber of wet-press technology by way of operating the process under conditions operative to rearrange an apparently randomly formed wet web.

SUMMARY OF THE INVENTION

The present invention is directed, in part, to a process for making absorbent cellulosic paper products such as basesheet for towel, tissue and the like, including compactively dewatering a nascent web followed by wet fabric or belt creping the web at an intermediate consistency of anywhere from about 30 to about 60 percent under conditions operative to redistribute an apparently random array of fibers into a web structure having a predetermined local variation in basis weight as well as fiber orientation imparted by the fabric creping step. Preferably, the web is thereafter adhesively applied to a Yankee dryer using a creping adhesive operative to enable high speed transfer of the web of intermediate consistency such as poly(vinyl alcohol)/polyamide adhesives described hereinafter. It was unexpectedly found that certain adhesives could be utilized to transfer and adhere a web of intermediate consistency to a Yankee dryer sufficiently to allow for high speed operation and high jet velocity impingement drying of the web in the Yankee dryer hood so that the dryer is used effectively. The adhesive is hygroscopic, re-wettable and preferably does not crosslink substantially in use. Depending upon operating parameters, a wet strength resin is included in the papermaking furnish.

The web produced by way of the invention exhibits an open interfiber microstructure resembling in many respects the microstructure of throughdried products which have not been mechanically dewatered during their formative stages, that is, below consistencies of 50 percent or so. The inventive products exhibit high absorbency and CD stretch, more so than conventional compactively dewatered products. Without intending to be bound by any theory, it is believed the inventive process is operative to reconfigure the interfiber structure of the compactively dewatered web to an open microstructure exhibiting elevated levels of absorbency and cross machine-direction stretch. The products may be made with very high machine-direction stretch which contributes to unique tactile properties.

The CD modulus of products of the invention typically reaches a maximum value at low CD strains, less than 1% in most cases as do CWP produced products; however, the CD modulus of the inventive products is sustained at elevated values while increasing CD strain, unlike CWP products wherein CD modulus quickly decays at increasing strain as the product fails.

A method of making a belt-creped absorbent cellulosic sheet in accordance with the invention thus includes: compactively dewatering a papermaking furnish to form a nascent web having an apparently random distribution of papermaking fiber; applying the dewatered web having the apparently random fiber distribution to a translating transfer surface moving at a first speed; belt-creping the web from the transfer surface at a consistency of from about 30 to about 60 percent utilizing a patterned creping belt, the creping step occurring under pressure in a belt creping nip defined between the transfer surface and the creping belt wherein the belt is traveling at a second speed slower than the speed of said transfer surface, the belt pattern, nip parameters, velocity delta and web consistency being selected such that the web is creped from the surface and redistributed on the creping belt to form a web with a reticulum having a plurality of interconnected regions of different local basis weights including at least (i) a plurality of fiber enriched pileated regions of high local basis weight, interconnected by way of (ii) a plurality of lower local basis weight linking regions whose fiber orientation is biased toward the direction between pileated regions; and drying the web. Generally, the process is operated at a Fabric Crepe of at least about 10 percent, typically at least about 20 percent and in many cases at least about 40, 60 percent or at least about 80 percent.

In typical embodiments, there are provided integument regions of fiber whose orientation is biased toward and sometimes along the MD. The linking regions and integument regions are colligating regions between the fiber-enriched pileated regions as is seen particularly in the scanning electron micrographs annexed hereto. Generally, the plurality of fiber enriched regions and colligating regions recur in a regular pattern of interconnected fibrous regions throughout the web where the orientation bias of the fibers of the fiber enriched regions and colligating regions are different from one another. In some cases, the fibers of the fiber enriched regions are substantially oriented in the CD, and the plurality of fiber enriched regions have a higher local basis weight than the colligating regions. Preferably, at least a portion of the colligating regions consist of fibers that are substantially oriented in the MD and wherein there is a repeating pattern including a plurality of fiber enriched regions, a first plurality of colligating regions whose fiber orientation is biased toward the machine-direction, and a second plurality of colligating regions whose fiber orientation is biased toward the machine-direction but offset from the fiber orientation bias of the first plurality of colligating regions. In preferred embodiments, at least one of the plurality of colligating regions are substantially oriented in the MD and the fiber enriched regions exhibit a plurality of U-shaped folds transverse to the machine-direction. The products are suitably produced where the creping belt is a creping fabric provided with CD knuckles defining creping surfaces transverse to the machine-direction, such as where the distribution of the fiber enriched regions corresponds to the arrangement of CD knuckles on the creping fabric. So also, it is preferred that the fabric backing roll urging the fabric against the transfer surface is a deformable roll, preferably one having a polymeric cover having a thickness of at least 25% of the nip length, and in some cases 50% of the nip length.

The web generally has a CD stretch of from about 5 percent to about 20 percent with a CD stretch of from about 5 percent to about 10 percent being somewhat typical. In many preferred cases, the web has a CD stretch of from about 6 percent to about 8 percent.

Products of the invention may be provided with MD stretch which is characteristically high. The web may have an MD stretch of at least about 15 percent, at least about 25 or 30 percent, at least about 40 percent, an MD stretch of at least about 55 percent or more. For example, the web may have an MD stretch of at least about 75 or 80 percent in some cases. The web is also characterized in many embodiments by an MD/CD tensile ratio of less than about 1.1, generally from about 0.5 to about 0.9 or from about 0.6 to about 0.8.

Fabric creping conditions are preferably selected so that the fiber is redistributed into regions of different basis weights. Suitably, the web is belt-creped at a consistency of from about 35 percent to about 55 percent and more preferably the web is belt-creped at a consistency of from about 40 percent to about 50 percent. The belt or fabric creping nip pressure is from about 20 to about 100 PLI, preferably from about 40 PLI to about 80 PLI in general and more typically the creping nip pressure is from about 50 PLI to about 70 PLI. In order to promote more uniform fabric creping conditions, a soft covered backing roll is used to press the fabric to the transfer surface in the fabric creping nip to provide a sharper creping angle, particularly on wide machines where large roll diameters are required. Typically the creping belt is supported in the creping nip with a backing roll having a surface hardness of from about 20 to about 120 on the Pusey and Jones hardness scale. The creping belt may be supported in the creping nip with a backing roll having a surface hardness of from about 25 to about 90 on the Pusey and Jones hardness scale. Likewise, the fabric creping nip extends typically over a distance of at least about ½" in the machine-direction with a distance of about 2" being typical.

In another aspect of the invention, a method of making a fabric-creped absorbent cellulosic sheet includes: compactively dewatering a papermaking furnish to form a nascent web; applying the dewatered web to the surface of a rotating transfer cylinder rotating at a first speed such that the surface velocity of the cylinder is at least about 1000 fpm; fabric-creping the web from the transfer cylinder at a consistency of from about 30 to about 60 percent in a high impact fabric creping nip defined between the transfer cylinder and a creping fabric traveling at a second speed slower than said transfer cylinder, wherein the web is creped from the cylinder and rearranged on the creping fabric; and drying the web, wherein the web has an absorbency of at least about 5 g/g and a CD stretch of at least about 4 percent. Generally, the surface velocity of the transfer cylinder is at least about 2000 fpm, sometimes the surface velocity of the transfer cylinder is at least about 3000 or 4000 fpm and sometimes 6000 fpm or more. Preferred product attributes include those wherein the web has an absorbency of from about 5 g/g to about 12 g/g or wherein the absorbency of the web (g/g) is at least about 0.7 times the specific volume of the web (cc/g) such as wherein the absorbency of the web (g/g) is from about 0.75 to about 0.9 times the specific volume of the web cc/g). Absorbencies of 6 g/g, 7 g/g and 8 g/g are readily achieved in connection with compactively dewatered products by way of the invention. Even though webs of the present invention do not require substantial amounts of wet strength resin to achieve absorbency, the aqueous furnish may include a wet strength resin such as a polyamide-epicholorohydrin resin as described hereinafter. The nascent web is typically dewatered prior to applying it to the transfer cylinder, by wet pressing it with a papermaking felt while applying the web to the transfer cylinder, optionally with a shoe press. Either of the rolls in the transfer nip could be a shoe press roll if so desired. When a creping fabric is used, the creping nip typically extends over a distance corresponding to at least twice the distance between wefts (CD filaments) of the creping fabric such as wherein the fabric creping nip extends over a distance corresponding to at least 4 times the distance between wefts of the creping fabric or wherein the fabric creping nip extends over a distance corresponding to at least 10, 20 or 40 times the distance between wefts of the creping fabric. Since wet strength resin is not required for absorbency, toweling of the present invention can be made flushable.

Preferred processes include those where the web is dried by transferring the web from the creping belt to a drying cylinder at a consistency of from about 30 to about 60 percent, wherein the web is adhered to the drying cylinder with a hygroscopic, re-wettable adhesive adapted to secure the web to the drying cylinder; drying the web on the drying cylinder; and creping the web from the drying cylinder. Preferably, the adhesive is a substantially non-crosslinking adhesive and includes mostly poly(vinyl alcohol) as a tacky component, but creping adhesive may include anywhere from about 10 to about 90 percent poly(vinyl alcohol) based on the resin content of the adhesive. More typically, the creping adhesive comprises poly(vinyl alcohol) and at least a second resin and wherein the weight ratio of poly(vinyl alcohol) to the combined weight of poly(vinyl alcohol) and the second resin is at least about 3:4; or still more preferably, wherein the creping adhesive comprises poly(vinyl alcohol) and at least a second resin and wherein the weight ratio of poly(vinyl alcohol) to the combined weight of poly(vinyl alcohol) and the second resin is at least about 5:6. The weight ratio of poly(vinyl alcohol) to the combined weight of poly(vinyl alcohol and the second resin is up to about 7:8 in many preferred embodiments. So also, the creping adhesive consists essentially of poly(vinyl alcohol) and an amide polymer, optionally including one or more modifiers in the processes specifically described hereinafter. Suitable modifiers include quaternary ammonium complexes with at least one non-cyclic amide.

Typical production speeds may be a production line speed of at least about 500 fpm, at least 1000 fpm or more as noted above. Due to the use of particular adhesives, the step of drying the web on the drying cylinder includes drying the web with high velocity heated air impinging on the web in a drying hood about the drying cylinder. The impinging air has a jet velocity of from about 15,000 fpm to about 30,000 fpm such that a Yankee dryer dries the web at a rate of from about 20 (lbs. water/$ft^2$-hr) to about 50 lbs. water/$ft^2$-hr.

The inventive method may be operated at an Aggregate Crepe of at least about 10 percent; at least about 20 percent; at least about 30 percent; at least about 40 percent; at least about 50, 60, 70, 80 percent or more.

Preferred products include a web of cellulosic fibers comprising: (i) a plurality of pileated fiber enriched regions of relatively high local basis weight interconnected by way of (ii) a plurality of lower local basis weight linking regions whose fiber orientation is biased along the direction between pileated regions interconnected thereby. Optionally, there is further provided a plurality of integument regions of fiber spanning the pileated regions of the web and the linking regions of the web such that the web has substantially continuous surfaces.

In contrast to fibers in the linking regions, the fibers in the integument exhibit a tendency to be MD oriented. These products may have an absorbency of at least about 5 g/g, a CD stretch of at least about 4 percent, and an MD/CD tensile ratio of less than about 1.1 and exhibit a maximum CD modulus at a CD strain of less than 1 percent and sustain a CD modulus of at least 50 percent of its maximum CD modulus to a CD strain of at least about 4 percent. Preferably the absorbent web sustains a CD modulus of at least 75 percent of its peak CD modulus to a CD strain of 2 percent and has an absorbency of from about 5 g/g to about 12 g/g. In some embodiments, the web defines an open mesh structure which may be impregnated with a polymeric resin, such as a curable polymeric resin.

In another embodiment, there is provided an absorbent sheet prepared from a papermaking furnish exhibiting an absorbency of at least about 5 g/g, a CD stretch of at least about 4 percent, and an MD/CD tensile ratio of less than about 1.1, wherein the sheet exhibits a maximum CD modulus at a CD strain of less than 1 percent and sustains a CD modulus of at least 50 percent of its maximum CD modulus to a CD strain of at least about 4 percent. Preferably, the absorbent sheet sustains a CD modulus of at least 75 percent of its peak CD modulus to a CD strain of 2 percent and exhibits the properties noted hereinabove.

Another aspect of the invention is directed to an absorbent sheet prepared from a papermaking furnish exhibiting an absorbency of at least about 5 g/g, a CD stretch of at least about 4 percent, an MD stretch of at least about 15 percent and an MD/CD tensile ratio of less than about 1.1.

Still yet another aspect of the invention is directed to an absorbent sheet prepared from a papermaking furnish exhibiting an absorbency of at least about 5 g/g, a CD stretch of at least about 4 percent and an MD break modulus higher than its initial MD modulus (that is, its initial modulus peak at low strain) such as where the sheet exhibits an MD break modulus of at least about 1.5 times its initial MD modulus or wherein the sheet exhibits an MD break modulus of at least about twice its initial MD modulus. More preferred absorbent sheets of this invention will exhibit an absorbency of at least about 6 g/g, still more preferably at least 7 g/g and most preferably 8 g/g or more.

In its many applications, the processes of the invention may be utilized to make single-ply tissue by way of: compactively dewatering a papermaking furnish to form a nascent web having a generally random apparent distribution of papermaking fiber; applying the dewatered web having the apparent random fiber distribution to a translating transfer surface moving at a first speed; belt-creping the web from the transfer surface at a consistency of from about 30 to about 60 percent utilizing a patterned creping belt, the creping step occurring under pressure in a belt creping nip defined between the transfer surface and the creping belt wherein the belt is traveling at a second speed slower than the speed of said transfer surface, the belt pattern, nip parameters, velocity delta and web consistency being selected such that the web is creped from the surface and redistributed on the creping belt to form a web with a reticulum having a plurality of interconnected regions of different local basis weights including at least (i) a plurality of fiber enriched pileated regions of high local basis weight, interconnected by way of (ii) a plurality of lower local basis weight linking regions whose fiber orientation is biased along the direction between pileated regions and (iii) wherein the Fabric Crepe is greater than about 25%; drying the web to form a basesheet having an MD stretch greater than about 25% and a characteristic basis weight; and converting the basesheet into a single-ply tissue product wherein the single-ply tissue product has a basis weight lower than the basesheet prior to conversion and an MD stretch lower than the MD stretch of the basesheet prior to conversion. Typically, the basesheet has an MD stretch of at least about 30% and more preferably the basesheet has an MD stretch of at least about 40%. The single-ply tissue product generally has an MD stretch of less than 30% and less than 20% in some embodiments.

Two or three ply tissue is similarly produced by way of: compactively dewatering a papermaking furnish to form a nascent web having a generally random apparent distribution of papermaking fiber; applying the dewatered web to a translating transfer surface moving at a first speed; belt-creping the web from the transfer surface at a consistency of from about 30 to about 60 percent utilizing a patterned creping belt, the creping step occurring under pressure in a belt creping nip defined between the transfer surface and the creping belt wherein the belt is traveling at a second speed slower than the speed of said transfer surface, the belt pattern, nip pressure, and other nip parameters, velocity delta and web consistency being selected such that the web is creped from the transfer surface and redistributed on the creping belt to form a web with a reticulum having a plurality of interconnected regions of different local basis weights including at least (i) a plurality of fiber enriched pileated regions of high local basis weight, interconnected by way of (ii) a plurality of lower local basis weight linking regions whose fiber orientation is biased toward the direction between pileated regions and (iii) wherein the Fabric Crepe is greater than about 25%; drying the web to form a basesheet having an MD stretch greater than about 25% and a characteristic basis weight; and converting the basesheet into a multi-ply tissue product with n plies made from the basesheet, n being 2 or 3, wherein the multi-ply product has an MD stretch lower than the MD stretch of the basesheet. The two or three (n) ply tissue product has a basis weight which is less than n times the basis weight of the basesheet. Here again, the basesheet has an MD stretch of at least about 30% or 40% and the tissue product has an MD stretch of less than 30% or the tissue product has an MD stretch of less than 20%.

The single and multi-ply tissue products exhibit unique tactile properties not seen in connection with conventionally produced absorbent sheet; in preferred cases these products are calendered. With CWP tissues, as the caliper is increased at a given basis weight, there comes a point at which softness inevitably deteriorates. As a general rule, when the ratio, expressed as 12-ply caliper in microns divided by basis weight in square meters, exceeds about 95, softness deteriorates. Tissue products of the invention may be made with 12-ply caliper/basis weight ratios of greater than 95, say between 95 and 120 or more than 120 without perceptible softness loss.

In some preferred embodiments, the inventive process is practiced on a three-fabric machine and uses a forming roll provided with vacuum.

The foregoing and further aspects of the invention are discussed in detail below.

BRIEF DESCRIPTION OF DRAWINGS

The invention is described in detail below with reference to the Figures wherein like numerals indicate similar parts and in which.

The invention is illustrated in its various aspects in the Figures appended hereto.

DETAILED DESCRIPTION

The invention is described in detail below in connection with numerous examples for purposes of illustration only. Modifications to particular examples within the spirit and scope of the present invention, set forth in the appended claims, will be readily apparent to those of skill in the art.

Figure 1:
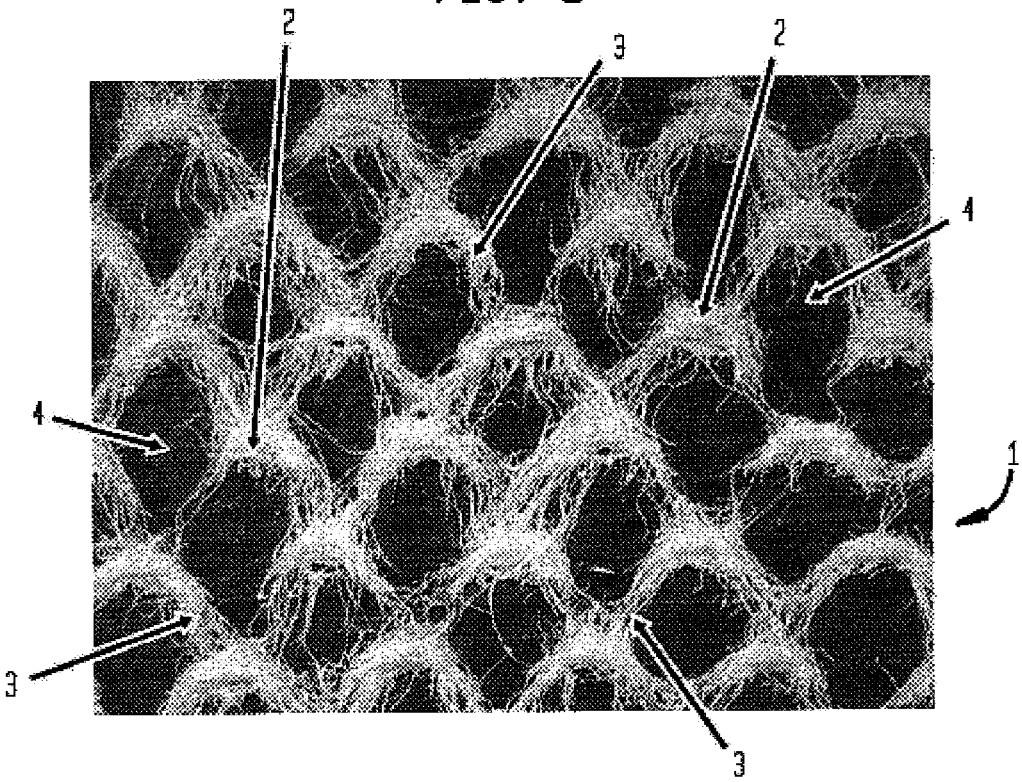
FIG. 1 is a photomicrograph (8×) of an open mesh web manufactured in accordance with the present invention including a plurality of high basis weight regions linked by lower basis weight regions extending therebetween.
Figure 2:
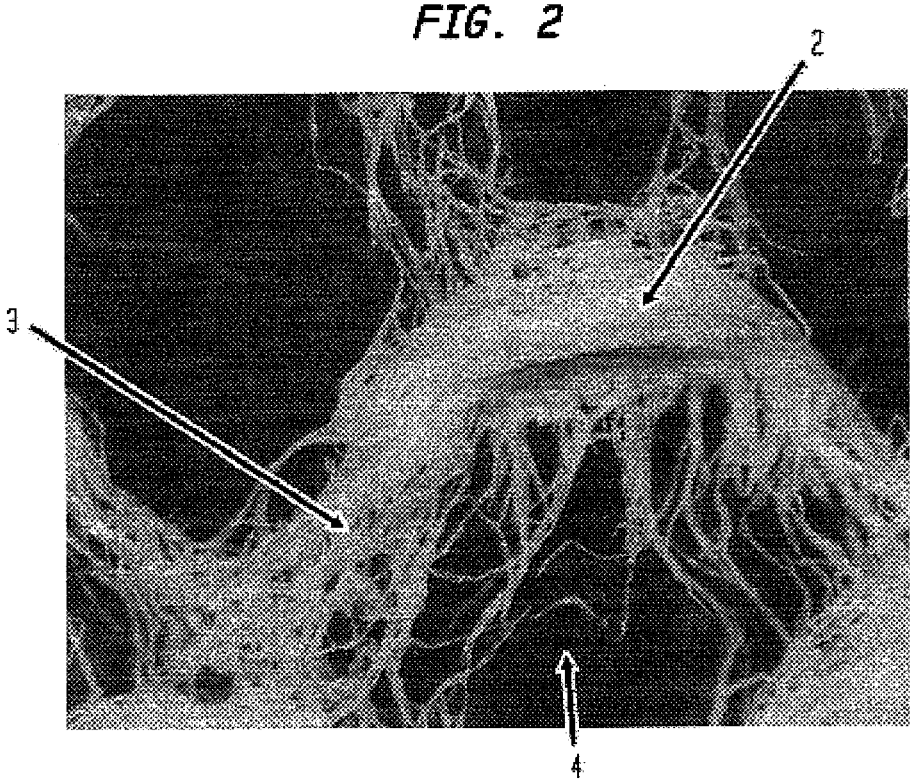
FIG. 2 is a photomicrograph showing enlarged detail (32×) of the web of FIG. 1.

The invention process and products produced thereby are appreciated by reference to FIGS. 1 through 18. FIG. 1 is a photomicrograph of a very low basis weight, open mesh web 1 having a plurality of relatively high basis weight pileated regions 2 interconnected by a plurality of lower basis weight linking regions 3. The cellulosic fibers of linking regions 3 have orientation which is biased along the direction as to which they extend between pileated regions 2, as is perhaps best seen in the enlarged view of FIG. 2. The orientation and variation in local basis weight is surprising in view of the fact that the nascent web has an apparent random fiber orientation when formed and is transferred largely undisturbed to a transfer surface prior to being wet-creped therefrom. The imparted ordered structure is distinctly seen at extremely low basis weights where web 1 has open portions 4 and is thus an open mesh structure.

Figure 3:
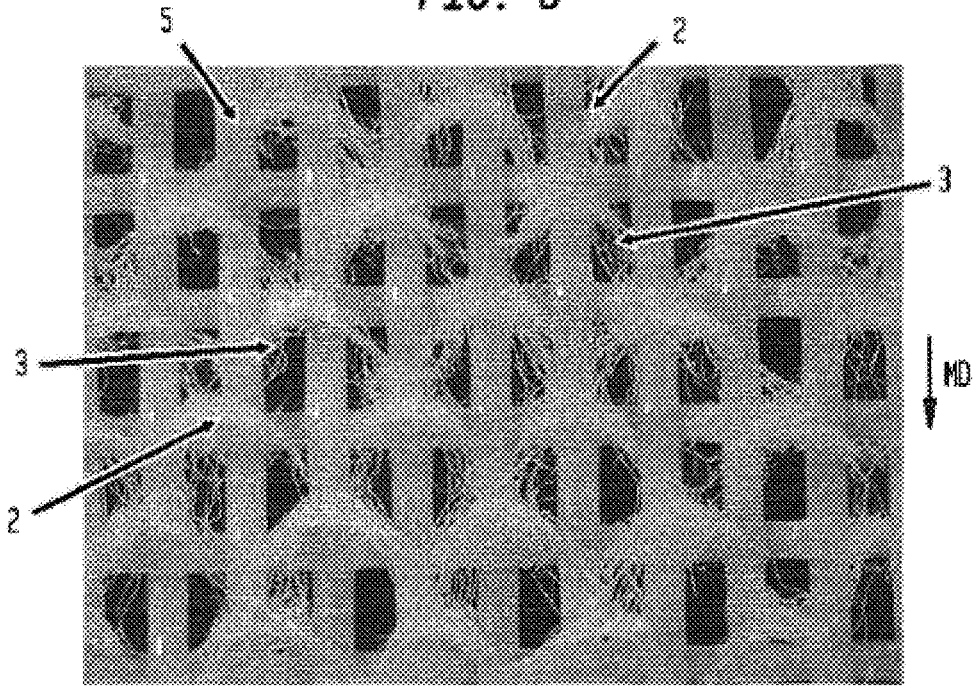
FIG. 3 is a photomicrograph (8×) showing the open mesh web of FIG. 1 placed on the creping fabric used to manufacture the web.

FIG. 3 shows a web together with the creping fabric 5 upon which the fibers were redistributed in a wet-creping nip after generally random formation to a consistency of 40-50 percent or so prior to creping from the transfer cylinder.

Figure 4:
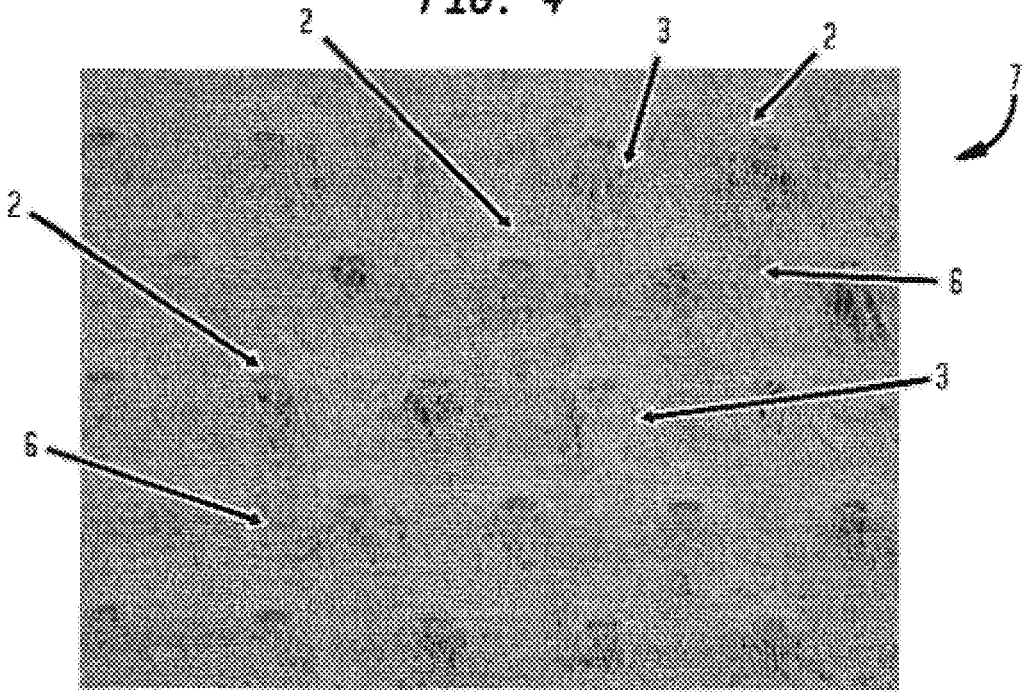
FIG. 4 is a photomicrograph showing a web of the invention having a basis weight of 19 lbs/ream produced with a 17% Fabric Crepe.
Figure 5:
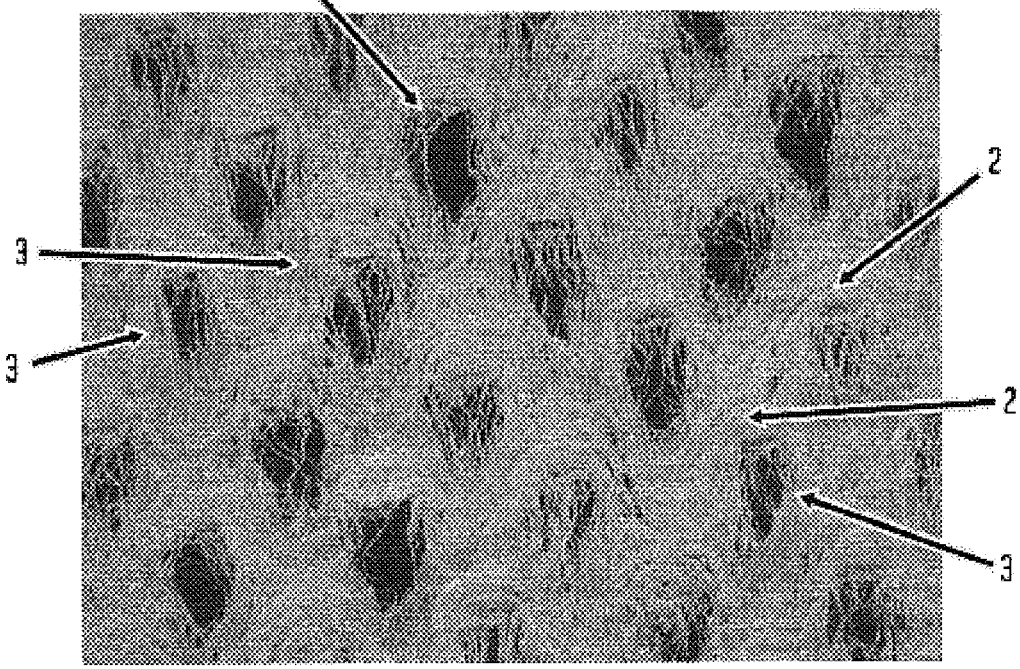
FIG. 5 is a photomicrograph showing a web of the invention having a basis weight of 19 lbs/ream produced with a 40% Fabric Crepe.
Figure 6:
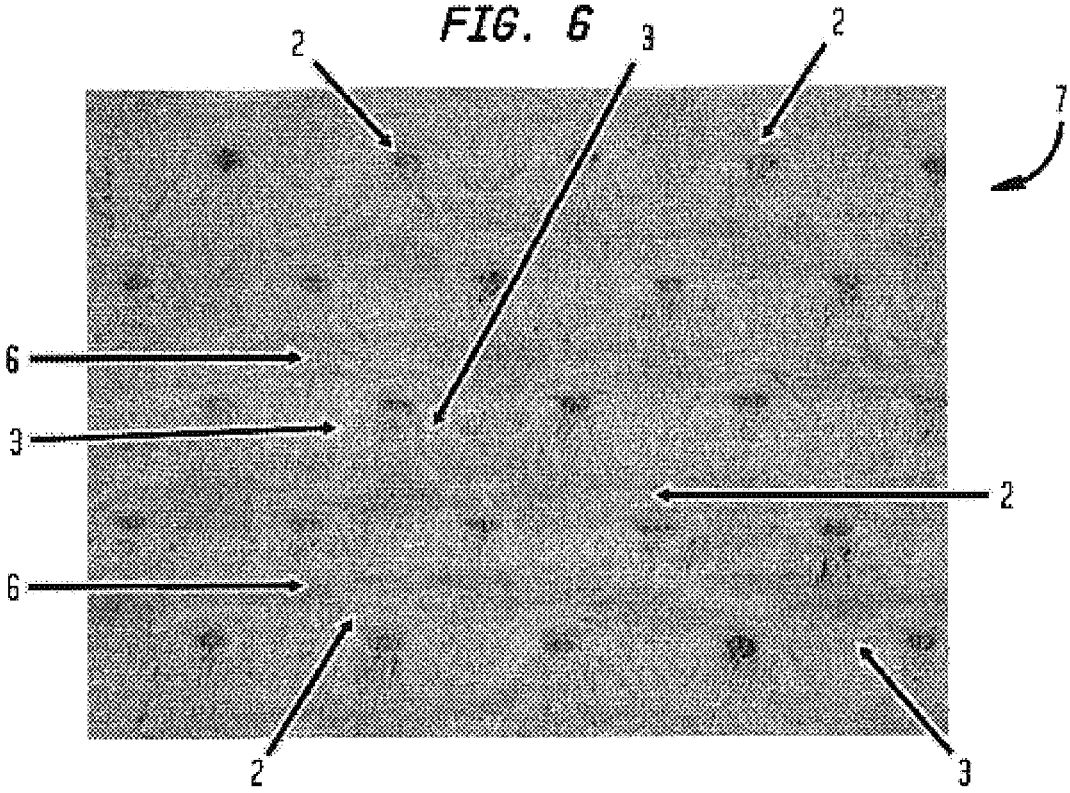
FIG. 6 is a photomicrograph showing a web of the invention having a basis weight of 27 lbs/ream produced with a 28% Fabric Crepe.

While the structure of the inventive products including the pileated and reoriented regions is easily observed in open meshed embodiments of very low basis weight, the ordered structure of the products of the invention is likewise seen when basis weight is increased where integument regions of fiber 6 span the pileated and linking regions as is seen in FIGS. 4 through 6 so that a sheet 7 is provided with substantially continuous surfaces as is seen particularly in FIGS. 4 and 6, where the darker regions are lower in basis weight while the almost solid white regions are relatively compressed fiber.

The impact of processing variables and so forth are also appreciated from FIGS. 4 through 6. FIGS. 4 and 5 both show 19 lb sheet; however, the pattern in terms of variation in basis weight is more prominent in FIG. 5 because the Fabric Crepe was much higher (40% vs. 17%). Likewise, FIG. 6 shows a higher basis weight web (27 lb) at 28% crepe where the pileated, linking and integument regions are all prominent.

Redistribution of fibers from a generally random arrangement into a patterned distribution including orientation bias as well as fiber enriched regions corresponding to the creping belt structure is still further appreciated by reference to FIGS. 7 through 18.

Figure 7:
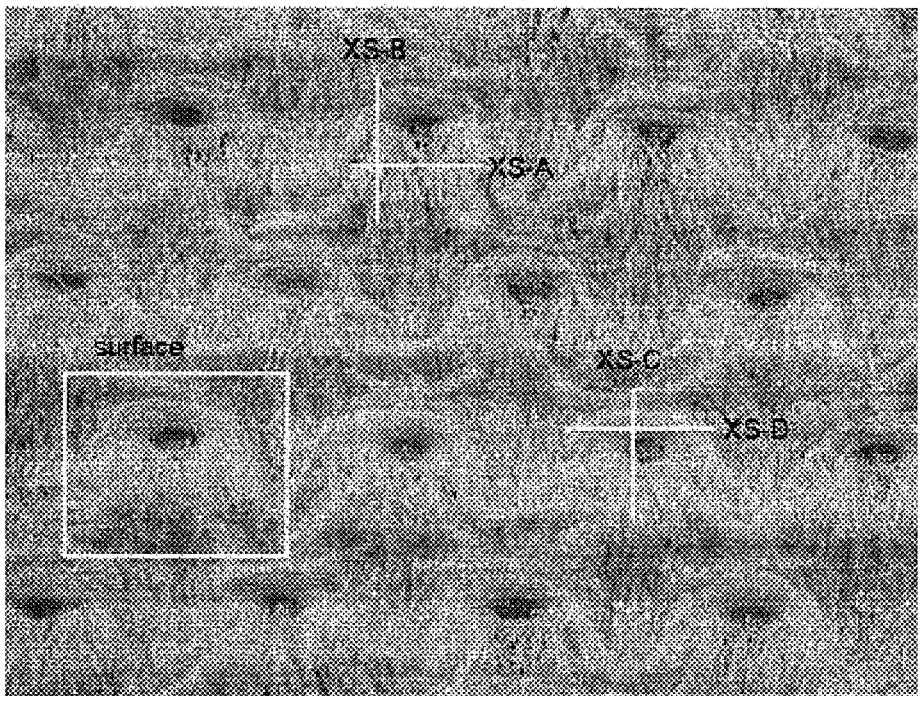
FIG. 7 is a surface image (10×) of an absorbent sheet of the invention, indicating areas where samples for surface and section SEMs were taken.
Figure 8:
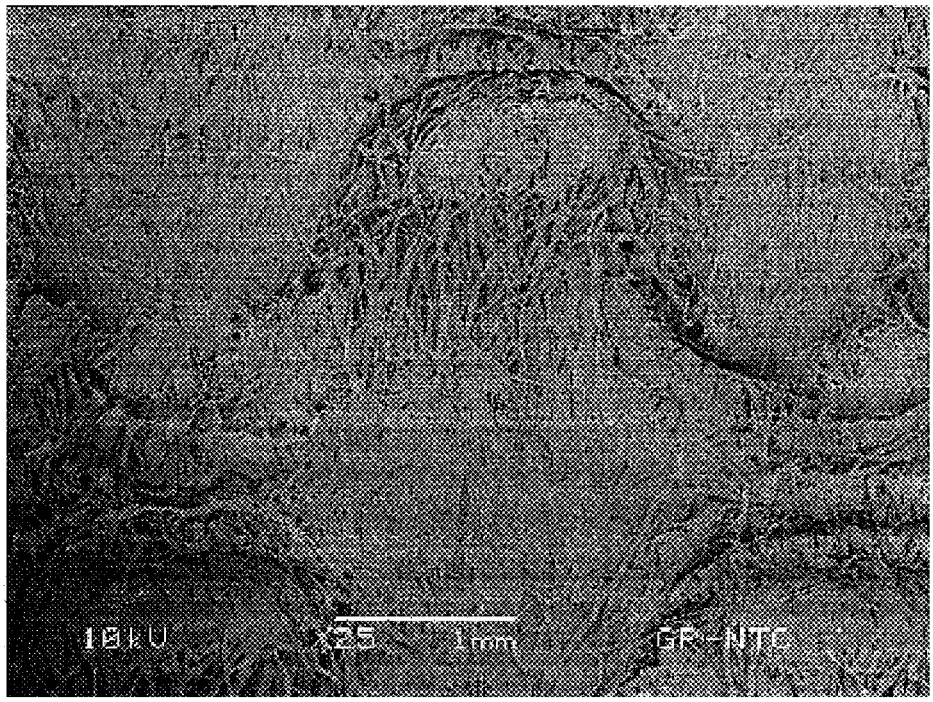
FIGS. 8-10 are surface SEMs of a sample of material taken from the sheet seen in FIG. 7.
Figure 9:
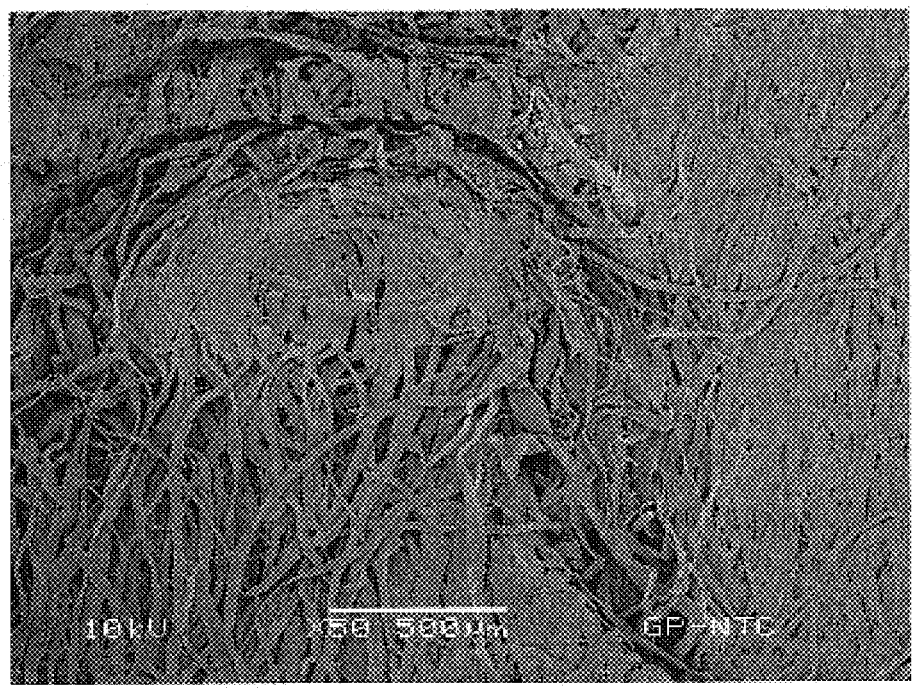
Figure 10:
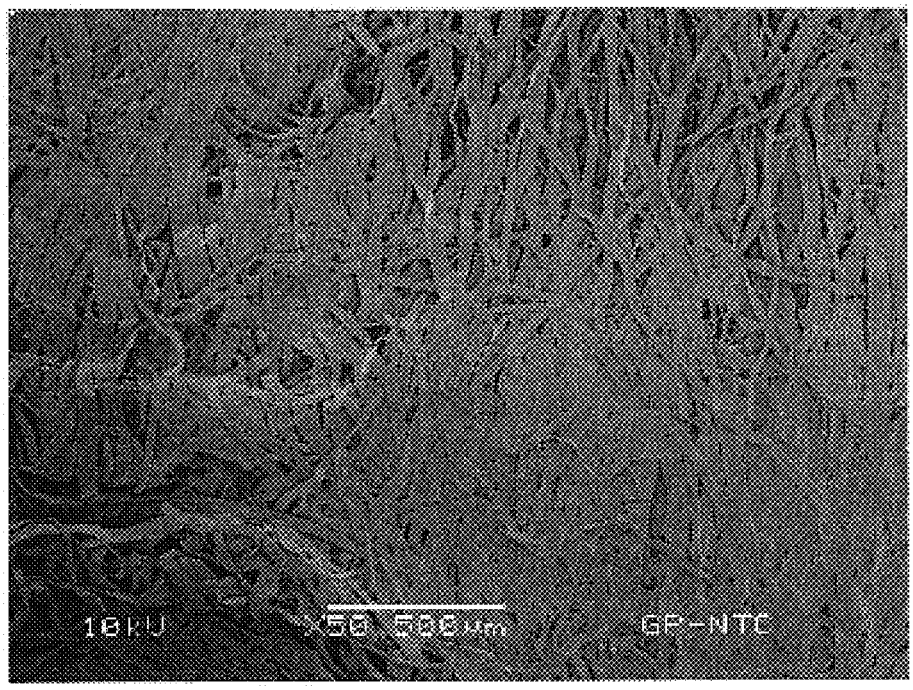

FIG. 7 is a photomicrograph (10×) showing a cellulosic web of the present invention from which a series of samples were prepared and scanning electron micrographs (SEMS) made to further show the fiber structure. On the left of FIG. 7 there is shown a surface area from which the SEM surface images 8, 9 and 10 were prepared. It is seen in these SEMs that the fibers of the linking regions have orientation biased along their direction between pileated regions as was noted earlier in connection with the photomicrographs. It is further seen in FIGS. 8, 9 and 10 that the integument regions formed have a fiber orientation along the machine-direction. The feature is illustrated rather strikingly in FIGS. 11 and 12.

Figure 11:
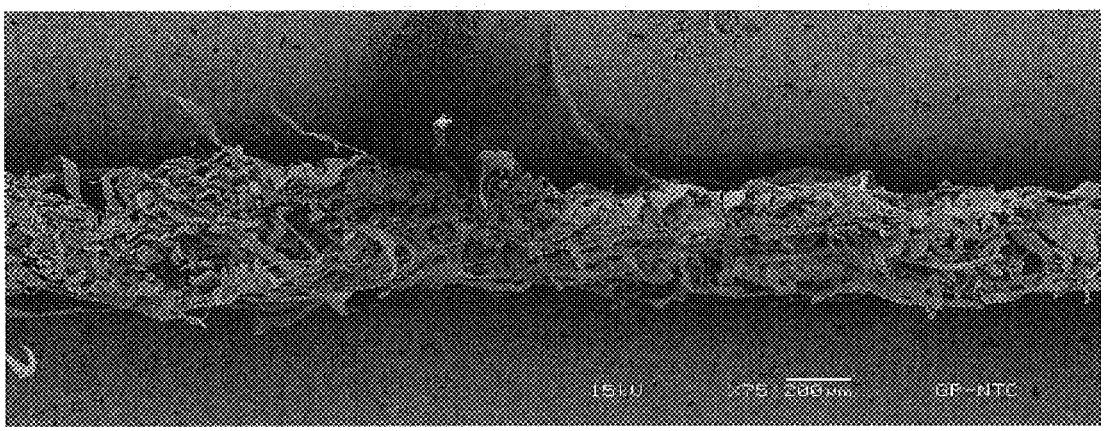
FIGS. 11 and 12 are SEMs of the sheet shown in FIG. 7 in section across the MD.
Figure 12:
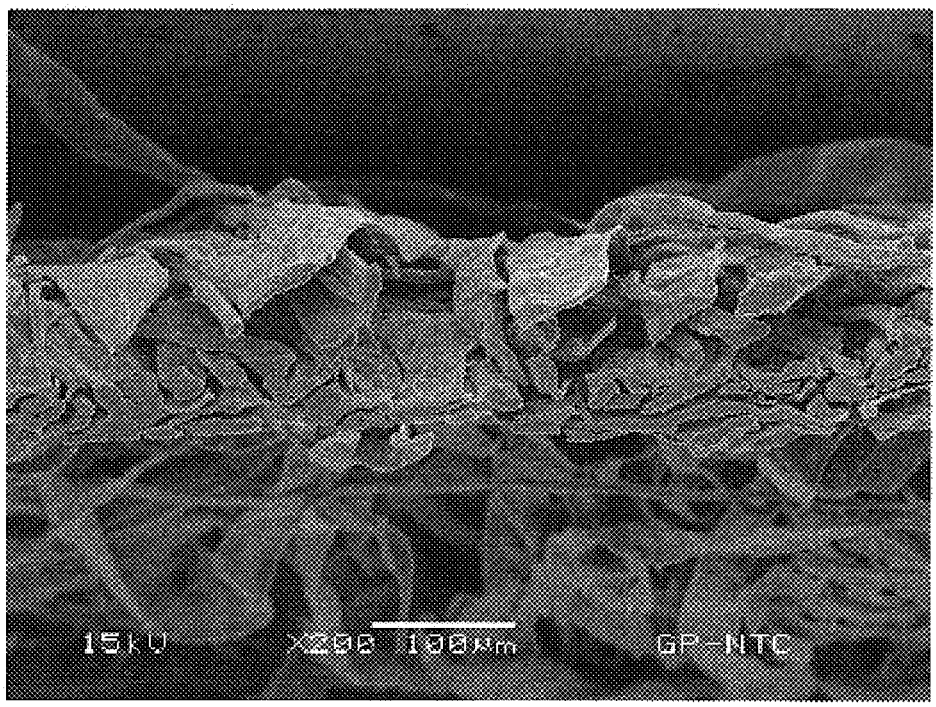

FIGS. 11 and 12 are views along line XS-A of FIG. 7, in section. It is seen especially at 200 magnification (FIG. 12) that the fibers are oriented toward the viewing plane, or machine-direction, inasmuch as the majority of the fibers were cut when the sample was sectioned.

Figure 13:
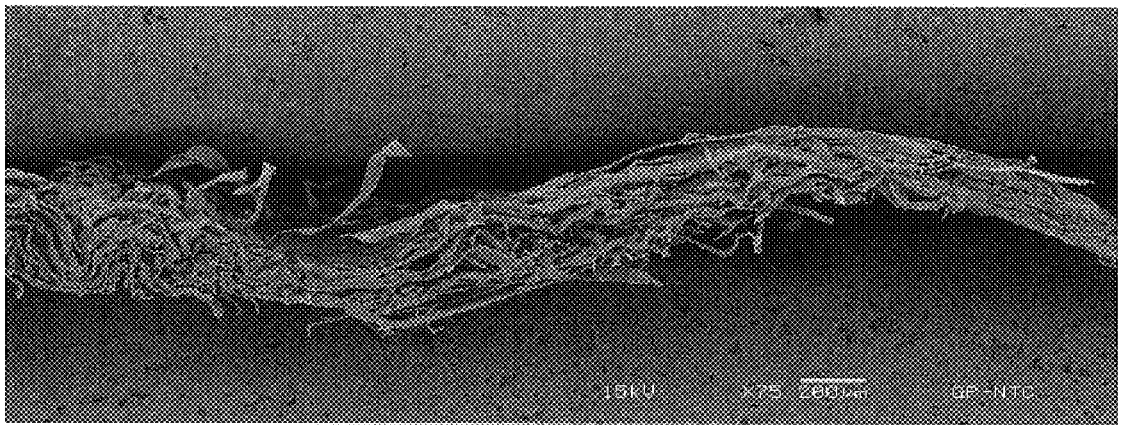
FIGS. 13 and 14 are SEMs of the sheet shown in FIG. 7 in section along the MD.
Figure 14:
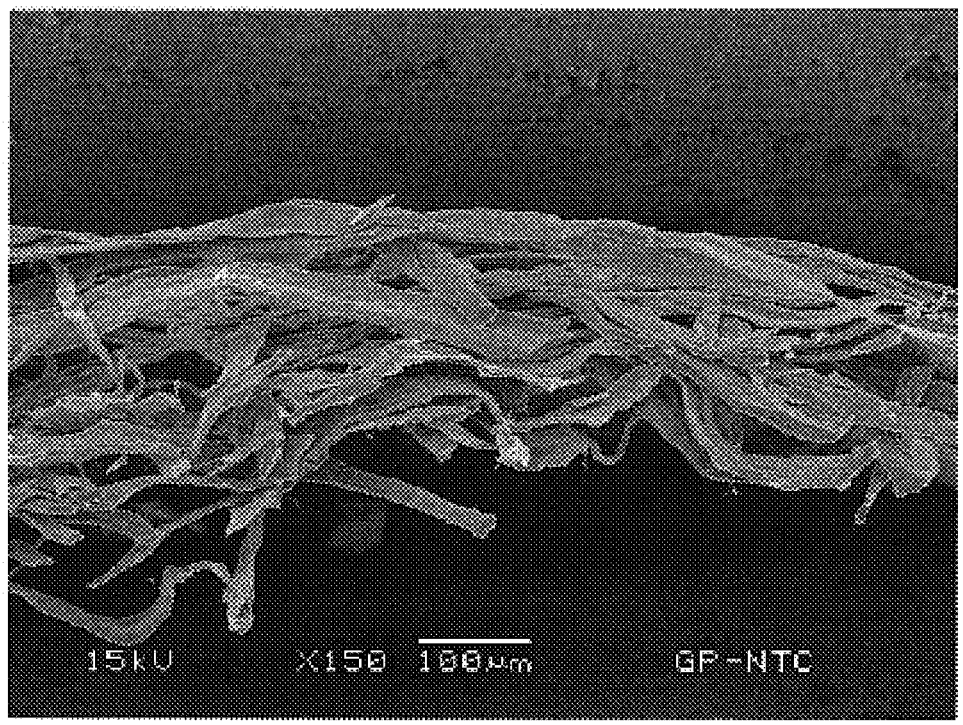

FIGS. 13 and 14, a section along line XS-B of the sample of FIG. 7, shows fewer cut fibers especially at the middle portions of the photomicrographs, again showing an MD orientation bias in these areas.

Figure 15:
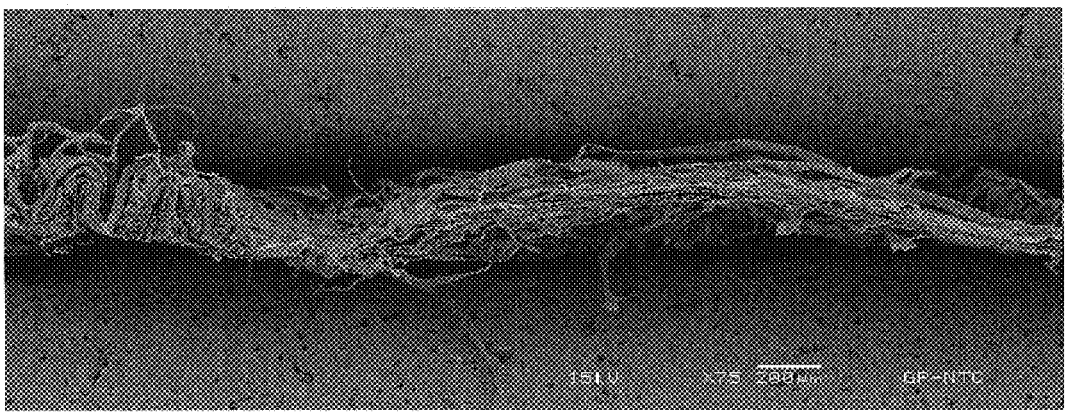
FIGS. 15 and 16 are SEMs of the sheet shown in FIG. 7 in section also along the MD.
Figure 16:
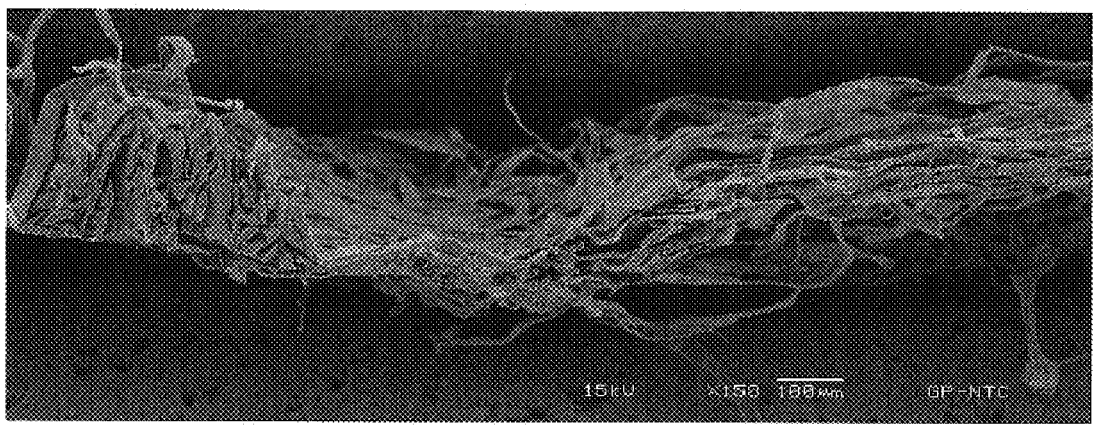

FIGS. 15 and 16 are SEMs of a section of the sample of FIG. 7 along Line XS-C. It is seen in these Figures that the pileated regions (left side) are "stacked up" to a higher local basis weight. Moreover, it is seen in the SEM of FIG. 16 that a large number of fibers have been cut in the pileated region (left) showing reorientation of the fibers in this area in a direction transverse to the MD, in this case along the CD. Also noteworthy is that the number of fiber ends observed diminishes as one moves from left to right, indicating orientation toward the MD as one moves away from the pileated regions.

Figure 17:
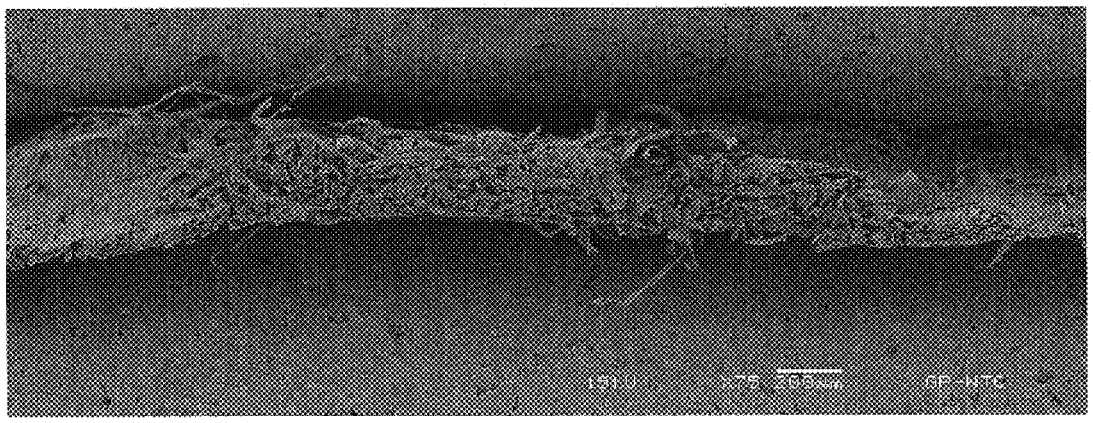
FIGS. 17 and 18 are SEMs of the sheet shown in FIG. 7 in section across the MD.
Figure 18:
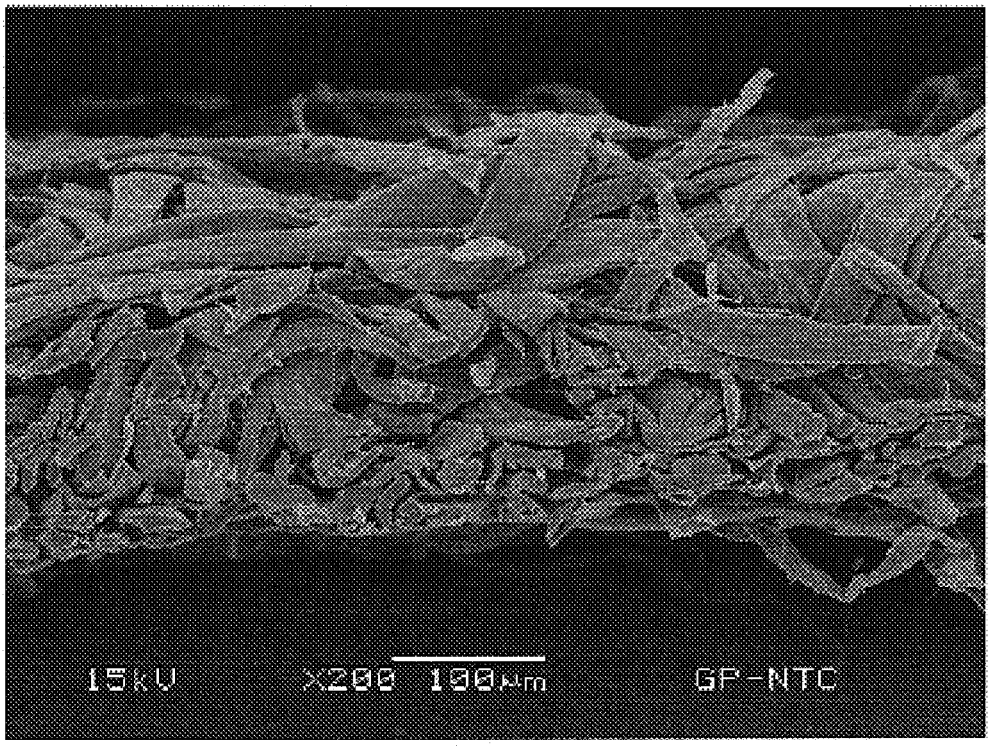

FIGS. 17 and 18 are SEMs of a section taken along line XS-D of FIG. 7. Here it is seen that fiber orientation bias changes as one moves across the CD. On the left, in a linking or colligating region, a large number of "ends" are seen indicating MD bias. In the middle, there are fewer ends as the edge of a pileated region is traversed, indicating more CD bias until another linking region is approached and cut fibers again become more plentiful, again indicating increased MD bias.

Without intending to be bound by theory, it is believed the inventive redistribution of fiber is achieved by an appropriate selection of consistency, fabric or belt pattern, nip parameters, and velocity delta, the difference in speed between the transfer surface and creping belt. Velocity deltas of at least 100 fpm, 200 fpm, 500 fpm, 1000 fpm, 1500 fpm or even in excess of 2000 fpm may be needed under some conditions to achieve the desired redistribution of fiber and combination of properties as will become apparent from the discussion which follows. In many cases, velocity deltas of from about 500 fpm to about 2000 fpm will suffice.

The invention is described in more detail below in connection with numerous embodiments.

Terminology used herein is given its ordinary meaning and the definitions set forth immediately below, unless the context indicates otherwise.

The term "cellulosic", "cellulosic sheet" and the like is meant to include any product incorporating papermaking fiber having cellulose as a major constituent. "Papermaking fibers" include virgin pulps or recycle cellulosic fibers or fiber mixes comprising cellulosic fibers. Fibers suitable for making the webs of this invention include: nonwood fibers, such as cotton fibers or cotton derivatives, abaca, kenaf, sabai grass, flax, esparto grass, straw, jute hemp, bagasse, milkweed floss fibers, and pineapple leaf fibers; and wood fibers such as those obtained from deciduous and coniferous trees, including softwood fibers, such as northern and southern softwood kraft fibers; hardwood fibers, such as eucalyptus, maple, birch, aspen, or the like. Papermaking fibers can be liberated from their source material by any one of a number of chemical pulping processes familiar to one experienced in the art including sulfate, sulfite, polysulfide, soda pulping, etc. The pulp can be bleached if desired by chemical means including the use of chlorine, chlorine dioxide, oxygen and so forth. The products of the present invention may comprise a blend of conventional fibers (whether derived from virgin pulp or recycle sources) and high coarseness lignin-rich tubular fibers, such as bleached chemical thermomechanical pulp (BCTMP). "Furnishes" and like terminology refers to aqueous compositions including papermaking fibers, wet strength resins, debonders and the like for making paper products.

As used herein, the term compactively dewatering the web or furnish refers to mechanical dewatering by wet pressing on a dewatering felt, for example, in some embodiments by use of mechanical pressure applied continuously over the web surface as in a nip between a press roll and a press shoe wherein the web is in contact with a papermaking felt. In other typical embodiments, compactively dewatering the web or furnish is carried out in a transfer nip on an impression or other fabric wherein the web is transferred to a dryer cylinder, for example, such that the furnish is concurrently compactively dewatered and applied to a rotating cylinder. Transfer pressure may be higher in selected areas of the web when an impression fabric is used. The terminology "compactively dewatering" is used to distinguish processes wherein the initial dewatering of the web is carried out largely by thermal means as is the case, for example, in U.S. Pat. No. 4,529,480 to Trokhan and U.S. Pat. No. 5,607,551 to Farrington et al. noted above. Compactively dewatering a web thus refers, for example, to removing water from a nascent web having a consistency of less than 30 percent or so by application of pressure thereto and/or increasing the consistency of the web by about 15 percent or more by application of pressure thereto.

Unless otherwise specified, "basis weight", BWT, bwt and so forth refers to the weight of a 3000 square foot ream of product. Likewise, percent or like terminology refers to weight percent on a dry basis, that is to say, with no free water present, which is equivalent to 5% moisture in the fiber.

Calipers reported herein are 8 sheet calipers unless otherwise indicated.

The sheets are stacked and the caliper measurement taken about the central portion of the stack. Preferably, the test samples are conditioned in an atmosphere of 23°±1.0° C. (73.40°±1.8° F.) at 50% relative humidity for at least about 2 hours and then measured with a Thwing-Albert Model 89-II-JR or Progage Electronic Thickness Tester with 2-in (50.8-mm) diameter anvils, 539±10 grams dead weight load, and 0.231 in./sec descent rate. For finished product testing, each sheet of product to be tested must have the same number of plies as the product is sold. Select and stack eight sheets together. For napkin testing, completely unfold napkins prior to stacking. For basesheet testing off of winders, each sheet to be tested must have the same number of plies as produced off the winder. Select and stack eight sheets together. For basesheet testing off of the papermachine reel, single plies must be used. Select and stack eight sheets together aligned in the MD. On custom embossed or printed product, try to avoid taking measurements in these areas if at all possible. Specific volume is determined from basis weight and caliper.

Absorbency of the inventive products is measured with a simple absorbency tester. The simple absorbency tester is a particularly useful apparatus for measuring the hydrophilicity and absorbency properties of a sample of tissue, napkins, or towel. In this test a sample of tissue, napkins, or towel 2.0 inches in diameter is mounted between a top flat plastic cover and a bottom grooved sample plate. The tissue, napkin, or towel sample disc is held in place by a ⅛ inch wide circumference flange area. The sample is not compressed by the holder. De-ionized water at 73° F. is introduced to the sample at the center of the bottom sample plate through a 1 mm. diameter conduit. This water is at a hydrostatic head of minus 5 mm. Flow is initiated by a pulse introduced at the start of the measurement by the instrument mechanism. Water is thus imbibed by the tissue, napkin, or towel sample from this central entrance point radially outward by capillary action. When the rate of water imbibation decreases below 0.005 gm water per 5 seconds, the test is terminated. The amount of water removed from the reservoir and absorbed by the sample is weighed and reported as grams of water per square meter of sample or grams of water per gram of sheet. In practice, an M/K Systems Inc. Gravimetric Absorbency Testing System is used. This is a commercial system obtainable from M/K Systems Inc., 12 Garden Street, Danvers, Mass., 01923. WAC or water absorbent capacity also referred to as SAT is actually determined by the instrument itself. WAC is defined as the point where the weight versus time graph has a "zero" slope, i.e., the sample has stopped absorbing. The termination criteria for a test are expressed in maximum change in water weight absorbed over a fixed time period. This is basically an estimate of zero slope on the weight versus time graph. The program uses a change of 0.005 g over a 5 second time interval as termination criteria; unless "Slow Sat" is specified in which case the cut off criteria is 1 mg in 20 seconds.

Water absorbency rate is measured in seconds and is the time it takes for a sample to absorb a 0.1 gram droplet of water disposed on its surface by way of an automated syringe. The test specimens are preferably conditioned at 23° C.±1° C. (73.4±1.8° F.) at 50% relative humidity. For each sample, 4 3×3 inch test specimens are prepared. Each specimen is placed in a sample holder such that a high intensity lamp is directed toward the specimen. 0.1 ml of water is deposited on the specimen surface and a stop watch is started. When the water is absorbed, as indicated by lack of further reflection of light from the drop, the stopwatch is stopped and the time recorded to the nearest 0.1 seconds. The procedure is repeated for each specimen and the results averaged for the sample.

Dry tensile strengths (MD and CD), stretch, ratios thereof, break modulus, stress and strain are measured with a standard Instron test device or other suitable elongation tensile tester which may be configured in various ways, typically using 3 or 1 inch wide strips of tissue or towel, conditioned at 50% relative humidity and 23° C. (73.4), with the tensile test run at a crosshead speed of 2 in/min for modulus, 10 in/min for tensile. For purposes of calculating relative modulus values and for generating FIGS. 42-55, inch wide specimens were pulled at 0.5 inches per minute so that a larger number of data points were available. Unless otherwise clear from the context, stretch refers to stretch (elgonation) at break. Break modulus is the ratio of peak load to stretch at peak load.

GMT refers to the geometric mean tensile of the CD and MD tensile.

Tensile energy absorption (TEA) is measured in accordance with TAPPI test method T494 om-01.

Initial MD modulus refers to the maximum MD modulus below 5% strain.

Wet tensile is measured by the Finch cup method or following generally the procedure for dry tensile, wet tensile is measured by first drying the specimens at 100° C. or so and then applying a 1½ inch band of water across the width of the sample with a Payne Sponge Device prior to tensile measurement. The latter method is referred to as the sponge method herein. The Finch cup method uses a three-inch wide strip of tissue that is folded into a loop, clamped in the Finch Cup, then immersed in a water. The Finch Cup, which is available from the Thwing-Albert Instrument Company of Philadelphia, Pa., is mounted onto a tensile tester equipped with a 2.0 pound load cell with the flange of the Finch Cup clamped by the tester's lower jaw and the ends of tissue loop clamped into the upper jaw of the tensile tester. The sample is immersed in water that has been adjusted to a pH of 7.0.+–0.0.1 and the tensile is tested after a 5 second immersion time.

Wet or dry tensile ratios are simply ratios of the values determined by way of the foregoing methods. Unless otherwise specified, a tensile property is a dry sheet property.

The void volume and /or void volume ratio as referred to hereafter, are determined by saturating a sheet with a nonpolar liquid and measuring the amount of liquid absorbed. The volume of liquid absorbed is equivalent to the void volume within the sheet structure. The percent weight increase (PWI) is expressed as grams of liquid absorbed per gram of fiber in the sheet structure times 100, as noted hereinafter. More specifically, for each single-ply sheet sample to be tested, select 8 sheets and cut out a 1 inch by 1 inch square (1 inch in the machine direction and 1 inch in the cross-machine direction). For multi-ply product samples, each ply is measured as a separate entity. Multiple samples should be separated into individual single plies and 8 sheets from each ply position used for testing. Weigh and record the dry weight of each test specimen to the nearest 0.0001 gram. Place the specimen in a dish containing POROFIL™ liquid having a specific gravity of 1.875 grams per cubic centimeter, available from Coulter Electronics Ltd., Northwell Drive, Luton, Beds, England; Part No. 9902458.) After 10 seconds, grasp the specimen at the very edge (1-2 Millimeters in) of one corner with tweezers and remove from the liquid. Hold the specimen with that corner uppermost and allow excess liquid to drip for 30 seconds. Lightly dab (less than ½ second contact) the lower corner of the specimen on #4 filter paper (Whatman Lt., Maidstone, England) in order to remove any excess of the last partial drop. Immediately weigh the specimen, within 10 seconds, recording the weight to the nearest 0.0001 gram. The PWI for each specimen, expressed as grams of POROFIL per gram of fiber, is calculated as follows:

$$PWI=[(W_2-W_1)/W_1]\times 100\%$$

wherein

"$W_1$" is the dry weight of the specimen, in grams; and

"$W_2$" is the wet weight of the specimen, in grams.

The PWI for all eight individual specimens is determined as described above and the average of the eight specimens is the PWI for the sample.

The void volume ratio is calculated by dividing the PWI by 1.9 (density of fluid) to express the ratio as a percentage, whereas the void volume (gms/gm) is simply the weight increase ratio; that is, PWI divided by 100.

Throughout this specification and claims, when we refer to a nascent web having an apparently random distribution of fiber orientation (or use like terminology), we are referring to the distribution of fiber orientation that results when known forming techniques are used for depositing a furnish on the forming fabric. When examined microscopically, the fibers give the appearance of being randomly oriented even though, depending on the jet to wire speed, there may be a significant bias toward machine-direction orientation making the machine-direction tensile strength of the web exceed the cross-direction tensile strength.

Fpm refers to feet per minute while consistency refers to the weight percent fiber of the web. A nascent web of 10 percent consistency is 10 weight percent fiber and 90 weight percent water.

Fabric Crepe Ratio is an expression of the speed differential between the creping fabric and the transfer cylinder or surface and is defined as the ratio of the transfer cylinder speed and the creping fabric speed calculated as:

Fabric Crepe Ratio=Transfer cylinder speed÷Creping fabric speed

Fabric Crepe can also be expressed as a percentage calculated as:

Fabric Crepe, percent,=Fabric Crepe Ratio−1×100%

Reel Crepe is a measure of the speed differential between the Yankee dryer and the take-up reel onto which the paper is being wound and is measured in a similar way:

Reel Crepe Ratio=Yankee dryer speed÷Reel speed, and Reel Crepe, percent=Reel Crepe Ratio−1'100%.

Similarly, the Aggregate Crepe Ratio is defined as:

Aggregate Crepe Ratio=Transfer cylinder speed÷Reel speed, and

Aggregate Crepe, percent=Aggregate Crepe Ratio−1×100%.

The Aggregate Crepe, expressed as a percent, is indicative of the final MD stretch found in sheets made with this process. The contributions to that overall MD stretch can be broken down into the two major creping components, fabric and reel creping, by using the ratio values. For example, if the transfer cylinder speed is 5000 fpm, the creping fabric speed is 4000 fpm and the reel is 3600 fpm, then the following values are obtained:

| | | |
|---|---|---|
| Aggregate Crepe Ratio | 5000/3600 = 1.39 | (39%) |
| Fabric Creping Ratio | 5000/4000 = 1.25 | (25%) |
| Reel Creping Ratio | 4000/3600 = 1.11. | (11%) |

PLI or pli means pounds force per linear inch.

Velocity delta means a difference in speed.

Pusey and Jones hardness (indentation) is measured in accordance with ASTM D 531, and refers to the indentation number (standard specimen and conditions).

Nip parameters include, without limitation, nip pressure, nip length, backing roll hardness, fabric approach angle, fabric takeaway angle, uniformity, and velocity delta between surfaces of the nip.

Nip length means the length over which the nip surfaces are in contact.

According to the present invention, an absorbent paper web is made by dispersing papermaking fibers into aqueous furnish (slurry) and depositing the aqueous furnish onto the forming wire of a papermaking machine. Any suitable forming scheme might be used. For example, an extensive but non-exhaustive list includes a crescent former, a C-wrap twin wire former, an S-wrap twin wire former, a suction breast roll former, a Fourdrinier former, or any art-recognized forming configuration. The forming fabric can be any suitable foraminous member including single layer fabrics, double layer fabrics, triple layer fabrics, photopolymer fabrics, and the like. Non-exhaustive background art in the forming fabric area includes U.S. Pat. Nos. 4,157,276; 4,605,585; 4,161,195; 3,545,705; 3,549,742; 3,858,623; 4,041,989; 4,071,050; 4,112,982; 4,149,571; 4,182,381; 4,184,519; 4,314,589; 4,359,069; 4,376,455; 4,379,735; 4,453,573; 4,564,052; 4,592,395; 4,611,639; 4,640,741; 4,709,732; 4,759,391; 4,759,976; 4,942,077; 4,967,085; 4,998,568; 5,016,678; 5,054,525; 5,066,532; 5,098,519; 5,103,874; 5,114,777; 5,167,261; 5,199,261; 5,199,467; 5,211,815; 5,219,004; 5,245,025; 5,277,761; 5,328,565; and 5,379,808 all of which are incorporated herein by reference in their entirety. One forming fabric particularly useful with the present invention is Voith Fabrics Forming Fabric 2164 made by Voith Fabrics Corporation, Shreveport, La.

Foam-forming of the aqueous furnish on a forming wire or fabric may be employed as a means for controlling the permeability or void volume of the sheet upon wet-creping. Foam-forming techniques are disclosed in U.S. Pat. No. 4,543,156 and Canadian Patent No. 2,053,505, the disclosures of which are incorporated herein by reference. The foamed fiber furnish is made up from an aqueous slurry of fibers mixed with a foamed liquid carrier just prior to its introduction to the headbox. The pulp slurry supplied to the system has a consistency in the range of from about 0.5 to about 7 weight percent fibers, preferably in the range of from about 2.5 to about 4.5 weight percent. The pulp slurry is added to a foamed liquid comprising water, air and surfactant containing 50 to 80 percent air by volume forming a foamed fiber furnish having a consistency in the range of from about 0.1 to about 3 weight percent fiber by simple mixing from natural turbulence and mixing inherent in the process elements. The addition of the pulp as a low consistency slurry results in excess foamed liquid recovered from the forming wires. The excess foamed liquid is discharged from the system and may be used elsewhere or treated for recovery of surfactant therefrom.

The furnish may contain chemical additives to alter the physical properties of the paper produced. These chemistries are well understood by the skilled artisan and may be used in any known combination. Such additives may be surface modifiers, softeners, debonders, strength aids, latexes, opacifiers, optical brighteners, dyes, pigments, sizing agents, barrier chemicals, retention aids, insolubilizers, organic or inorganic crosslinkers, or combinations thereof; said chemicals optionally comprising polyols, starches, PPG esters, PEG esters, phospholipids, surfactants, polyamines, HMCP or the like.

The pulp can be mixed with strength adjusting agents such as wet strength agents, dry strength agents and debonders/softeners and so forth. Suitable wet strength agents are known to the skilled artisan. A comprehensive but non-exhaustive list of useful strength aids include urea-formaldehyde resins, melamine formaldehyde resins, glyoxylated polyacrylamide resins, polyamide-epichlorohydrin resins and the like. Thermosetting polyacrylamides are produced by reacting acrylamide with diallyl dimethyl ammonium chloride (DADMAC) to produce a cationic polyacrylamide copolymer which is ultimately reacted with glyoxal to produce a cationic cross-linking wet strength resin, glyoxylated polyacrylamide. These materials are generally described in U.S. Pat. Nos. 3,556,932 to Coscia et al. and 3,556,933 to Williams et al., both of which are incorporated herein by reference in their entirety. Resins of this type are commercially available under the trade name of PAREZ 631NC by Bayer Corporation. Different mole ratios of acrylamide/-DADMAC/glyoxal can be used to produce cross-linking resins, which are useful as wet strength agents. Furthermore, other dialdehydes can be substituted for glyoxal to produce thermosetting wet strength characteristics. Of particular utility are the polyamide-epichlorohydrin wet strength resins, an example of which is sold under the trade names Kymene 557LX and Kymene 557H by Hercules Incorporated of Wilmington, Del. and Amres® from Georgia-Pacific Resins, Inc. These resins and the process for making the resins are described in U.S. Pat. No. 3,700,623 and U.S. Pat. No. 3,772,076 each of which is incorporated herein by reference in its entirety. An extensive description of polymeric-epihalohydrin resins is given in Chapter 2: *Alkaline-Curing Polymeric Amine-Epichlorohydrin* by Espy in *Wet Strength Resins and Their Application* (L. Chan, Editor, 1994), herein incorporated by reference in its entirety. A reasonably comprehensive list of wet strength resins is described by Westfelt in *Cellulose Chemistry and Technology* Volume 13, p. 813, 1979, which is incorporated herein by reference.

Suitable temporary wet strength agents may likewise be included. A comprehensive but non-exhaustive list of useful temporary wet strength agents includes aliphatic and aromatic aldehydes including glyoxal, malonic dialdehyde, succinic dialdehyde, glutaraldehyde and dialdehyde starches, as well as substituted or reacted starches, disaccharides, polysaccharides, chitosan, or other reacted polymeric reaction products of monomers or polymers having aldehyde groups, and optionally, nitrogen groups. Representative nitrogen containing polymers, which can suitably be reacted with the aldehyde containing monomers or polymers, includes vinyl-amides, acrylamides and related nitrogen containing polymers. These polymers impart a positive charge to the aldehyde containing reaction product. In addition, other commercially available temporary wet strength agents, such as, PAREZ 745, manufactured by Cytec can be used, along with those disclosed, for example in U.S. Pat. No. 4,605,702.

The temporary wet strength resin may be any one of a variety of water-soluble organic polymers comprising aldehydic units and cationic units used to increase dry and wet tensile strength of a paper product. Such resins are described in U.S. Pat. Nos. 4,675,394; 5,240,562; 5,138,002; 5,085,736; 4,981,557; 5,008,344; 4,603,176; 4,983,748; 4,866,151; 4,804,769 and 5,217,576. Modified starches sold under the trademarks CO-BOND® 1000 and CO-BOND® 1000 Plus, by National Starch and Chemical Company of Bridgewater, N.J. may be used. Prior to use, the cationic aldehydic water soluble polymer can be prepared by preheating an aqueous slurry of approximately 5% solids maintained at a temperature of approximately 240 degrees Fahrenheit and a pH of about 2.7 for approximately 3.5 minutes. Finally, the slurry can be quenched and diluted by adding water to produce a mixture of approximately 1.0% solids at less than about 130 degrees Fahrenheit.

Other temporary wet strength agents, also available from National Starch and Chemical Company are sold under the trademarks CO-BOND ® 1600 and CO-BOND® 2300. These starches are supplied as aqueous colloidal dispersions and do not require preheating prior to use.

Temporary wet strength agents such as glyoxylated polyacrylamide can be used. Temporary wet strength agents such glyoxylated polyacrylamide resins are produced by reacting acrylamide with diallyl dimethyl ammonium chloride (DADMAC) to produce a cationic polyacrylamide copolymer which is ultimately reacted with glyoxal to produce a cationic cross-linking temporary or semi-permanent wet strength resin, glyoxylated polyacrylamide. These materials are generally described in U.S. Pat. No. 3,556,932 to Coscia et al. and U.S. Pat. No. 3,556,933 to Williams et al., both of which are incorporated herein by reference. Resins of this type are commercially available under the trade name of PAREZ 631NC, by Cytec Industries. Different mole ratios of acrylamide/DADMAC/glyoxal can be used to produce cross-linking resins, which are useful as wet strength agents. Furthermore, other dialdehydes can be substituted for glyoxal to produce wet strength characteristics.

Suitable dry strength agents include starch, guar gum, polyacrylamides, carboxymethyl cellulose and the like. Of particular utility is carboxymethyl cellulose, an example of which is sold under the trade name Hercules CMC, by Hercules Incorporated of Wilmington, Del. According to one embodiment, the pulp may contain from about 0 to about 15 lb/ton of dry strength agent. According to another embodiment, the pulp may contain from about 1 to about 5 lbs/ton of dry strength agent.

Suitable debonders are likewise known to the skilled artisan. Debonders or softeners may also be incorporated into the pulp or sprayed upon the web after its formation. The present invention may also be used with softener materials including but not limited to the class of amido amine salts derived from partially acid neutralized amines. Such materials are disclosed in U.S. Pat. No. 4,720,383. Evans, *Chemistry and Industry*, 5 Jul. 1969, pp. 893-903; Egan, *J.Am. Oil Chemist's Soc.*, Vol. 55 (1978), pp. 118-121; and Trivedi et al., *J.Am.Oil Chemist's Soc., June* 1981, pp. 754-756, incorporated by reference in their entirety, indicate that softeners are often available commercially only as complex mixtures rather than as single compounds. While the following discussion will focus on the predominant species, it should be understood that commercially available mixtures would generally be used in practice.

Quasoft 202-JR is a suitable softener material, which may be derived by alkylating a condensation product of oleic acid and diethylenetriamine. Synthesis conditions using a deficiency of alkylation agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10%) of the resulting amido amine cyclize to imidazoline compounds. Since only the imidazoline portions of these materials are quaternary ammonium compounds, the compositions as a whole are pH-sensitive. Therefore, in the practice of the present invention with this class of chemicals, the pH in the head box should be approximately 6 to 8, more preferably 6 to 7 and most preferably 6.5 to 7.

Quaternary ammonium compounds, such as dialkyl dimethyl quaternary ammonium salts are also suitable particularly when the alkyl groups contain from about 10 to 24 carbon atoms. These compounds have the advantage of being relatively insensitive to pH.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entirety. The compounds are biodegradable diesters of quaternary ammonia compounds, quaternized amine-esters, and biodegradable vegetable oil based esters functional with quaternary ammonium chloride and diester dierucyldimethyl ammonium chloride and are representative biodegradable softeners.

In some embodiments, a particularly preferred debonder composition includes a quaternary amine component as well as a nonionic surfactant.

The nascent web is typically dewatered on a papermaking felt. Any suitable felt may be used. For example, felts can have double-layer base weaves, triple-layer base weaves, or laminated base weaves. Preferred felts are those having the laminated base weave design. A wet-press-felt which may be particularly useful with the present invention is AMFlex 3 made by Voith Fabric. Background art in the press felt area includes U.S. Pat. Nos. 5,657,797; 5,368,696; 4,973,512; 5,023,132; 5,225,269; 5,182,164; 5,372,876; and 5,618,612. A differential pressing felt as is disclosed in U.S. Pat. No. 4,533,437 to Curran et al. may likewise be utilized.

Suitable creping fabrics include single layer, multi-layer, or composite preferably open meshed structures. Fabrics may have at least one of the following characteristics: (1) on the side of the creping fabric that is in contact with the wet web (the "top" side), the number of machine-direction (MD) strands per inch (mesh) is from 10 to 200 and the number of cross-direction (CD) strands per inch (count) is also from 10 to 200; (2) The strand diameter is typically smaller than 0.050 inch; (3) on the top side, the distance between the highest point of the MD knuckles and the highest point on the CD knuckles is from about 0.001 to about 0.02 or 0.03 inch; (4) In between these two levels there can be knuckles formed either by MD or CD strands that give the topography a three dimensional hill/valley appearance which is imparted to the sheet during the wet molding step; (5) The fabric may be oriented in any suitable way so as to achieve the desired effect on processing and on properties in the product; the long warp knuckles may be on the top side to increase MD ridges in the product, or the long shute knuckles may be on the top side if more CD ridges are desired to influence creping characteristics as the web is transferred from the transfer cylinder to the creping fabric; and (6) the fabric may be made to show certain geometric patterns that are pleasing to the eye, which is typically repeated between every two to 50 warp yarns. Suitable commercially available coarse fabrics include a number of fabrics made by Asten Johnson Forming Fabrics, Inc., including without limitation Asten 934, 920, 52B, and Velostar V-800. As hereinafter described, creping belts are also usable.

The creping adhesive used on the Yankee cylinder is capable of cooperating with the web at intermediate moisture to facilitate transfer from the creping fabric to the Yankee and to firmly secure the web to the Yankee cylinder as it is dried to a consistency of 95% or more on the cylinder preferably with a high volume drying hood. The adhesive is critical to stable system operation at high production rates and is a hygroscopic, re-wettable, substantially non-crosslinking adhesive. Examples of preferred adhesives are those which include poly(vinyl alcohol) of the general class described in U.S. Pat. No. 4,528,316 to Soerens et al. Other suitable adhesives are disclosed in co-pending U.S. patent application Ser. No. 10/409,042, filed Apr. 9, 2003 (United States Patent Publication No. 2005/0006040 Al, published Jan. 13. 2005), entitled "Improved Creping Adhesive Modifier and Process for Producing Paper Products". The disclosures of the '316 patent and the '255 application are incorporated herein by reference. Suitable adhesives are optionally provided with modifiers and so forth. It is preferred to use crosslinker sparingly or not at all in the adhesive in many cases; such that the resin is substantially non-crosslinkable in use.

Creping adhesives may comprise a thermosetting or non-thermosetting resin, a film-forming semi-crystalline polymer and optionally an inorganic cross-linking agent as well as modifiers. Optionally, the creping adhesive of the present invention may also include any art-recognized components, including, but not limited to, organic cross linkers, hydrocarbons oils, surfactants, or plasticizers.

Creping modifiers which may be used include a quaternary ammonium complex comprising at least one non-cyclic amide. The quaternary ammonium complex may also contain one or several nitrogen atoms (or other atoms) that are capable of reacting with alkylating or quaternizing agents. These alkylating or quaternizing agents may contain zero, one, two, three or four non-cyclic amide containing groups. An amide containing group is represented by the following formula structure:

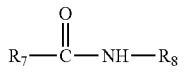

where $R_7$ and $R_8$ are non-cyclic molecular chains of organic or inorganic atoms.

Preferred non-cyclic bis-amide quaternary ammonium complexes can be of the formula:

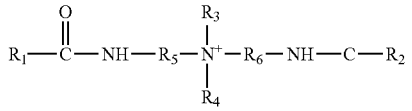

where $R_1$ and $R_2$ can be long chain non-cyclic saturated or unsaturated aliphatic groups; $R_3$ and $R_4$ can be long chain non-cyclic saturated or unsaturated aliphatic groups, a halogen, a hydroxide, an alkoxylated fatty acid, an alkoxylated fatty alcohol, a polyethylene oxide group, or an organic alcohol group; and $R_5$ and $R_6$ can be long chain non-cyclic saturated or unsaturated aliphatic groups. The modifier is present in the creping adhesive in an amount of from about 0.05% to about 50%, more preferably from about 0.25% to about 20%, and most preferably from about 1% to about 18% based on the total solids of the creping adhesive composition.

Modifiers include those obtainable from Goldschmidt Corporation of Essen/Germany or Process Application Corporation based in Washington Crossing, Pa. Appropriate creping modifiers from Goldschmidt Corporation include, but are not limited to, VARISOFT® 222LM, VARISOFT® 222, VARISOFT® 110, VARISOFT® 222LT, VARISOFT® 110 DEG, and VARISOFT® 238. Appropriate creping modifiers from Process Application Corporation include, but are not limited to, PALSOFT 580 FDA or PALSOFT 580C.

Other creping modifiers for use in the present invention include, but are not limited to, those compounds as described in WO/01/85109, which is incorporated herein by reference in its entirety.

Creping adhesives for use according to the present invention include any art recognized thermosetting or non-thermosetting resin. Resins according to the present invention are preferably chosen from thermosetting and non-thermosetting polyamide resins or glyoxylated polyacrylamide resins. Polyamides for use in the present invention can be branched or unbranched, saturated or unsaturated.

Polyamide resins for use in the present invention may include polyaminoamide-epichlorohydrin (PAE) resins of the same general type employed as wet strength resins. PAE resins are described, for example, in "Wet-Strength Resins and Their Applications,"Ch. 2, H. Epsy entitled Alkaline-Curing Polymeric Amine-Epichlorohydrin Resins, which is incorporated herein by reference in its entirety. Preferred PAE resins for use according to the present invention include a water-soluble polymeric reaction product of an epihalohydrin, preferably epichlorohydrin, and a water-soluble polyamide having secondary amine groups derived from a polyalkylene polyamine and a saturated aliphatic dibasic carboxylic acid containing from about 3 to about 10 carbon atoms.

A non-exhaustive list of non-thermosetting cationic polyamide resins can be found in U.S. Pat. No. 5,338,807, issued to Espy et al. and incorporated herein by reference. The non-thermosetting resin may be synthesized by directly reacting the polyamides of a dicarboxylic acid and methyl bis(3-aminopropyl)amine in an aqueous solution, with epichlorohydrin. The carboxylic acids can include saturated and unsaturated dicarboxylic acids having from about 2 to 12 carbon atoms, including for example, oxalic, malonic, succinic, glutaric, adipic, pilemic, suberic, azelaic, sebacic, maleic, itaconic, phthalic, and terephthalic acids. Adipic and glutaric acids are preferred, with adipic acid being the most preferred. The esters of the aliphatic dicarboxylic acids and aromatic dicarboxylic acids, such as the phathalic acid, may be used, as well as combinations of such dicarboxylic acids or esters.

Thermosetting polyamide resins for use in the present invention may be made from the reaction product of an epihalohydrin resin and a polyamide containing secondary amine or tertiary amines. In the preparation of such a resin, a dibasic carboxylic acid is first reacted with the polyalkylene polyamine, optionally in aqueous solution, under conditions suitable to produce a water-soluble polyamide. The preparation of the resin is completed by reacting the water-soluble amide with an epihalohydrin, particularly epichlorohydrin, to form the water-soluble thermosetting resin.

The of preparation of water soluble, thermosetting polyamide-epihalohydrin resin is described in U.S. Pat. Nos. 2,926,116; 3,058,873; and 3,772,076 issued to Kiem, all of which are incorporated herein by reference in their entirety.

The polyamide resin may be based on DETA instead of a generalized polyamine. Two examples of structures of such a polyamide resin are given below. Structure 1 shows two types of end groups: a di-acid and a mono-acid based group:

STRUCTURE 1

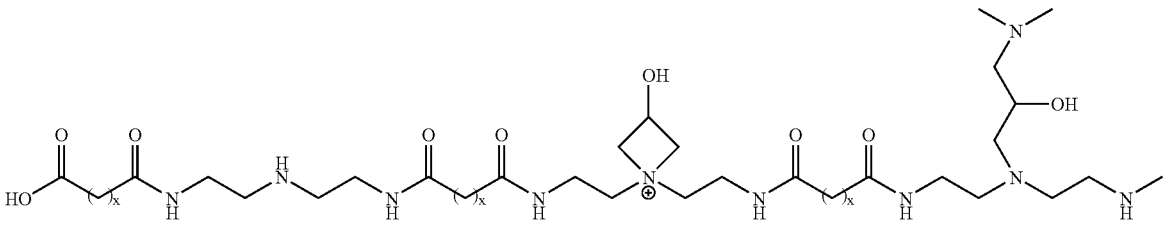

-continued

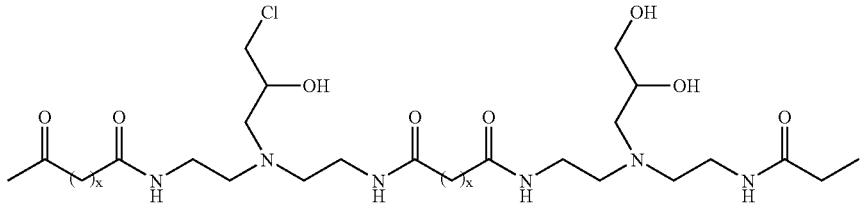

Structure 2 shows a polymer with one end-group based on a di-acid group and the other end-group based on a nitrogen group:

STRUCTURE 2

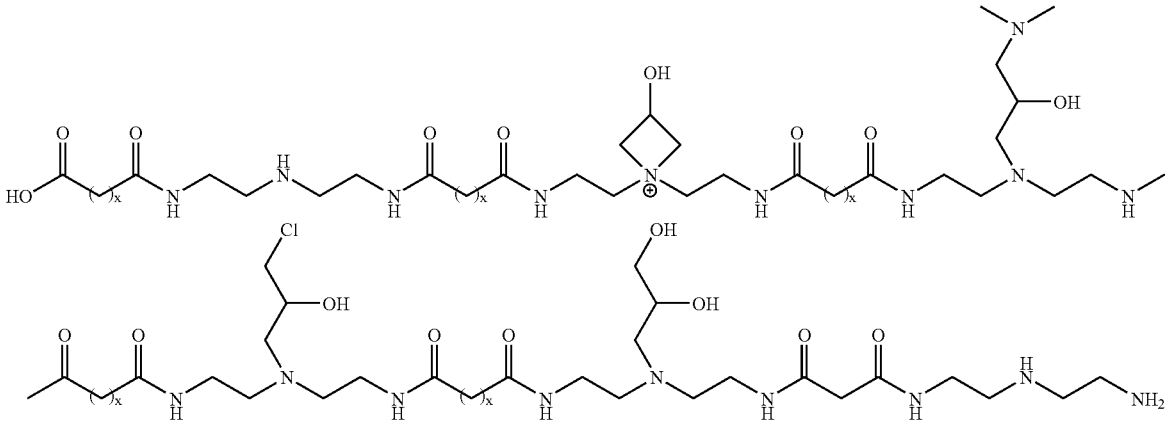

Note that although both structures are based on DETA, other polyamines may be used to form this polymer, including those, which may have tertiary amide side chains.

The polyamide resin has a viscosity of from about 80 to about 800 centipoise and a total solids of from about 5% to about 40%. The polyamide resin is present in the creping adhesive according to the present invention in an amount of from about 0% to about 99.5%. According to another embodiment, the polyamide resin is present in the creping adhesive in an amount of from about 20% to about 80%. In yet another embodiment, the polyamide resin is present in the creping adhesive in an amount of from about 40% to about 60% based on the total solids of the creping adhesive composition.

Polyamide resins for use according to the present invention can be obtained from Ondeo-Nalco Corporation, based in Naperville, Ill., and Hercules Corporation, based in Wilmington, Del. Creping adhesive resins for use according to the present invention from Ondeo-Nalco Corporation include, but are not limited to, CREPECCEL® 675NT, CREPECCEL® 675P and CREPECCEL® 690HA. Appropriate creping adhesive resins available from Hercules Corporation include, but are not limited to, HERCULES 82-176, Unisoft 805 and CREPETROL A-6115.

Other polyamide resins for use according to the present invention include, for example, those described in U.S. Pat. Nos. 5,961,782 and 6,133,405, both of which are incorporated herein by reference.

The creping adhesive may also comprise a film-forming semi-crystalline polymer. Film-forming semi-crystalline polymers for use in the present invention can be selected from, for example, hemicellulose, carboxymethyl cellulose, and most preferably includes polyvinyl alcohol (PVOH). Polyvinyl alcohols used in the creping adhesive can have an average molecular weight of about 13,000 to about 124,000 daltons. According to one embodiment, the polyvinyl alcohols have a degree of hydrolysis of from about 80% to about 99.9%. According to another embodiment, polyvinyl alcohols have a degree of hydrolysis of from about 85% to about 95%. In yet another embodiment, polyvinyl alcohols have a degrees of hydrolysis of from about 86% to about 90%. Also, according to one embodiment, polyvinyl alcohols preferably have a viscosity, measured at 20 degree centigrade using a 4% aqueous solution, of from about 2 to about 100 centipoise. According to another embodiment, polyvinyl alcohols have a viscosity of from about 10 to about 70 centipoise. In yet another embodiment, polyvinyl alcohols have a viscosity of from about 20 to about 50 centipoise.

Typically, the polyvinyl alcohol is present in the creping adhesive in an amount of from about 10% to 90% or 20% to about 80% or more. In some embodiments, the polyvinyl alcohol is present in the creping adhesive in an amount of from about 40% to about 60%, by weight, based on the total solids of the creping adhesive composition.

Polyvinyl alcohols for use according to the present invention include those obtainable from Monsanto Chemical Co. and Celanese Chemical. Appropriate polyvinyl alcohols from Monsanto Chemical Co. include Gelvatols, including, but not limited to, GELVATOL 1-90, GELVATOL 3-60, GELVATOL 20-30, GELVATOL 1-30, GELVATOL 20-90, and GELVATOL 20-60. Regarding the Gelvatols, the first number indicates the percentage residual polyvinyl acetate and the next series of digits when multiplied by 1,000 gives the number corresponding to the average molecular weight.

Celanese Chemical polyvinyl alcohol products for use in the creping adhesive (previously named Airvol products from Air Products until October 2000) are listed below:

TABLE 1

Polyvinyl Alcohol for Creping Adhesive

| Grade | % Hydrolysis, | Viscosity, cps[1] | pH | Volatiles, % Max. | Ash, % Max.[3] |
|---|---|---|---|---|---|
| Super Hydrolyzed | | | | | |
| Celvol 125 | 99.3+ | 28-32 | 5.5-7.5 | 5 | 1.2 |
| Celvol 165 | 99.3+ | 62-72 | 5.5-7.5 | 5 | 1.2 |
| Fully Hydrolyzed | | | | | |
| Celvol 103 | 98.0-98.8 | 3.5-4.5 | 5.0-7.0 | 5 | 1.2 |
| Celvol 305 | 98.0-98.8 | 4.5-5.5 | 5.0-7.0 | 5 | 1.2 |
| Celvol 107 | 98.0-98.8 | 5.5-6.6 | 5.0-7.0 | 5 | 1.2 |
| Celvol 310 | 98.0-98.8 | 9.0-11.0 | 5.0-7.0 | 5 | 1.2 |
| Celvol 325 | 98.0-98.8 | 28.0-32.0 | 5.0-7.0 | 5 | 1.2 |
| Celvol 350 | 98.0-98.8 | 62-72 | 5.0-7.0 | 5 | 1.2 |
| Intermediate Hydrolyzed | | | | | |
| Celvol 418 | 91.0-93.0 | 14.5-19.5 | 4.5-7.0 | 5 | 0.9 |
| Celvol 425 | 95.5-96.5 | 27-31 | 4.5-6.5 | 5 | 0.9 |
| Partially Hydrolyzed | | | | | |
| Celvol 502 | 87.0-89.0 | 3.0-3.7 | 4.5-6.5 | 5 | 0.9 |
| Celvol 203 | 87.0-89.0 | 3.5-4.5 | 4.5-6.5 | 5 | 0.9 |
| Celvol 205 | 87.0-89.0 | 5.2-6.2 | 4.5-6.5 | 5 | 0.7 |
| Celvol 513 | 86.0-89.0 | 13-15 | 4.5-6.5 | 5 | 0.7 |
| Celvol 523 | 87.0-89.0 | 23-27 | 4.0-6.0 | 5 | 0.5 |
| Celvol 540 | 87.0-89.0 | 45-55 | 4.0-6.0 | 5 | 0.5 |

[1]4% aqueous solution, 20

The creping adhesive may also comprise one or more inorganic cross-linking salts or agents. Such additives are believed best used sparingly or not at all in connection with the present invention. A non-exhaustive list of multivalent metal ions includes calcium, barium, titanium, chromium, manganese, iron, cobalt, nickel, zinc, molybdenium, tin, antimony, niobium, vanadium, tungsten, selenium, and zirconium. Mixtures of metal ions can be used. Preferred anions include acetate, formate, hydroxide, carbonate, chloride, bromide, iodide, sulfate, tartrate, and phosphate. An example of a preferred inorganic cross-linking salt is a zirconium salt. The zirconium salt for use according to one embodiment of the present invention can be chosen from one or more zirconium compounds having a valence of plus four, such as ammonium zirconium carbonate, zirconium acetylacetonate, zirconium acetate, zirconium carbonate, zirconium sulfate, zirconium phosphate, potassium zirconium carbonate, zirconium sodium phosphate, and sodium zirconium tartrate. Appropriate zirconium compounds include, for example, those described in U.S. Pat. No. 6,207,011, which is incorporated herein by reference.

The inorganic cross-linking salt can be present in the creping adhesive in an amount of from about 0% to about 30%. In another embodiment, the inorganic cross-linking agent can be present in the creping adhesive in an amount of from about 1% to about 20%. In yet another embodiment, the inorganic cross-linking salt can be present in the creping adhesive in an amount of from about 1% to about 10% by weight based on the total solids of the creping adhesive composition. Zirconium compounds for use according to the present invention include those obtainable from EKA Chemicals Co. (previously Hopton Industries) and Magnesium Elektron, Inc. Appropriate commercial zirconium compounds from EKA Chemicals Co. are AZCOTE 5800M and KZCOTE 5000 and from Magnesium Elektron, Inc. are AZC or KZC.

Optionally, the creping adhesive according to the present invention can include any other art recognized components, including, but not limited to, organic cross-linkers, hydrocarbon oils, surfactants, amphoterics, humectants, plasticizers, or other surface treatment agents. An extensive, but non-exhaustive, list of organic cross-linkers includes glyoxal, maleic anhydride, bismaleimide, bis acrylamide, and epihalohydrin. The organic cross-linkers can be cyclic or non-cyclic compounds. Plastizers for use in the present invention can include propylene glycol, diethylene glycol, triethylene glycol, dipropylene glycol, and glycerol.

The creping adhesive may be applied as a single composition or may be applied in its component parts. More particularly, the polyamide resin may be applied separately from the polyvinyl alcohol (PVOH) and the modifier.

Typical operating conditions of the papermaking process illustrated herein may include a water rate of from about 120 to about 200 gallons/minute/inch of headbox width. KYMENE SLX wet strength resin may be added at the machine chest stock pumps at the rate of about 20 lbs/ton, while CMC-7MT is added downstream of the machine chest, but before the fan pumps. CMC-7MT is added at a rate of about 3 lbs/ton.

Figure 19:
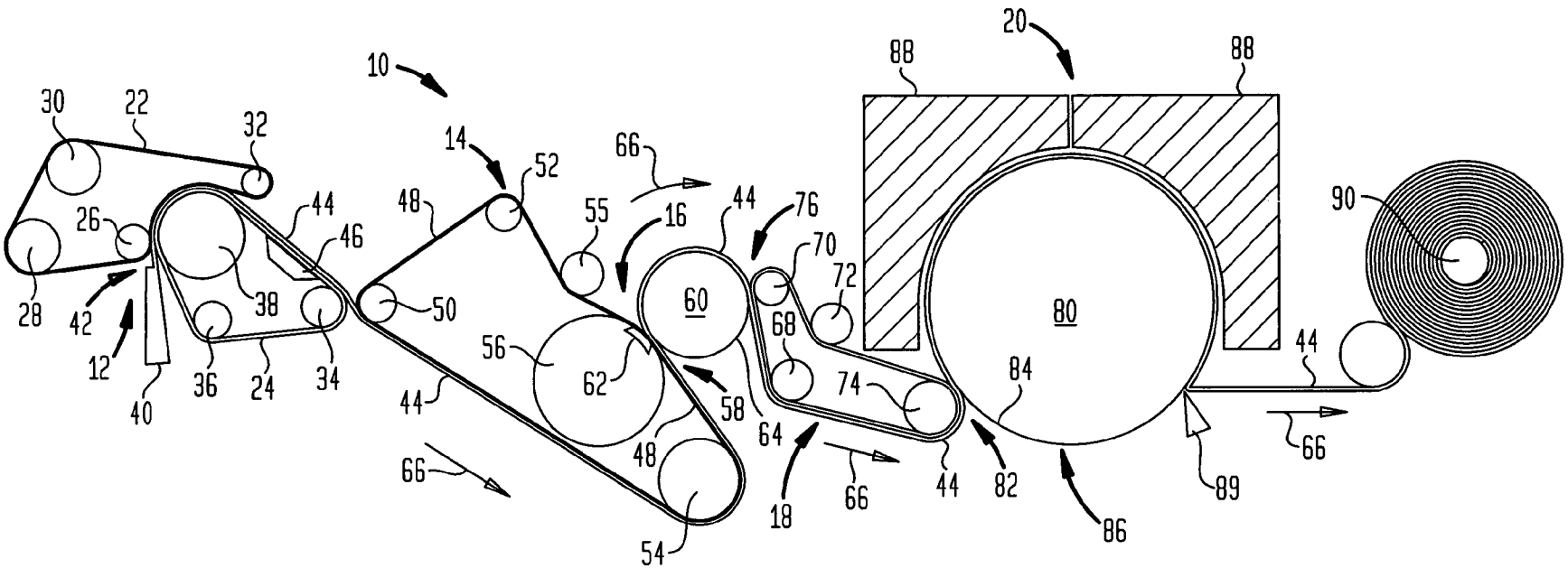
FIG. 19 is a schematic diagram of a papermachine layout for practicing the present invention.

If a twin wire former is used as is shown in FIG. 19, the nascent web is conditioned with vacuum boxes and a steam shroud until it reaches a solids content suitable for transferring to a dewatering felt. The nascent web may be transferred with vacuum assistance to the felt. In a crescent former, these steps are unnecessary as the nascent web is formed between the forming fabric and the felt. After further fabric creping as described hereinbelow, the web may be pattern pressed to the Yankee dryer at a pressure of about 200 to about 400 pounds per linear inch (pli). The Yankee dryer may be conditioned with a creping adhesive containing about 40% polyvinyl alcohol, about 60% PAE, and about 1.5% of the creping modifier. The polyvinyl alcohol is typically a low molecular weight polyvinyl alcohol(87-89% hydrolyzed) obtained from Air Products under the trade name AIRVOL 523. The PAE is a 16% aqueous solution of 100% cross-linked polyaminoamide epichlorohydrin copolymer of adipic acid and diethylenetriamine obtained from Ondeo-Nalco under the trade name NALCO 690HA. The creping modifier may be a 47% 2-hydroxyethyl di-(2-alkylamido-ethyl) methyl ammonium methyl sulfate and other non-cyclic alkyl and alkoxy amides and diamides containing a mixture of stearic, oleic, and linolenic alkyl groups obtained from Process Applications, Ltd., under the trade name PALSOFT 580C.

The creping adhesive is applied in an amount of 0.040 g/m$^2$. After the web was transferred to the Yankee dryer, it was dried to a solids content of about 95% or so using pressurized steam to heat the Yankee cylinder and high velocity air hoods. The web was creped using a doctor blade and wrapped to a reel. The line load at the creping doctor and cleaning doctor may be, for example, about 50 pli.

FIG. 19 is a schematic diagram of a papermachine 10 having a conventional twin wire forming section 12, a felt run 14, a shoe press section 16, a creping fabric 18 and a Yankee dryer 20 suitable for practicing the present invention. Forming section 12 includes a pair of forming fabrics 22, 24 supported by a plurality of rolls 26, 28, 30, 32, 34, 36 and a forming roll 38. A headbox 40 provides papermaking furnish to a nip 42 between forming roll 38 and roll 26 and the fabrics. The furnish forms a nascent web 44 which is dewatered on the fabrics with the assistance of vacuum, for example, by way of vacuum box 46.

The nascent web is advanced to a papermaking felt 48 which is supported by a plurality of rolls 50, 52, 54, 55 and the felt is in contact with a shoe press roll 56. The web is of low consistency as it is transferred to the felt. Transfer may be assisted by vacuum; for example roll 50 may be a vacuum roll if so desired or a pickup or vacuum shoe as is known in the art. As the web reaches the shoe press roll it may have a consistency of 10-25 percent, preferably 20 to 25 percent or so as it enters nip 58 between shoe press roll 56 and transfer roll 60. Transfer roll 60 may be a heated roll if so desired. Instead of a shoe press roll, roll 56 could be a conventional suction pressure roll. If a shoe press is employed it is desirable and preferred that roll 54 is a vacuum roll effective to remove water form the felt prior to the felt entering the shoe press nip since water from the furnish will be pressed into the felt in the shoe press nip. In any case, using a vacuum roll at 54 is typically desirable to ensure the web remains in contact with the felt during the direction change as one of skill in the art will appreciate from the diagram.

Web 44 is wet-pressed on the felt in nip 58 with the assistance of pressure shoe 62. The web is thus compactively dewatered at 58, typically by increasing the consistency by 15 or more points at this stage of the process. The configuration shown at 58 is generally termed a shoe press; in connection with the present invention cylinder 60 is operative as a transfer cylinder which operates to convey web 44 at high speed, typically 1000 fpm-6000 fpm to the creping fabric.

Cylinder 60 has a smooth surface 64 which may be provided with adhesive and/or release agents if needed. Web 44 is adhered to transfer surface 64 of cylinder 60 which is rotating at a high angular velocity as the web continues to advance in the machine-direction indicated by arrows 66. On the cylinder, web 44 has a generally random apparent distribution of fiber.

Direction 66 is referred to as the machine-direction (MD) of the web as well as that of papermachine 10; whereas the cross-machine-direction (CD) is the direction in the plane of the web perpendicular to the MD.

Web 44 enters nip 58 typically at consistencies of 10-25 percent or so and is dewatered and dried to consistencies of from about 25 to about 70 by the time it is transferred to creping fabric 18 as shown in the diagram.

Fabric 18 is supported on a plurality of rolls 68, 70, 72 and a press nip roll 74 and forms a fabric crepe nip 76 with transfer cylinder 60 as shown.

The creping fabric defines a creping nip over the distance in which creping fabric 18 is adapted to contact roll 60; that is, applies significant pressure to the web against the transfer cylinder. To this end, backing (or creping) roll 70 may be provided with a soft deformable surface which will increase the length of the creping nip and increase the fabric creping angle between the fabric and the sheet and the point of contact or a shoe press roll could be used as roll 70 to increase effective contact with the web in high impact fabric creping nip 76 where web 44 is transferred to fabric 18 and advanced in the machine-direction. By using different equipment at the creping nip, it is possible to adjust the fabric creping angle or the takeaway angle from the creping nip. Thus, it is possible to influence the nature and amount of redistribution of fiber, delamination/debonding which may occur at fabric creping nip 76 by adjusting these nip parameters. In some embodiments it may by desirable to restructure the z-direction interfiber characteristics while in other cases it may be desired to influence properties only in the plane of the web. The creping nip parameters can influence the distribution of fiber in the web in a variety of directions, including inducing changes in the z-direction as well as the MD and CD. In any case, the transfer from the transfer cylinder to the creping fabric is high impact in that the fabric is traveling slower than the web and a significant velocity change occurs. Typically, the web is creped anywhere from 10-60 percent and even higher during transfer from the transfer cylinder to the fabric.

Creping nip 76 generally extends over a fabric creping nip distance of anywhere from about ⅛" to about 2", typically ½" to 2". For a creping fabric with 32 CD strands per inch, web 44 thus will encounter anywhere from about 4 to 64 weft filaments in the nip.

The nip pressure in nip 76, that is, the loading between backing roll 70 and transfer roll 60 is suitably 20-100, preferably 40-70 pounds per linear inch (PLI).

After fabric creping, the web continues to advance along MD 66 where it is wet-pressed onto Yankee cylinder 80 in transfer nip 82. Transfer at nip 82 occurs at a web consistency of generally from about 25 to about 70 percent. At these consistencies, it is difficult to adhere the web to surface 84 of cylinder 80 firmly enough to remove the web from the fabric thoroughly. This aspect of the process is important, particularly when it is desired to use a high velocity drying hood as well as maintain high impact creping conditions.

In this connection, it is noted that conventional TAD processes do not employ high velocity hoods since sufficient adhesion to the Yankee is not achieved.

It has been found in accordance with the present invention that the use of particular adhesives cooperate with a moderately moist web (25-70 percent consistency) to adhere it to the Yankee sufficiently to allow for high velocity operation of the system and high jet velocity impingement air drying. In this connection, a poly(vinyl alcohol)/polyamide adhesive composition as noted above is applied at 86 as needed.

The web is dried on Yankee cylinder 80 which is a heated cylinder and by high jet velocity impingement air in Yankee hood 88. As the cylinder rotates, web 44 is creped from the cylinder by creping doctor 89 and wound on a take-up roll 90. Creping of the paper from a Yankee dryer may be carried out using an undulatory creping blade, such as that disclosed in U.S. Pat. No. 5,690,788, the disclosure of which is incorporated by reference. Use of the undulatory crepe blade has been shown to impart several advantages when used in production of tissue products. In general, tissue products creped using an undulatory blade have higher caliper (thickness), increased CD stretch, and a higher void volume than do comparable tissue products produced using conventional crepe blades. All of these changes effected by use of the undulatory blade tend to correlate with improved softness perception of the tissue products.

When a wet-crepe process is employed, an impingement air dryer, a through-air dryer, or a plurality of can dryers can be used instead of a Yankee. Impingement air dryers are disclosed in the following patents and applications, the disclosure of which is incorporated herein by reference:

U.S. Pat. No. 5,865,955 of Ilvespaaet et al.

U.S. Pat. No. 5,968,590 of Ahonen et al.

U.S. Pat. No. 6,001,421 of Ahonen et al.

U.S. Pat. No. 6,119,362 of Sundqvist et al.

U.S. patent application Ser. No. 09/733,172, entitled Wet Crepe,

Impingement-Air Dry Process for Making Absorbent Sheet, now

U.S. Pat. No. 6,432,267.

A throughdrying unit as is well known in the art and described in U.S. Pat. No. 3,432,936 to Cole et al., the disclosure of which is incorporated herein by reference as is U.S. Pat. No. 5,851,353 which discloses a can-drying system.

Figure 20:
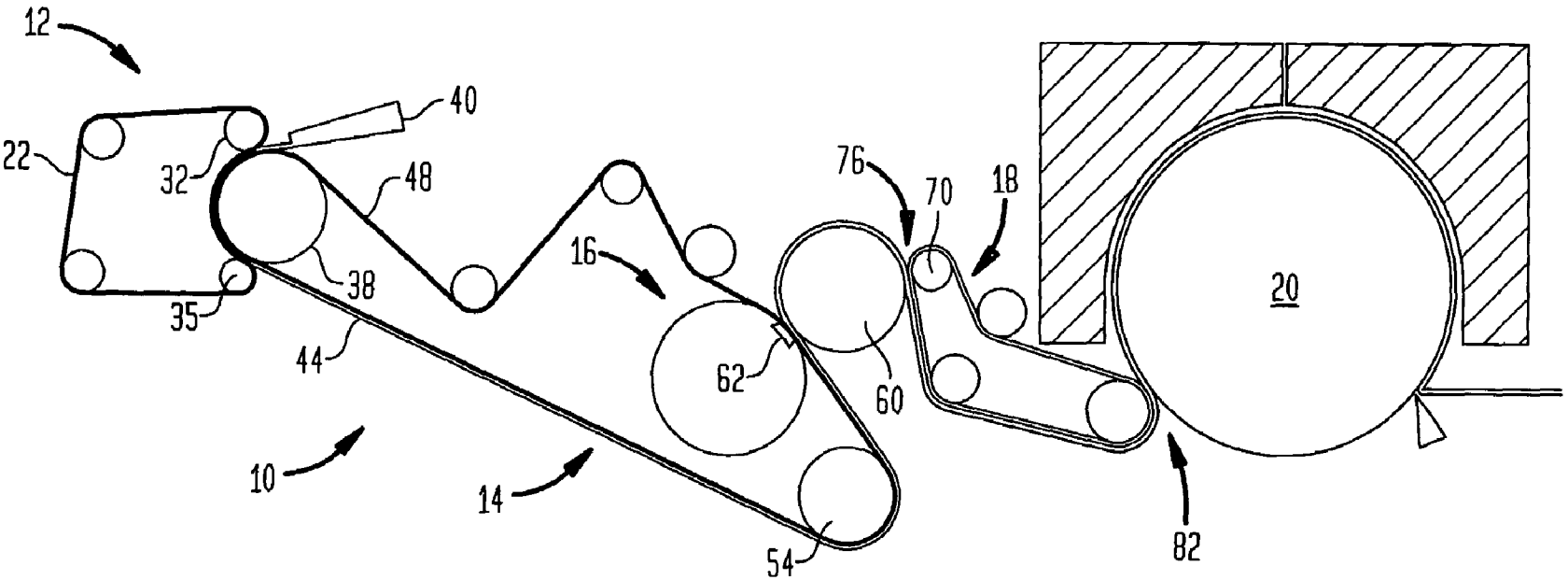
FIG. 20 is a schematic diagram of another papermachine layout for practicing the present invention.

There is shown in FIG. 20 a preferred papermachine 10 for use in connection with the present invention. Papermachine 10 is a three fabric loop machine having a forming section 12 generally referred to in the art as a crescent former. Forming section 12 includes a forming wire 22 supported by a plurality of rolls such as rolls 32, 35. The forming section also includes a forming roll 38 which supports paper making felt 48 such that web 44 is formed directly on felt 48. Felt run 14 extends to a shoe press section 16 wherein the moist web is deposited on a backing roll 60 as described above. Thereafter web 44 is creped onto fabric 18 in fabric crepe 20 nip 76 before being deposited on Yankee dryer 20 in another press nip 82. The system includes a vacuum turning roll 54, in some embodiments; however, the three loop system may be configured in a variety of ways wherein a turning roll is not necessary. This feature is particularly important in connection with the rebuild of a papermachine inasmuch as the expense of relocating associated equipment i.e. pulping or fiber processing equipment and/or the large and expensive drying equipment such as the Yankee dryer or plurality of can dryers would make a rebuild prohibitively expensive unless the improvements could be configured to be compatible with the existing facility. In this connection, various improvements and modifications to the machine 10 of FIG. 20 may be made as described in connection with FIGS. 21, 22 and FIG. 23.

Figure 21:
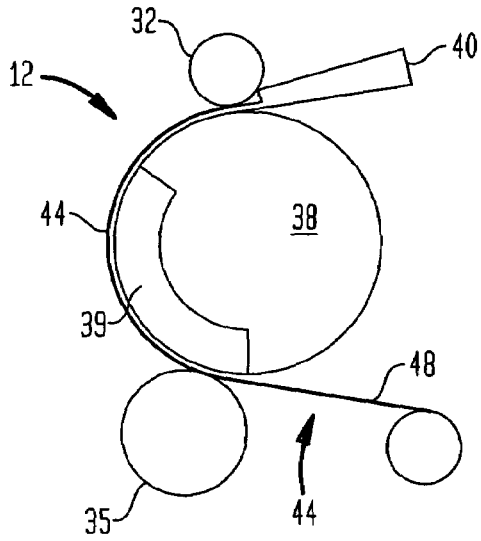
FIGS. 21, 22 and 23 are schematic diagrams illustrating additional improvements to papermachines for practicing the present invention.

FIG. 21 is a partial schematic of forming section 12 of papermachine 10 of FIG. 20. Forming roll 38 is a vacuum roll wherein vacuum application is indicated schematically at 39. Heavy weight sheets on a crescent former usually mean that the felt carries excessive water. In a shoe press operation, this extra water increases the possibility of crushing in the press nip. Most often the extra water is removed using a suction roll with a relatively high degree of felt wrap prior to a shoe press nip. This roll takes relatively large amounts of vacuum to reduce the felt water to the point the nip won't crush out. The use of a vacuum forming roll will eliminate the need for further vacuum application to the felt as the web advances through the equipment. In this way, the vacuum applied can be more efficiently used to reduce water in the felt. The increased efficiency also results from another mechanism. In the forming sections of modem crescent formers, the forming fabric tensions can be as high as 70 pounds per linear inch. If the forming roll is, for example, 50 inches in diameter, and the tension in the forming fabric 50 pli, the assisting pressure exerted against the sheet is about 2 psi (P, psi =T, ph/Radius, in or P =50/25=2). This beneficial extra 2 psi is added to the existing vacuum at the "expensive" end of the vacuum curve to improve the economics of the process.

Figure 22:
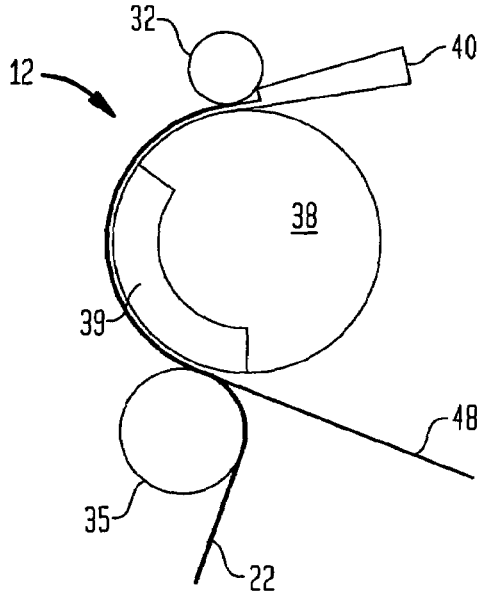

The installation of a soft covered roll 35 inside the forming fabric loop of the crescent former may further assist in urging the felt water into the vacuum forming roll and thus further enhance dewatering of the felt without the addition of more expensive vacuum power. This arrangement is illustrated in FIGS. 21 and 22. Note that assisting dewatering by fabric tension is on the order of about 2 psi; for example, in this invention if a soft covered roll (for uniform CD fit) exhibits a one inch wide nip, then by loading this roll to a relatively low level, say 20 pli, the additional urging pressure on the water in the felt is 10 times that of the fabric alone and will cost no more in terms of vacuum pressure or flow needed. In fact this additional loading might actually reduce the purging volume experienced at a given pressure drop.

As a further means of reducing the complexity of the forming section, soft covered roll, such as roll 35, in FIG. 21 can be used as a fabric turning roll as shown in FIG. 22. Roll 35 could function as a press roll as well as a turning roll for forming wire 22. Normally this would not be feasible in a crescent former due to the need to utilize a felt-roll separation vacuum pulse to effectively transfer the sheet from the forming wire to the felt. But in this invention, the vacuum inside the forming roll can help effect the transfer and allow the forming section to be configured as compactly as needed.

Figure 23:
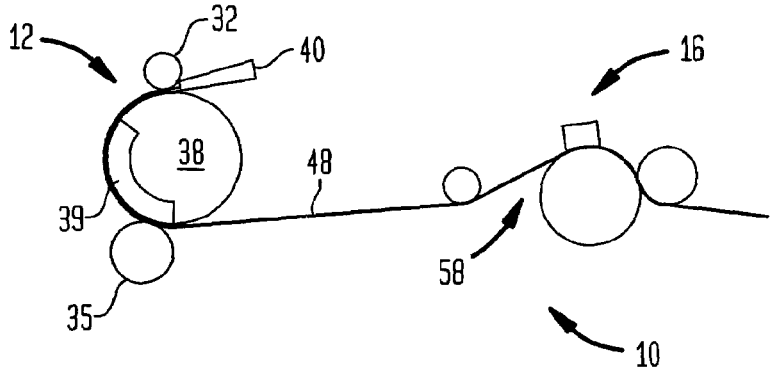

Still further flexibility is achieved by inclining felt 48 upwardly as shown in FIG. 23. In FIG. 23 there is provided an inverted running in nip 58 as well as a shoe press indicated schematically at 16. Here the papermachine 10 may be configured to maximize use of an existing facility by eliminating a vacuum roll such as roll 54 in FIG. 19 or FIG. 20 so that fabric cleaning or other equipment may be located as needed in order to minimize the need to modify an existing facility during a rebuild.

Without intending to be bound by theory, it is believed that high impact creping of the web at the fabric crepe nip is a salient feature of the invention where the web is rearranged on the fabric and interfiber bonding of the web is reconfigured so that high bulk and absorbency is achieved notwithstanding the compactive or mechanical dewatering of the web to relatively high consistencies on the papermaking felt in the shoe press. Accordingly, excessive compaction resulting from aggressive pressing in a suction pressure roll at the Yankee can be avoided. As will be appreciated from the web properties presented below, webs produced by way of the invention exhibit bulk, absorbency and stretch which are unexpectedly high for compactively dewatered products.

Typical operating conditions for papermachine 10 are included in Table 2 below; whereas, product properties for high impact fabric creped products appear in Table 3.

Figure 24:
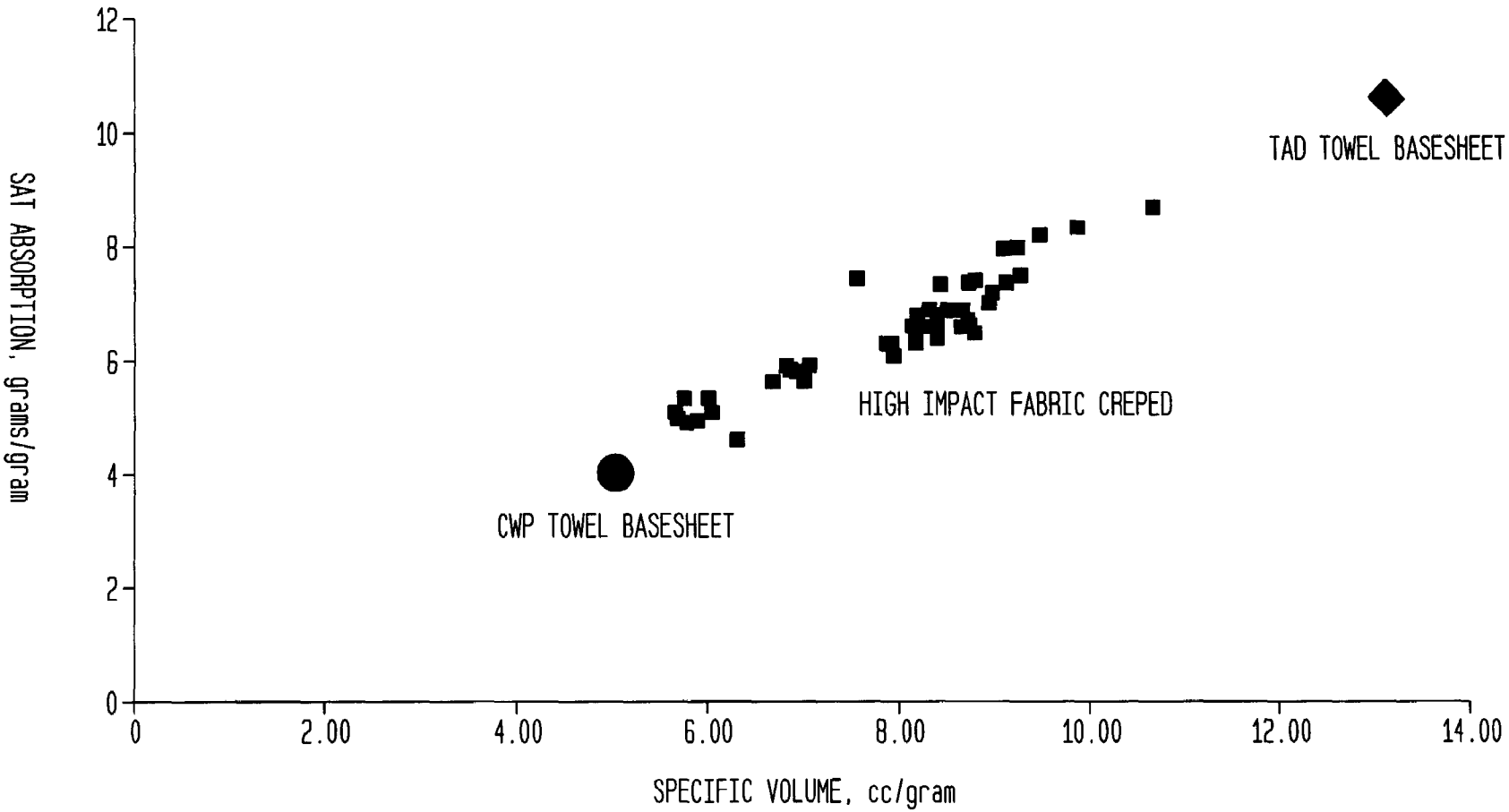
FIGS. 24 and 25 are plots of absorbency versus specific volume for products of the invention as well as representative data for other products.
Figure 25:
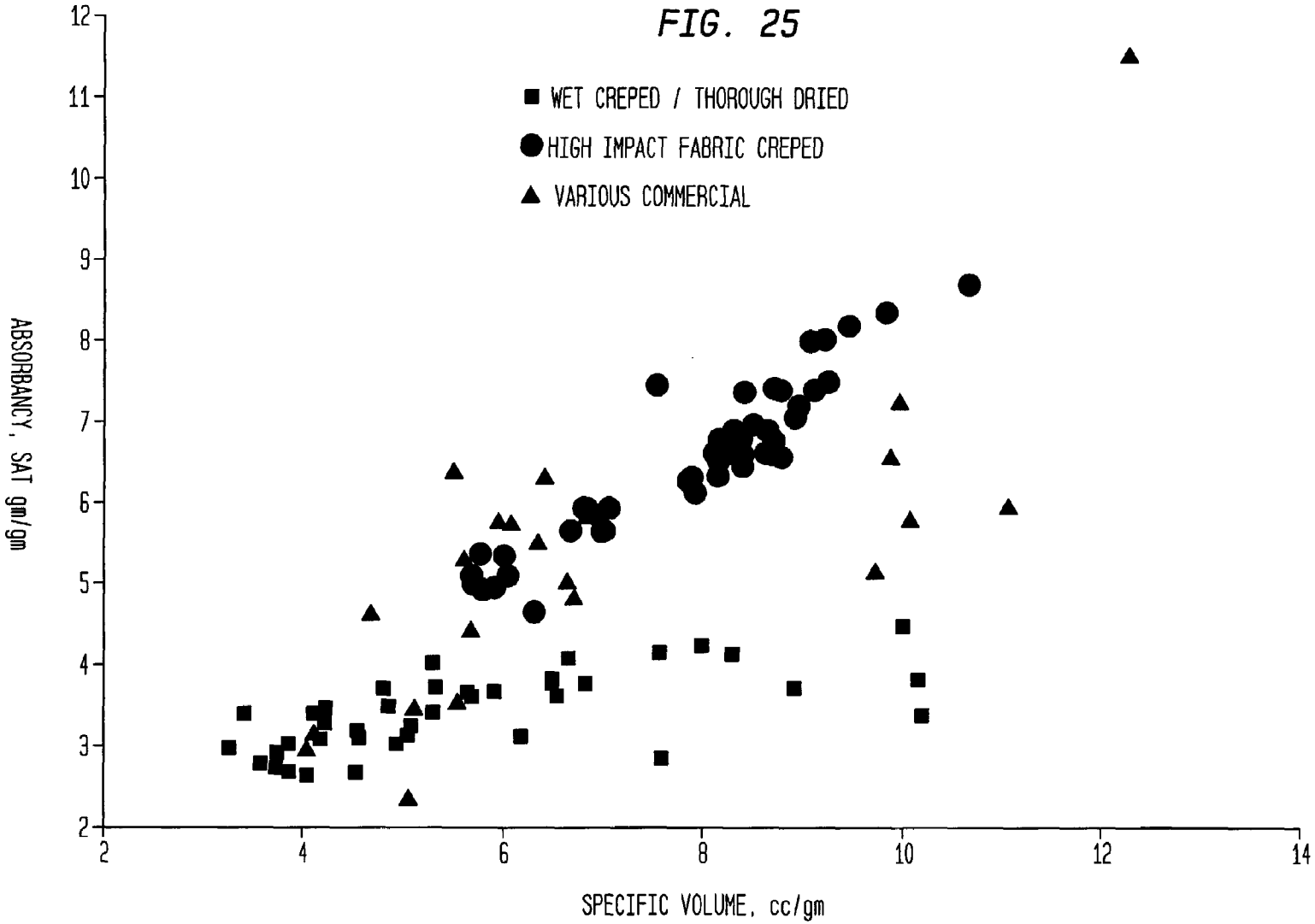
Figure 26:
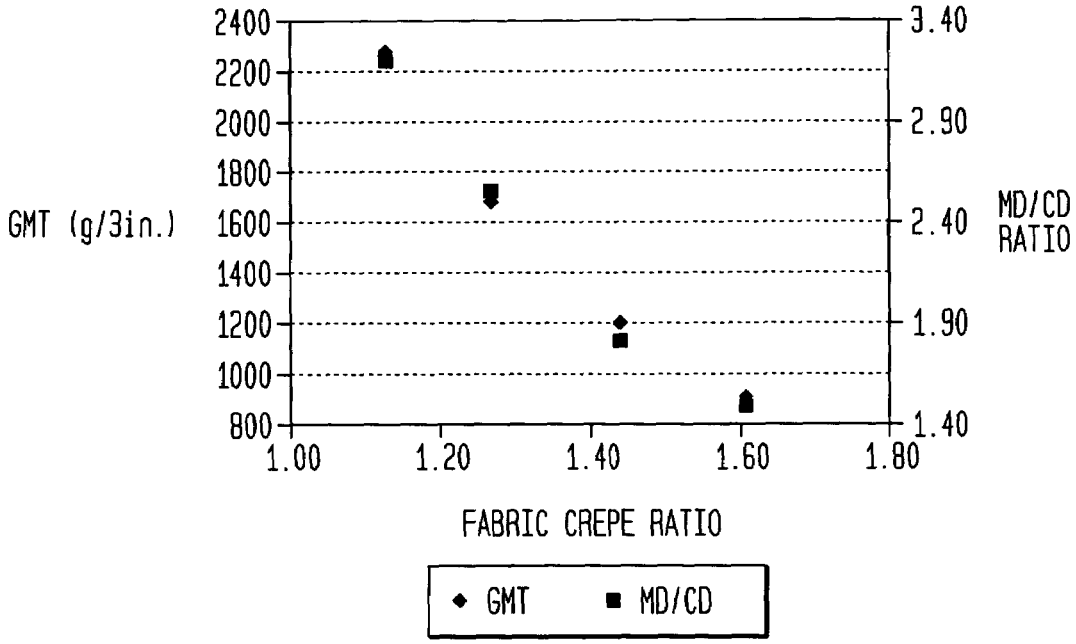
FIG. 26 is a plot of GMT and MD/CD Tensile Ratio vs. Fabric Crepe Ratio.
Figure 27:
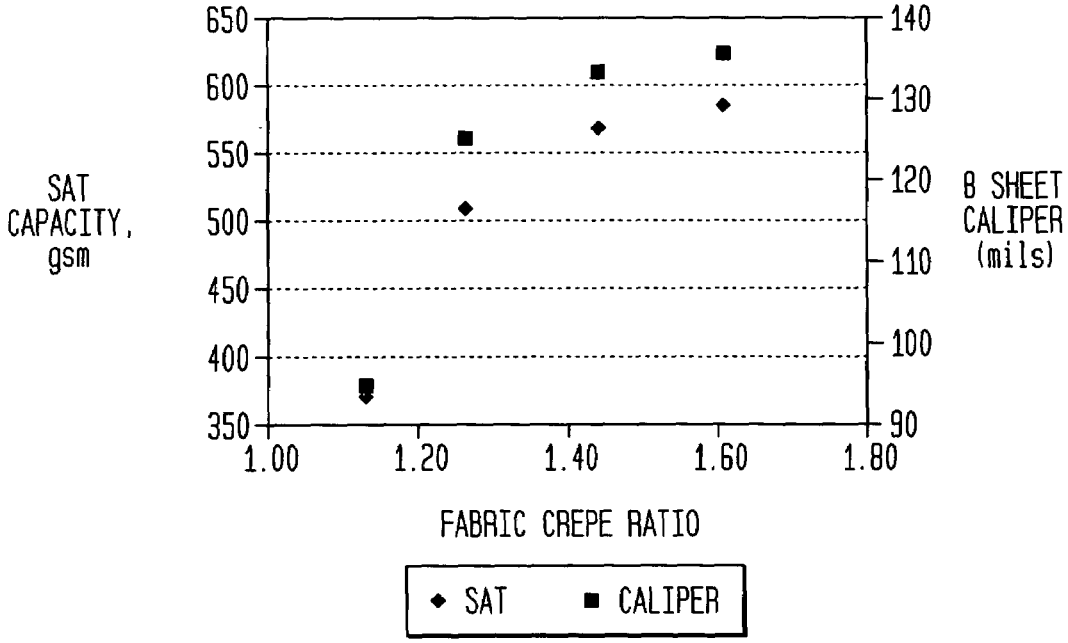
FIG. 27 is a plot of SAT Capacity and Caliper vs. Crepe Ratio.
Figure 28:
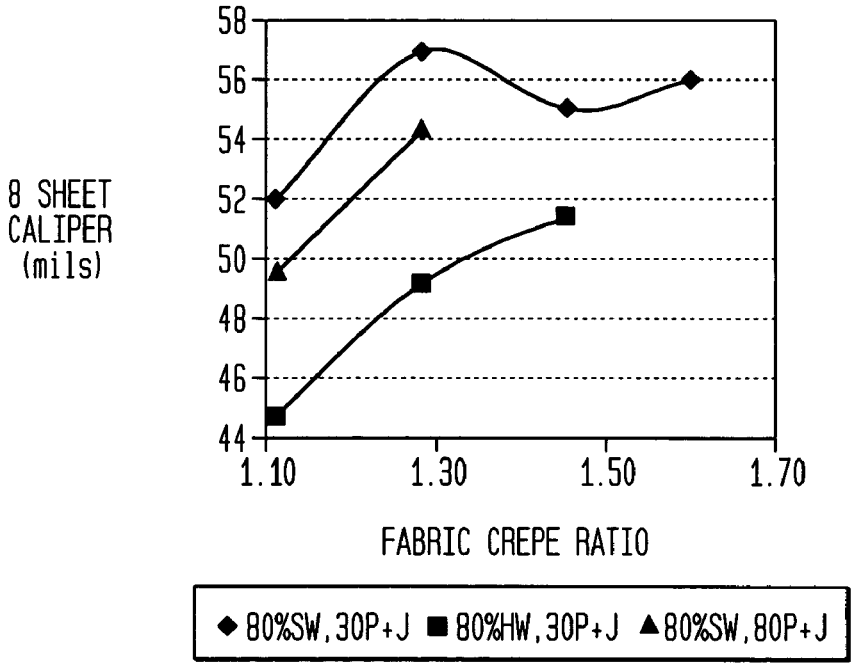
FIG. 28 is a plot of Caliper vs. Crepe Ratio for various furnishes and fabric backing (creping) rolls.
Figure 29:
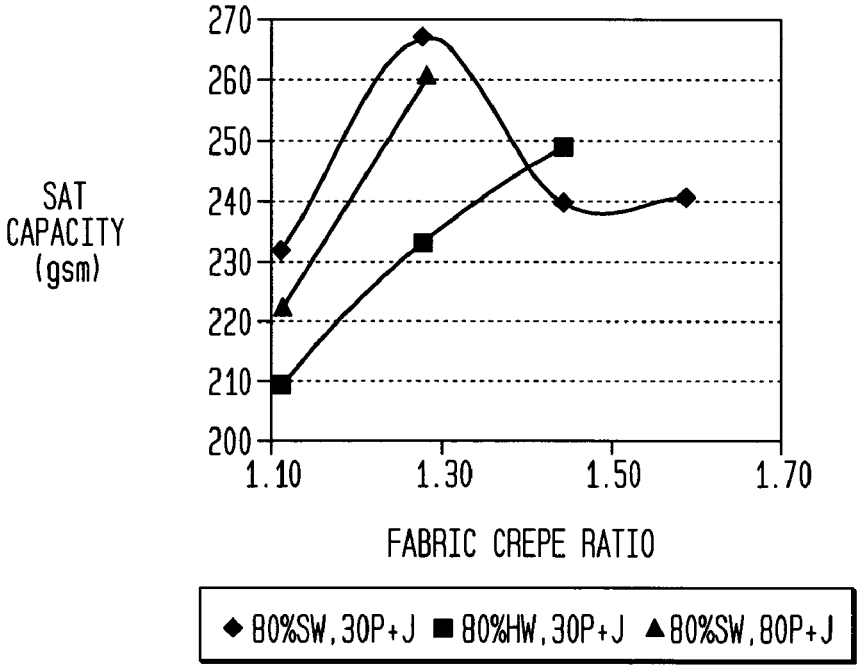
FIG. 29 is a plot of SAT Capacity vs. Fabric Crepe Ratio for various furnishes and backing (creping) rolls.
Figure 30:
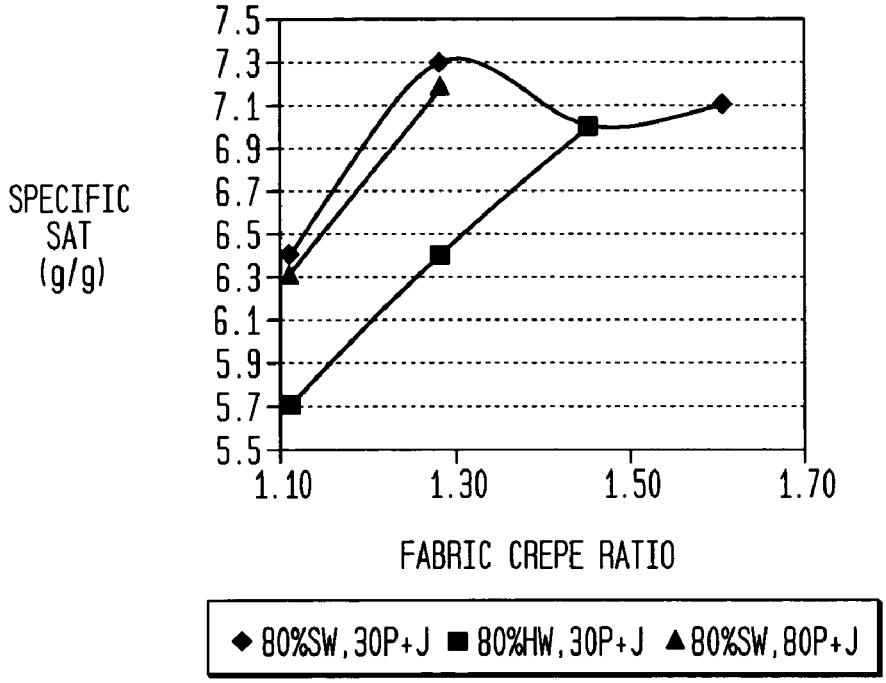
FIG. 30 is a plot of Specific SAT (g/g) vs. Fabric Crepe Ratio for various furnishes and backing (creping) rolls.
Figure 31:
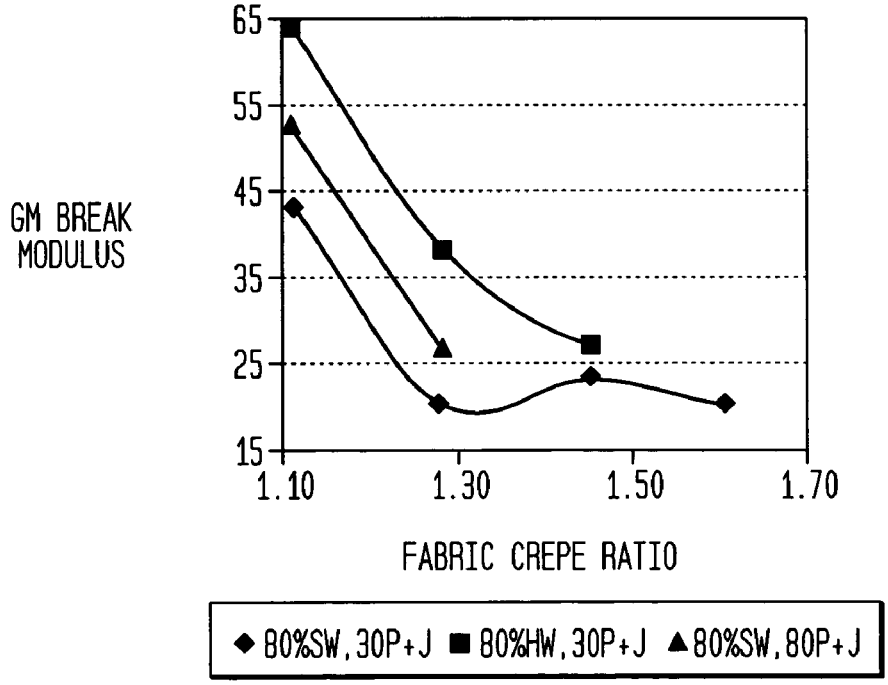
FIG. 31 is a plot of GM Break Modulus vs. Fabric Crepe Ratio for various furnishes and backing (creping) rolls.
Figure 32:
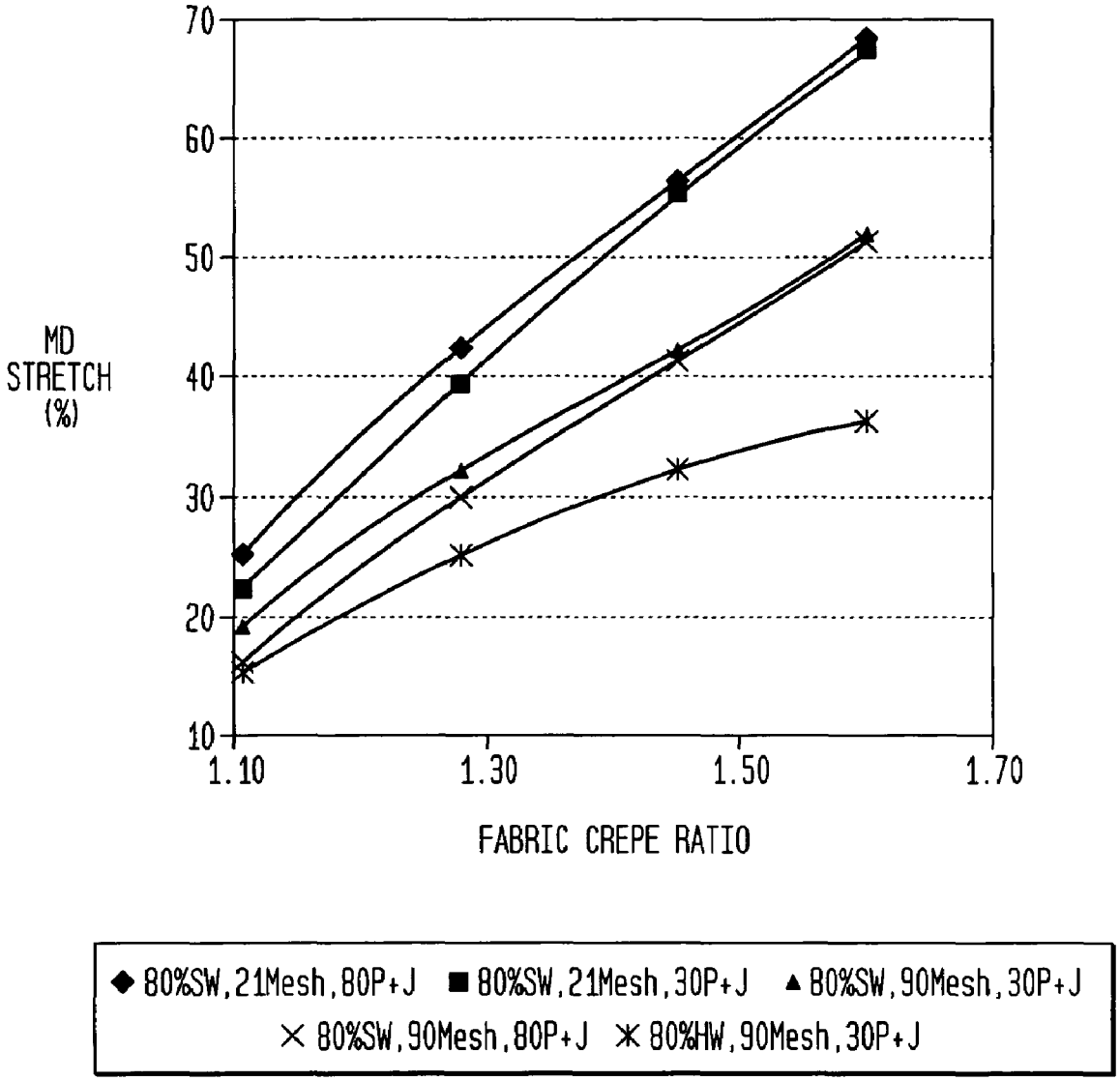
FIG. 32 is a plot of MD Stretch vs. Fabric Crepe Ratio for various furnishes, creping fabrics and backing (creping) roll permutations.

Selected products are summarized in Tables 4 and 5 and are compared with existing products in Table 6 as well as FIGS. 24 and 25 which are plots of absorbency versus specific volume. FIGS. 26 through 32 illustrate the impact of fabric creping ratio and various other variables on the properties achieved by way of the invention.

TABLE 2

Representative Operating Conditions

| Creping Fabric/Creping Blade | Fabric Speed fpm | Yank. Speed fpm | Reel Speed fpm | Crepe Roll Load PLI | Shoe Press Load PLI | Crepe Ratio, Fabric/ Yankee | Crepe Ratio, Yankee/ Reel | Crepe Ratio, Fabric/ Reel | Crepe Roll Hard-ness | 8 Sheet Caliper (mils) | Basis Weight lb/3000 ft2 | GMT | SAT, g/g |
|---|---|---|---|---|---|---|---|---|---|---|---|---|---|
| (MD knuckles out)/ Conventional | 2000 | 1800 | 1800 | 60 | 600 | 1.11 | 1.00 | 1.11 | "Soft" | 81 | 25.0 | 2649 | |
| (CD knuckles out)/ Conventional | 2000 | 1800 | 1700 | 54 | 600 | 1.11 | 1.06 | 1.18 | "Soft" | 102 | 25.1 | 2296 | |
| (CD knuckles out)/ Conventional | 2000 | 1700 | 1600 | 40 | 400 | 1.18 | 1.06 | 1.25 | "Soft" | 64 | 15.4 | 1771 | 6.5 |
| (CD knuckles out)/ Conventional | 2000 | 1700 | 1600 | 60 | 400 | 1.18 | 1.06 | 1.25 | "Soft" | 66 | 15.5 | 1776 | 6.6 |
| (CD knuckles out)/ Conventional | 2000 | 1850 | 1600 | 60 | 400 | 1.08 | 1.16 | 1.25 | "Soft" | 67 | 15.6 | 1751 | 6.8 |
| (CD knuckles out)/ Conventional | 2000 | 1850 | 1600 | 56 | 400 | 1.08 | 1.16 | 1.25 | "Soft" | 64 | 15.1 | 1651 | 6.9 |
| (CD knuckles out)/ Conventional | 2000 | 1850 | 1600 | 60 | 600 | 1.08 | 1.16 | 1.25 | "Soft" | 65 | 15.1 | 1866 | 6.6 |
| (CD knuckles out)/ Conventional | 2000 | 1850 | 1600 | 55 | 600 | 1.08 | 1.16 | 1.25 | "Soft" | 64 | 15.3 | 1757 | 6.8 |
| (CD knuckles out)/ Conventional | 2000 | 1700 | 1600 | 60 | 600 | 1.18 | 1.06 | 1.25 | "Soft" | 67 | 15.3 | 1660 | 6.9 |
| (CD knuckles out)/ Conventional | 2000 | 1700 | 1600 | 40 | 600 | 1.18 | 1.06 | 1.25 | "Soft" | 65 | 15.3 | 1765 | 6.8 |
| (CD knuckles out)/ Conventional | 2000 | 1700 | 1600 | 53 | 400 | 1.18 | 1.06 | 1.25 | "Soft" | 65 | 16.1 | 1737 | 6.3 |
| (CD knuckles out)/ Conventional | 2000 | 1700 | 1600 | 53 | 600 | 1.18 | 1.06 | 1.25 | "Soft" | 68 | 16.8 | 1816 | 6.3 |
| (CD knuckles out)/ Conventional | 2500 | 2125 | 2000 | 60 | 600 | 1.18 | 1.06 | 1.25 | "Soft" | 63 | 13.8 | 985 | |
| (CD knuckles out)/ Conventional | 2500 | 2125 | 2000 | 60 | 400 | 1.18 | 1.06 | 1.25 | "Soft" | 61 | 13.6 | 921 | 7.4 |
| (CD knuckles out)/ Conventional | 2500 | 2200 | 2000 | 60 | 400 | 1.14 | 1.10 | 1.25 | "Soft" | 66 | 15.3 | 1275 | 6.4 |
| (CD knuckles out)/ Conventional | 2500 | 2200 | 2000 | 60 | 600 | 1.14 | 1.10 | 1.25 | "Soft" | 68 | 15.2 | 1378 | 6.6 |
| (CD knuckles out)/ Conventional | 3000 | 2545 | 2400 | 60 | 600 | 1.18 | 1.06 | 1.25 | "Soft" | 65 | 14.5 | 881 | 6.6 |
| (CD knuckles out)/ Conventional | 3000 | 2545 | 2400 | 60 | 400 | 1.18 | 1.06 | 1.25 | "Soft" | 65 | 14.6 | 820 | 6.5 |
| (CD knuckles out)/ Conventional | 3000 | 2545 | 2400 | 60 | 600 | 1.18 | 1.06 | 1.25 | "Soft" | 66 | 14.7 | 936 | 6.7 |
| (CD knuckles out)/ Conventional | 3000 | 2700 | 2400 | 64 | 600 | 1.11 | 1.13 | 1.25 | "Soft" | 67 | 15.8 | 1188 | 6.6 |
| (CD knuckles out)/ Conventional | 3200 | 2900 | 2560 | 64 | 600 | 1.10 | 1.13 | 1.25 | "Soft" | 66 | 15.4 | 1133 | 6.6 |
| (MD knuckles out)/ Conventional | 2000 | 1800 | 1600 | 60 | 600 | 1.11 | 1.13 | 1.25 | "Soft" | 90 | 20.4 | 1575 | 6.6 |
| (MD knuckles out)/ Conventional | 2000 | 1600 | 1600 | 60 | 600 | 1.25 | 1.00 | 1.25 | "Soft" | 105 | 23.0 | 1643 | 7.0 |
| (MD knuckles out)/ Conventional | 2000 | 1600 | 1600 | 54 | 600 | 1.25 | 1.00 | 1.25 | "Soft" | 106 | 25.4 | 2045 | 6.3 |
| MD knuckles out)/ Conventional | 2000 | 1500 | 1500 | 60 | 600 | 1.33 | 1.00 | 1.33 | "Soft" | 109 | 24.6 | 1458 | 6.9 |
| (MD knuckles out)/ Conventional | 2000 | 1400 | 1400 | 54 | 600 | 1.43 | 1.00 | 1.43 | "Soft" | 121 | 25.0 | 1618 | 8.2 |
| (MD knuckles out)/ Conventional | 2000 | 1400 | 1400 | 54 | 600 | 1.43 | 1.00 | 1.43 | "Soft" | 109 | 20.0 | 913 | 8.7 |
| (MD knuckles out)/ Undulatory | 2000 | 1400 | 1400 | 54 | 600 | 1.43 | 1.00 | 1.43 | "Soft" | 119 | 25.1 | 1726 | 7.5 |
| (MD knuckles out)/ Conventional | 2000 | 1350 | 1350 | 60 | 600 | 1.48 | 1.00 | 1.48 | "Soft" | 122 | 26.7 | 1363 | 7.2 |

TABLE 3

| Sample | Basis Weight lb/3000 ft^2 | Caliper 8 Sheet mils/8 sht | Tensile MD g/3 in | Stretch MD % | Tensile CD g/3 in | Stretch CD % | Tensile GM g/3 in. | Tensile Dry Ratio % | Wet Tens Finch Cured-CD g/3 in. |
|---|---|---|---|---|---|---|---|---|---|
| 1-1 | 19.87 | 62.88 | 4606 | 18.5 | 3133 | 5.2 | 3780 | 1.5237710 | 996.92 |
| 1-2 | 20.76 | 61.86 | 4684 | 22.1 | 3609 | 5.2 | 4111 | 1.2981323 | 1,266.53 |
| 1-3 | 20.68 | 60.00 | 4474 | 23.7 | 3836 | 5.1 | 4137 | 1.1687330 | 1,204.89 |
| 1-4 | 20.69 | 61.46 | 4409 | 26.4 | 3978 | 4.6 | 4188 | 1.1090470 | 1,227.87 |
| 1-5 | 20.50 | 62.60 | 4439 | 23.6 | 3863 | 5.1 | 4140 | 1.1502550 | 995.75 |
| 1-6 | 20.19 | 62.44 | 3793 | 23.5 | 3598 | 5.5 | 3693 | 1.0538107 | 955.01 |
| 1-7 | 20.50 | 61.94 | 3895 | 25.2 | 3439 | 5.3 | 3660 | 1.1323913 | 999.16 |
| 1-8 | 20.80 | 60.58 | 3904 | 24.8 | 3608 | 5.5 | 3752 | 1.0820923 | 969.49 |
| 1-9 | 20.68 | 57.72 | 3986 | 23.6 | 3350 | 5.3 | 3652 | 1.1906527 | 978.24 |
| 1-10 | 20.69 | 62.14 | 3800 | 23.6 | 3282 | 5.5 | 3531 | 1.1589873 | 824.23 |
| 1-11 | 22.35 | 68.48 | 2905 | 25.6 | 2795 | 5.0 | 2849 | 1.0410453 | 723.88 |
| 2-1 | 19.58 | 77.44 | 3218 | 24.0 | 3847 | 4.7 | 3518 | 0.8369987 | 1,130.23 |
| 2-2 | 20.23 | 62.04 | 3926 | 25.7 | 3078 | 5.6 | 3477 | 1.2757220 | 843.49 |
| 2-3 | 20.44 | 60.06 | 4240 | 24.9 | 2729 | 5.5 | 3401 | 1.5554780 | 809.07 |
| 2-4 | 19.50 | 57.50 | 3504 | 24.5 | 3097 | 4.9 | 3292 | 1.1345120 | 832.34 |
| 2-5 | 19.91 | 61.20 | 3668 | 25.4 | 3068 | 4.9 | 3354 | 1.1959187 | 1,046.25 |
| 2-6 | 20.50 | 59.48 | 3611 | 25.9 | 3563 | 5.4 | 3587 | 1.0141063 | 1,078.93 |
| 2-7 | 20.37 | 60.48 | 4132 | 23.2 | 3616 | 4.4 | 3864 | 1.1433700 | 982.13 |
| 2-8 | 20.84 | 61.56 | 3761 | 26.5 | 3559 | 5.0 | 3658 | 1.0581430 | 1,088.29 |
| 2-9 | 20.13 | 56.38 | 4008 | 23.2 | 3950 | 4.6 | 3976 | 1.0163267 | 1,103.56 |
| 2-10 | 20.19 | 60.28 | 3921 | 23.2 | 3658 | 4.4 | 3786 | 1.0737743 | 1,176.74 |
| 2-11 | 20.01 | 58.08 | 4061 | 21.2 | 3725 | 4.5 | 3887 | 1.0922847 | 1,239.30 |
| 2-12 | 20.34 | 62.30 | 3644 | 22.3 | 3353 | 4.2 | 3494 | 1.0901400 | 1,055.76 |
| 2-13 | 19.36 | 56.52 | 3474 | 23.1 | 3254 | 4.2 | 3358 | 1.0724343 | 115.79 |
| 3-1 | 20.03 | 67.00 | 2547 | 24.7 | 2432 | 4.4 | 2488 | 1.0486153 | 71.69 |
| 3-2 | 19.37 | 55.22 | 3607 | 21.8 | 3588 | 4.2 | 3596 | 1.0064937 | 99.86 |
| 3-3 | 19.54 | 56.16 | 3519 | 20.3 | 3372 | 4.4 | 3444 | 1.0445673 | 92.77 |
| 3-4 | 15.13 | 51.18 | 2873 | 23.7 | 3016 | 4.4 | 2943 | 0.9522983 | 659.93 |
| 3-5 | 14.95 | 52.06 | 2663 | 23.9 | 1992 | 5.0 | 2299 | 1.3529480 | 628.42 |
| 3-6 | 14.93 | 52.20 | 2692 | 22.8 | 2181 | 5.0 | 2422 | 1.2362143 | 653.00 |
| 3-7 | 14.70 | 53.12 | 2626 | 23.7 | 2260 | 4.8 | 2436 | 1.1617173 | 688.65 |
| 3-8 | 15.15 | 53.68 | 2500 | 23.3 | 2319 | 5.5 | 2407 | 1.0789143 | 575.97 |
| 3-9 | 15.08 | 54.02 | 2525 | 23.6 | 2273 | 5.2 | 2396 | 1.1105663 | 575.91 |
| 3-10 | 15.11 | 53.04 | 2453 | 23.3 | 2202 | 4.8 | 2323 | 1.1156770 | 625.81 |
| 3-11 | 15.54 | 53.12 | 2721 | 24.4 | 2337 | 5.2 | 2522 | 1.1638033 | 674.02 |
| 3-12 | 15.54 | 54.04 | 2524 | 23.2 | 2268 | 5.4 | 2387 | 1.1276000 | 715.30 |
| 3-13 | 16.03 | 57.40 | 2319 | 24.9 | 1822 | 4.9 | 2054 | 1.2758480 | 529.99 |
| 4-1 | 15.19 | 56.72 | 2243 | 26.0 | 2081 | 5.7 | 2159 | 1.0810010 | 574.78 |
| 4-2 | 15.23 | 56.62 | 2517 | 27.2 | 2387 | 5.4 | 2450 | 1.0549993 | 624.15 |
| 4-3 | 16.42 | 68.26 | 2392 | 36.2 | 2628 | 5.7 | 2506 | 0.9109697 | 686.76 |
| 4-4 | 16.27 | 62.82 | 2101 | 35.7 | 2198 | 6.0 | 2149 | 0.9562577 | 550.84 |
| 4-5 | 18.66 | 80.40 | 2055 | 52.6 | 2692 | 6.0 | 2352 | 0.7643983 | 604.63 |
| 4-6 | 17.54 | 78.22 | 1741 | 54.5 | 2326 | 6.0 | 2011 | 0.7499683 | 606.87 |
| 4-7 | 15.69 | 73.08 | 1350 | 53.9 | 2085 | 7.5 | 1677 | 0.6474557 | 495.32 |
| 4-8 | 13.43 | 67.62 | 918 | 48.1 | 1569 | 7.8 | 1200 | 0.5849340 | 441.99 |
| 4-9 | 17.37 | 81.92 | 1651 | 53.0 | 2262 | 6.0 | 1932 | 0.7304977 | 346.16 |
| 4-10 | 17.96 | 83.42 | 2397 | 55.2 | 1693 | 7.5 | 2014 | 1.4165033 | 453.38 |
| 5-1 | 15.25 | 53.80 | 3133 | 28.5 | 1403 | 7.4 | 2096 | 2.2372990 | 417.16 |
| 5-2 | 15.30 | 52.22 | 2763 | 28.9 | 1969 | 6.4 | 2332 | 1.4042303 | 540.96 |
| 5-3 | 15.27 | 54.42 | 2739 | 27.9 | 1949 | 6.2 | 2310 | 1.4051727 | 584.31 |
| 5-4 | 14.26 | 49.20 | 2724 | 22.3 | 1911 | 6.0 | 2280 | 1.4301937 | 492.39 |
| 5-5 | 15.01 | 51.50 | 2871 | 24.5 | 1846 | 6.3 | 2302 | 1.5558130 | 493.79 |
| 5-6 | 16.32 | 66.38 | 2675 | 39.0 | 2164 | 7.2 | 2406 | 1.2364763 | 591.34 |
| 5-7 | 16.35 | 64.66 | 2652 | 38.6 | 2025 | 6.7 | 2317 | 1.3098210 | 616.83 |
| 5-8 | 16.99 | 64.76 | 2495 | 38.6 | 2061 | 6.9 | 2268 | 1.2104890 | 641.85 |
| 5-9 | 17.05 | 64.70 | 2570 | 39.0 | 2121 | 8.1 | 2335 | 1.2114943 | 627.03 |
| 5-10 | 19.74 | 81.54 | 2445 | 59.0 | 2615 | 8.3 | 2528 | 0.9348707 | 696.55 |
| 5-11 | 17.61 | 79.06 | 2010 | 58.1 | 2164 | 7.9 | 2085 | 0.9286937 | 583.19 |
| 5-12 | 16.42 | 74.80 | 1763 | 56.7 | 1835 | 7.3 | 1799 | 0.9618313 | 459.98 |
| 5-13 | 15.89 | 74.26 | 1554 | 56.1 | 1686 | 7.9 | 1616 | 0.9264103 | 502.56 |
| 5-14 | 14.13 | 59.58 | 1603 | 35.2 | 1540 | 8.3 | 1571 | 1.0418210 | 433.09 |
| 5-15 | 14.45 | 59.60 | 1851 | 36.6 | 1722 | 7.9 | 1785 | 1.0752183 | 454.11 |
| 6-1 | 15.42 | 64.70 | 2002 | 36.1 | 1649 | 7.6 | 1817 | 1.2143843 | 448.91 |
| 6-2 | 13.79 | 59.50 | 1773 | 33.2 | 1491 | 7.2 | 1625 | 1.1921810 | 467.44 |
| 6-3 | 13.88 | 60.78 | 1865 | 34.5 | 1459 | 6.5 | 1649 | 1.2790833 | 402.48 |
| 6-4 | 17.21 | 53.80 | 3739 | 21.3 | 2441 | 6.2 | 3021 | 1.5312243 | 524.07 |

TABLE 3-continued

| Sample | Wet Tens Sponge Cured-CD g/3 in | SAT Slow Rate Capacity g/m^2 | Modulus GM g/ % Stretch | Break Modulus GM gms/% | SAT Capacity g/m^2 | Water Abs Rate 0.1 mLs | Void Volume Ratio | Void Volume Wt Inc. % | T.E.A. MD mm-gm/ mm^2 | T.E.A. CD mm-gm/ mm^2 |
|---|---|---|---|---|---|---|---|---|---|---|
| 1-1 | 1,037.74 | | | 386.04 | | | | | 4.925 | 1.246 |
| 1-2 | | | | 379.43 | | | | | 5.629 | 1.407 |
| 1-3 | | | | 381.02 | | | | | 5.647 | 1.447 |
| 1-4 | | | | 374.25 | | | | | 6.154 | 1.393 |
| 1-5 | 1,114.45 | 134.035 | 89.6 | 373.07 | | 15.1 | 2.557 | 485.919 | 5.891 | 1.530 |
| 1-6 | 923.31 | 143.739 | 84.4 | 330.65 | 334.019 | 9.7 | 2.370 | 450.291 | 5.357 | 1.552 |
| 1-7 | 986.41 | 148.014 | 64.2 | 316.10 | 328.262 | 17.7 | 2.749 | 522.405 | 5.483 | 1.390 |
| 1-8 | 955.90 | 152.619 | 62.8 | 322.44 | 336.485 | 16.1 | 3.120 | 592.786 | 5.525 | 1.529 |
| 1-9 | 979.37 | 173.341 | 107.3 | 329.09 | | 11.6 | 2.574 | 489.077 | 5.329 | 1.333 |
| 1-10 | 807.69 | 202.780 | 82.7 | 318.25 | | 5.8 | 2.503 | 475.539 | 5.350 | 1.340 |
| 1-11 | 760.64 | 228.436 | 49.6 | 252.46 | | 10.1 | 2.605 | 495.028 | 3.899 | 0.904 |
| 2-1 | | | | 333.44 | | | | | 4.770 | 1.379 |
| 2-2 | | | | 289.77 | | | | | 5.442 | 1.355 |
| 2-3 | | | | 290.39 | | | | | 5.594 | 1.106 |
| 2-4 | 892.06 | | 73.5 | 304.75 | 338.788 | 12.1 | 2.447 | 464.953 | 4.849 | 1.100 |
| 2-5 | 1,134.95 | | 73.4 | 303.38 | 344.215 | 14.1 | 2.602 | 494.364 | 5.135 | 1.111 |
| 2-6 | 1,185.72 | | 74.0 | 299.38 | 338.295 | 13.3 | 2.500 | 475.079 | 5.099 | 1.382 |
| 2-7 | | | 84.1 | 388.22 | 324.809 | 8.3 | 2.742 | 520.947 | 5.415 | 1.183 |
| 2-8 | 1,083.57 | | 74.1 | 322.48 | 332.539 | 16.5 | 2.350 | 446.534 | 5.307 | 1.362 |
| 2-9 | | | | 380.20 | | | | | 5.310 | 1.442 |
| 2-10 | | | | 378.20 | | | | | 4.986 | 1.246 |
| 2-11 | | | | 407.80 | | | | | 4.997 | 1.313 |
| 2-12 | | | | 367.66 | | | | | 4.710 | 1.107 |
| 2-13 | | | | 341.00 | | | | | 4.334 | 1.050 |
| 3-1 | | | | 237.83 | | | | | 3.141 | 0.810 |
| 3-2 | | | | 374.55 | | | | | 4.587 | 1.185 |
| 3-3 | | | | 361.95 | | | | | 4.289 | 1.174 |
| 3-4 | | | | 281.81 | | | | | 3.992 | 1.074 |
| 3-5 | | | | 206.59 | | | | | 3.625 | 0.721 |
| 3-6 | 624.93 | | 96.9 | 234.34 | 287.806 | 23.6 | 3.060 | 581.457 | 3.535 | 0.857 |
| 3-7 | 687.75 | | 110.3 | 230.28 | 283.201 | 15.6 | 3.505 | 665.997 | 3.642 | 0.878 |
| 3-8 | 658.71 | | 91.4 | 213.35 | 287.477 | 20.8 | 2.876 | 546.462 | 3.412 | 0.991 |
| 3-9 | 605.18 | | 96.0 | 215.30 | 276.787 | 20.4 | 2.676 | 508.501 | 3.655 | 0.922 |
| 3-10 | 735.02 | | 109.2 | 228.44 | 287.477 | 13.3 | 2.709 | 514.787 | 3.447 | 0.823 |
| 3-11 | 726.30 | | 95.0 | 224.41 | 284.516 | 21.8 | 3.416 | 648.993 | 3.938 | 0.927 |
| 3-12 | 710.84 | | 99.8 | 211.56 | 298.824 | 10.8 | 2.844 | 540.334 | 3.520 | 0.974 |
| 3-13 | 588.92 | | 84.9 | 194.08 | 293.397 | 11.7 | 3.070 | 583.215 | 3.268 | 0.673 |
| 4-1 | | | | 176.34 | | | | | 3.631 | 0.927 |
| 4-2 | | | | 199.09 | | | | | 4.073 | 1.013 |
| 4-3 | | | | 174.98 | 352.932 | | | | 4.516 | 1.169 |
| 4-4 | | | | 147.74 | 393.882 | | | | 4.107 | 1.008 |
| 4-5 | | | | 132.27 | 446.180 | | | | 5.908 | 1.233 |
| 4-6 | | | | 111.11 | 421.512 | | | | 5.267 | 1.043 |
| 4-7 | | | | 85.12 | 376.614 | | | | 4.232 | 1.188 |
| 4-8 | | | | 62.19 | 363.622 | | | | 2.839 | 0.906 |
| 4-9 | | | | 107.93 | 451.443 | | | | 4.779 | 1.008 |
| 4-10 | | | | 100.33 | 466.245 | | | | 6.235 | 0.994 |
| 5-1 | | | | 139.92 | 296.522 | | | | 4.808 | 0.830 |
| 5-2 | | | | 167.96 | 292.082 | | | | 4.561 | 0.980 |
| 5-3 | | | | 176.21 | 287.970 | | | | 4.497 | 0.960 |
| 5-4 | | | | 197.34 | 258.038 | | | | 3.783 | 0.918 |
| 5-5 | | | | 191.14 | 282.872 | | | | 4.276 | 0.909 |
| 5-6 | | | | 142.92 | 342.406 | | | | 5.165 | 1.274 |
| 5-7 | | | | 143.42 | 334.841 | | | | 5.191 | 1.058 |
| 5-8 | | | | 139.58 | 346.024 | | | | 5.533 | 1.078 |
| 5-9 | | | | 128.05 | 329.414 | | | | 5.854 | 1.256 |
| 5-10 | | | | 114.09 | 446.016 | | | | 7.192 | 1.764 |
| 5-11 | | | | 95.91 | 397.171 | | | | 5.944 | 1.290 |
| 5-12 | | | | 89.77 | 386.482 | | | | 5.377 | 1.006 |
| 5-13 | | | | 78.57 | 381.712 | | | | 4.773 | 1.006 |
| 5-14 | | | | 93.20 | 298.660 | | | | 3.608 | 0.938 |
| 5-15 | | | | 107.14 | 304.087 | | | | 4.247 | 1.041 |
| 6-1 | | | | 110.50 | 340.926 | | | | 3.696 | 0.981 |
| 6-2 | | | | 109.51 | 306.060 | | | | 3.280 | 0.848 |
| 6-3 | | | | 107.86 | | | | | 3.491 | 0.727 |
| 6-4 | | | | 262.56 | 289.450 | | | | 4.764 | 1.204 |

TABLE 3-continued

| Sample | Basis Weight Raw Wt g | SAT Rate g/s^0.5 | SAT Time s | Break Modulus CD gms/% | Break Modulus MD gms/% | Modulus MD g/% Stretch | SAT Slow Rate Rate g/s^0.5 | SAT Slow Rate Time s | Modulus CD g/ % Stretch |
|---|---|---|---|---|---|---|---|---|---|
| 1-1 | 1.502 | | | 616.35 | 243.93 | | | | |
| 1-2 | 1.570 | | | 678.34 | 212.24 | | | | |
| 1-3 | 1.563 | | | 767.81 | 189.09 | | | | |
| 1-4 | 1.564 | | | 838.85 | 166.97 | | | | |
| 1-5 | 1.550 | | | 735.66 | 189.20 | 33.9 | 0.0097 | 760.7 | 236.7 |
| 1-6 | 1.527 | 0.1267 | 51.7 | 653.42 | 167.43 | 31.8 | 0.0117 | 645.4 | 224.3 |
| 1-7 | 1.550 | 0.1097 | 68.5 | 632.98 | 157.97 | 27.0 | 0.0143 | 525.7 | 155.4 |
| 1-8 | 1.573 | 0.1090 | 64.0 | 650.43 | 159.84 | 21.9 | 0.0147 | 558.4 | 182.0 |
| 1-9 | 1.564 | | | 630.71 | 171.75 | 54.6 | 0.0133 | 1,488.3 | 212.8 |
| 1-10 | 1.564 | | | 615.91 | 164.45 | 30.3 | 0.0197 | 1,360.7 | 225.6 |
| 1-11 | 1.690 | | | 562.56 | 114.48 | 17.1 | 0.0213 | 1,640.4 | 144.4 |
| 2-1 | 1.480 | | | 814.69 | 136.54 | | | | |
| 2-2 | 1.529 | | | 545.09 | 154.06 | | | | |
| 2-3 | 1.545 | | | 506.30 | 166.68 | | | | |
| 2-4 | 1.475 | 0.1063 | 80.6 | 642.06 | 145.06 | 24.9 | | | 217.9 |
| 2-5 | 1.505 | 0.1143 | 72.5 | 620.58 | 148.80 | 25.1 | | | 215.6 |
| 2-6 | 1.550 | 0.0847 | 106.2 | 638.62 | 140.40 | 25.1 | | | 219.8 |
| 2-7 | 1.540 | 0.1197 | 60.3 | 826.28 | 182.78 | 32.2 | | | 221.4 |
| 2-8 | 1.576 | 0.1103 | 67.4 | 726.00 | 143.31 | 22.9 | | | 240.9 |
| 2-9 | 1.522 | | | 856.84 | 168.81 | | | | |
| 2-10 | 1.527 | | | 812.16 | 176.14 | | | | |
| 2-11 | 1.513 | | | 838.71 | 198.30 | | | | |
| 2-12 | 1.538 | | | 805.74 | 167.77 | | | | |
| 2-13 | 1.464 | | | 760.44 | 153.34 | | | | |
| 3-1 | 1.515 | | | 549.07 | 103.46 | | | | |
| 3-2 | 1.465 | | | 862.70 | 162.65 | | | | |
| 3-3 | 1.478 | | | 748.20 | 175.19 | | | | |
| 3-4 | 1.144 | | | 658.49 | 120.60 | | | | |
| 3-5 | 1.130 | | | 383.94 | 112.01 | | | | |
| 3-6 | 1.129 | 0.1193 | 48.8 | 443.89 | 123.80 | 43.4 | | | 217.1 |
| 3-7 | 1.111 | 0.1207 | 49.8 | 476.73 | 111.42 | 58.8 | | | 207.2 |
| 3-8 | 1.146 | 0.1103 | 55.5 | 422.57 | 107.74 | 43.9 | | | 190.3 |
| 3-9 | 1.140 | 0.1183 | 43.2 | 430.31 | 107.73 | 45.5 | | | 203.2 |
| 3-10 | 1.143 | 0.1080 | 58.6 | 465.97 | 111.99 | 52.4 | | | 228.0 |
| 3-11 | 1.175 | 0.1067 | 51.9 | 447.41 | 112.72 | 42.1 | | | 215.1 |
| 3-12 | 1.175 | 0.1187 | 48.4 | 420.40 | 106.64 | 49.1 | | | 202.9 |
| 3-13 | 1.212 | 0.1303 | 48.5 | 400.40 | 94.17 | 36.3 | | | 198.6 |
| 4-1 | 1.148 | | | 360.37 | 86.31 | | | | |
| 4-2 | 1.152 | | | 437.86 | 90.64 | | | | |
| 4-3 | 1.242 | 0.1503 | 40.2 | 458.63 | 66.80 | | | | |
| 4-4 | 1.230 | 0.1853 | 54.7 | 370.93 | 58.89 | | | | |
| 4-5 | 1.411 | 0.2067 | 39.9 | 441.47 | 39.66 | | | | |
| 4-6 | 1.326 | 0.2073 | 37.5 | 395.01 | 31.25 | | | | |
| 4-7 | 1.186 | 0.1997 | 36.0 | 286.82 | 25.28 | | | | |
| 4-8 | 1.015 | 0.2147 | 35.2 | 200.88 | 19.27 | | | | |
| 4-9 | 1.313 | 0.1890 | 46.9 | 367.11 | 31.74 | | | | |
| 4-10 | 1.358 | 0.2370 | 43.4 | 232.71 | 43.27 | | | | |
| 5-1 | 1.153 | 0.1177 | 52.1 | 181.40 | 107.99 | | | | |
| 5-2 | 1.157 | 0.1027 | 53.8 | 297.12 | 94.95 | | | | |
| 5-3 | 1.155 | 0.1157 | 46.8 | 315.99 | 98.40 | | | | |
| 5-4 | 1.078 | 0.0930 | 53.3 | 316.31 | 123.29 | | | | |
| 5-5 | 1.135 | 0.0977 | 67.4 | 305.42 | 119.70 | | | | |
| 5-6 | 1.234 | 0.1450 | 39.6 | 295.03 | 69.28 | | | | |
| 5-7 | 1.236 | 0.1330 | 46.8 | 299.01 | 68.80 | | | | |
| 5-8 | 1.285 | 0.1280 | 60.4 | 297.32 | 65.53 | | | | |
| 5-9 | 1.289 | 0.1397 | 48.6 | 248.67 | 65.97 | | | | |
| 5-10 | 1.493 | 0.1840 | 59.9 | 311.46 | 41.80 | | | | |
| 5-11 | 1.332 | 0.2080 | 30.1 | 267.30 | 34.43 | | | | |
| 5-12 | 1.241 | 0.2020 | 33.2 | 262.35 | 30.72 | | | | |
| 5-13 | 1.202 | 0.1683 | 39.4 | 215.78 | 28.61 | | | | |
| 5-14 | 1.068 | 0.1590 | 43.4 | 190.30 | 45.68 | | | | |
| 5-15 | 1.093 | 0.1323 | 48.8 | 221.86 | 51.74 | | | | |
| 6-1 | 1.166 | 0.1553 | 42.0 | 219.03 | 55.78 | | | | |
| 6-2 | 1.043 | 0.1453 | 39.5 | 219.30 | 54.89 | | | | |
| 6-3 | 1.050 | | | 216.25 | 53.84 | | | | |
| 6-4 | 1.301 | 0.1050 | 56.6 | 386.65 | 178.43 | | | | |

TABLE 4

Selected Products

| Sample | Bwt | Cal | Sp Vol | MD* | MDSTR | CD* | CDSTR | GMT | Md/CD | WETCD* | SAT | SAT gms/gm | Pred. SAT |
|---|---|---|---|---|---|---|---|---|---|---|---|---|---|
| 2-7 | 20.37 | 60.48 | 5.79 | 4132 | 23.2 | 3616 | 4.4 | 3865 | 1.143 | 982.13 | 324.809 | 4.90 | 4.47 |
| 2-8 | 20.84 | 61.56 | 5.76 | 3761 | 26.5 | 3559 | 5.0 | 3659 | 1.058 | 1,088.29 | 332.539 | 4.90 | 4.45 |
| 1-7 | 20.50 | 61.94 | 5.89 | 3895 | 25.2 | 3439 | 5.3 | 3660 | 1.132 | 999.16 | 328.262 | 4.92 | 4.56 |
| 1-8 | 20.80 | 60.58 | 5.68 | 3904 | 24.8 | 3608 | 5.5 | 3753 | 1.082 | 969.49 | 336.485 | 4.97 | 4.38 |
| 2-6 | 20.50 | 59.48 | 5.66 | 3611 | 25.9 | 3563 | 5.4 | 3587 | 1.014 | 1,078.93 | 338.295 | 5.07 | 4.36 |
| 1-6 | 20.19 | 62.44 | 6.03 | 3793 | 23.5 | 3598 | 5.5 | 3694 | 1.054 | 955.01 | 334.019 | 5.08 | 4.68 |
| 2-5 | 19.91 | 61.20 | 6.00 | 3668 | 25.4 | 3068 | 4.9 | 3354 | 1.196 | 1,046.25 | 344.215 | 5.31 | 4.65 |
| 2-4 | 19.50 | 57.50 | 5.75 | 3504 | 24.5 | 3097 | 4.9 | 3294 | 1.135 | 832.34 | 338.788 | 5.34 | 4.44 |
| 3-13 | 16.03 | 57.40 | 6.99 | 2319 | 24.9 | 1822 | 4.9 | 2056 | 1.276 | 529.99 | 293.397 | 5.62 | 5.50 |
| 3-11 | 15.54 | 53.12 | 6.67 | 2721 | 24.4 | 2337 | 5.2 | 2522 | 1.164 | 674.02 | 284.516 | 5.63 | 5.23 |
| 3-9 | 15.08 | 54.02 | 6.99 | 2525 | 23.6 | 2273 | 5.2 | 2396 | 1.111 | 575.91 | 276.787 | 5.64 | 5.50 |
| 3-8 | 15.15 | 53.68 | 6.91 | 2500 | 23.3 | 2319 | 5.5 | 2408 | 1.079 | 575.97 | 287.477 | 5.83 | 5.43 |
| 3-10 | 15.11 | 53.04 | 6.85 | 2453 | 23.3 | 2202 | 4.8 | 2324 | 1.116 | 625.81 | 287.477 | 5.84 | 5.38 |
| 3-12 | 15.54 | 54.04 | 6.79 | 2524 | 23.2 | 2268 | 5.4 | 2393 | 1.128 | 715.30 | 298.824 | 5.91 | 5.33 |
| 3-7 | 14.70 | 53.12 | 7.05 | 2626 | 23.7 | 2260 | 4.8 | 2436 | 1.162 | 688.65 | 283.201 | 5.92 | 5.55 |
| 3-6 | 14.93 | 52.20 | 6.82 | 2692 | 22.8 | 2181 | 5.0 | 2423 | 1.236 | 653.00 | 287.806 | 5.92 | 5.35 |
| 4-3 | 16.42 | 68.26 | 8.11 | 2392 | 36.2 | 2628 | 5.7 | 2507 | 0.911 | 686.76 | 352.932 | 6.60 | 6.46 |
| 4-5 | 18.66 | 80.40 | 8.40 | 2055 | 52.6 | 2692 | 6.0 | 2352 | 0.764 | 604.63 | 446.180 | 7.34 | 6.72 |
| 4-7 | 15.69 | 73.08 | 9.09 | 1350 | 53.9 | 2085 | 7.5 | 1677 | 0.647 | 495.32 | 376.614 | 7.38 | 7.31 |
| 4-6 | 17.54 | 78.22 | 8.70 | 1741 | 54.5 | 2326 | 6.0 | 2012 | 0.750 | 606.87 | 421.512 | 7.38 | 6.97 |
| 4-4 | 16.27 | 62.82 | 7.53 | 2101 | 35.7 | 2198 | 6.0 | 2149 | 0.956 | 550.84 | 393.882 | 7.44 | 5.97 |
| 4-10 | 17.96 | 83.42 | 9.06 | 2397 | 55.2 | 1693 | 7.5 | 2014 | 1.417 | 453.38 | 466.245 | 7.97 | 7.28 |
| 4-9 | 17.37 | 81.92 | 9.20 | 1651 | 53.0 | 2262 | 6.0 | 1933 | 0.730 | 346.16 | 451.443 | 7.99 | 7.40 |
| 4-8 | 13.43 | 67.62 | 9.83 | 918 | 48.1 | 1569 | 7.8 | 1200 | 0.585 | 441.99 | 363.622 | 8.32 | 7.94 |

*indicates tensile value

TABLE 5

Comparison of Sheets With and Without High Yield Fiber

| Small Dryer Speed fpm | Yankee Speed fpm | Reel Speed fpm | BCTMP % | Fabric Crepe Ratio | Basis Weight lb/rm | Caliper mils/8sht | MD Dry Tensile gm/3" | MD Stretch % | CD Dry Tensile gm/3" | CD Stretch % | Geom. Mean Tensile gm/3" | MD/CD Ratio | SAT Capacity gsm | Specific SAT gm/gm |
|---|---|---|---|---|---|---|---|---|---|---|---|---|---|---|
| 2000 | 1800 | 1700 | 0 | 1.11 | 24.92 | 77.10 | 2233 | 20.1 | 3113 | 4.1 | 2636 | 0.72 | 393.4 | 4.85 |
| 2000 | 1800 | 1700 | 0 | 1.11 | 25.01 | 77.16 | 2374 | 20.8 | 3124 | 3.9 | 2723 | 0.76 | 369.0 | 4.53 |
| 2600 | 1800 | 1700 | 0 | 1.44 | 25.66 | 110.36 | 1856 | 51.6 | 415 | 19.6 | 877 | 4.48 | 501.3 | 6.00 |
| 2600 | 1800 | 1700 | 0 | 1.44 | 24.93 | 108.42 | 2037 | 54.1 | 421 | 20.3 | 926 | 4.85 | 530.5 | 6.54 |
| 2000 | 1801 | 1684 | 0 | 1.11 | 25.08 | 76.30 | 3010 | 19.2 | 3570 | 4.4 | 3278 | 0.84 | 389.8 | 4.77 |
| 2000 | 1801 | 1684 | 0 | 1.11 | 24.85 | 75.40 | 3246 | 20.0 | 3692 | 4.1 | 3460 | 0.88 | 385.8 | 4.77 |
| 2299 | 1800 | 1695 | 0 | 1.28 | 24.44 | 83.66 | 3836 | 35.3 | 3660 | 5.4 | 3747 | 1.05 | 423.8 | 5.33 |
| 2298 | 1800 | 1712 | 0 | 1.28 | 24.68 | 85.12 | 4202 | 37.4 | 3896 | 5.6 | 4044 | 1.08 | 415.3 | 5.17 |
| 2598 | 1800 | 1712 | 0 | 1.44 | 25.08 | 97.86 | 3800 | 52.5 | 1177 | 11.3 | 2114 | 3.23 | 488.0 | 5.98 |
| 2600 | 1800 | 1712 | 0 | 1.44 | 25.11 | 97.00 | 3702 | 51.7 | 1199 | 11.5 | 2106 | 3.09 | 478.7 | 5.86 |
| 2300 | 1800 | 1700 | 25 | 1.28 | 24.08 | 98.50 | 3049 | 37.2 | 1000 | 7.2 | 1745 | 3.05 | 486.3 | 6.20 |
| 2300 | 1800 | 1700 | 25 | 1.28 | 24.08 | 83.80 | 3230 | 35.3 | 987 | 7.1 | 1785 | 3.28 | 433.5 | 5.53 |
| 2299 | 1800 | 1709 | 25 | 1.28 | 24.68 | 97.14 | 3254 | 37.4 | 1144 | 7.8 | 1928 | 2.85 | 511.5 | 6.37 |
| 2299 | 1800 | 1709 | 25 | 1.28 | 24.92 | 98.26 | 3388 | 36.8 | 1119 | 7.2 | 1946 | 3.04 | 494.2 | 6.09 |
| 2300 | 1800 | 1723 | 25 | 1.28 | 24.89 | 89.00 | 4136 | 36.1 | 3249 | 5.4 | 3666 | 1.27 | 441.9 | 5.45 |
| 2296 | 1800 | 1723 | 25 | 1.28 | 25.17 | 89.22 | 4156 | 35.9 | 3063 | 5.2 | 3566 | 1.36 | 450.1 | 5.49 |
| 2303 | 1800 | 1723 | 25 | 1.28 | 24.80 | 87.38 | 3180 | 35.5 | 4360 | 4.6 | 3723 | 0.73 | 446.8 | 5.54 |
| 2301 | 1800 | 1723 | 25 | 1.28 | 24.65 | 86.84 | 3092 | 35.2 | 4285 | 4.6 | 3639 | 0.72 | 461.6 | 5.75 |
| 2000 | 1800 | 1700 | 50 | 1.11 | 23.56 | 81.60 | 2858 | 19.3 | 3453 | 3.4 | 3139 | 0.83 | 435.7 | 5.68 |
| 2000 | 1800 | 1700 | 50 | 1.11 | 24.05 | 81.74 | 2856 | 18.9 | 3570 | 3.4 | 3192 | 0.80 | 424.1 | 5.42 |
| 2600 | 1800 | 1700 | 50 | 1.44 | 24.03 | 114.08 | 2189 | 50.7 | 509 | 14.8 | 1055 | 4.30 | 565.7 | 7.23 |
| 2600 | 1800 | 1700 | 50 | 1.44 | 24.17 | 111.68 | 2349 | 50.0 | 550 | 14.6 | 1136 | 4.27 | 548.3 | 6.97 |
| 2000 | 1800 | 1723 | 50 | 1.11 | 23.74 | 71.46 | 4480 | 19.4 | 5423 | 3.5 | 4928 | 0.83 | 367.4 | 4.76 |
| 2001 | 1800 | 1723 | 50 | 1.11 | 24.05 | 75.22 | 4656 | 18.5 | 5464 | 3.6 | 5043 | 0.85 | 394.9 | 5.04 |
| 2599 | 1800 | 1723 | 50 | 1.44 | 24.72 | 102.86 | 3687 | 51.5 | 1416 | 8.4 | 2285 | 2.61 | 530.5 | 6.59 |
| 2589 | 1800 | 1723 | 50 | 1.44 | 24.13 | 102.74 | 3480 | 51.7 | 1469 | 8.3 | 2261 | 2.37 | 543.0 | 6.91 |

It is seen in the Tables and FIGS. 24 and 25 that the web of the invention exhibits absorbency and specific volumes higher than conventional wet pressed products and approaching those of typical conventional throughdried (TAD) products. The comparison is further summarized in Table 6 where it is also seen that the MD/CD dry tensile ratios of some of the preferred products of the invention are unique.

TABLE 6

Comparison of Typical Web Properties

| Property | Conventional Wet Press | Conventional Throughdried | High Speed Fabric Crepe |
|---|---|---|---|
| SAT g/g | 4 | 10 | 6-9 |
| *Bulk | 40 | 120+ | 50-115 |
| MD/CD Tensile | >1 | >1 | <1 |
| CD Stretch (%) | 3-4 | 7-10 | 5-10 |

*mils/8sheet

Indeed, MD/CD dry tensile ratios are unexpectedly low and can go below 0.5 which is considerably lower than can usually be achieved by control of jet to wire alone speed. At the same time, CD stretch values are high. Moreover, the MD stretch achieved is seen in Table 3 to approach 50 and even exceed 50%. In other cases, we have achieved MD stretch of over 80% while maintaining good machine runnability even with recycle fiber. The unique properties, especially absorbency and volume are consistent with the web microstructures observed in FIGS. 33 through 41.

Figure 33:
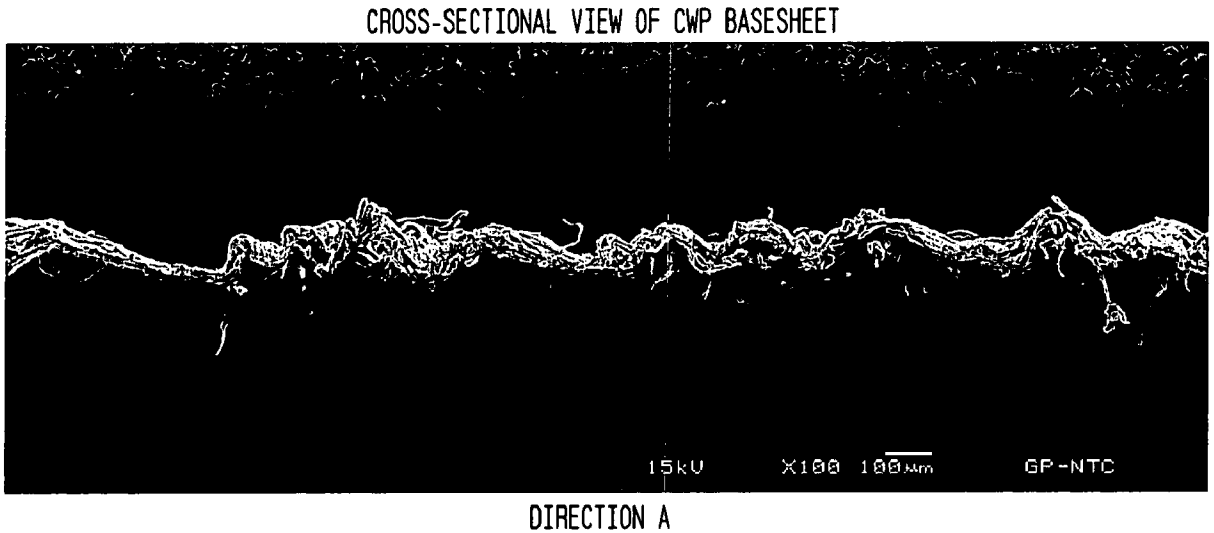
FIG. 33 (PRIOR ART)
FIGS. 33 and 34 are cross-section photomicrographs of a conventional wet-pressed web along the machine-direction and cross-direction, respectively.
Figure 34:
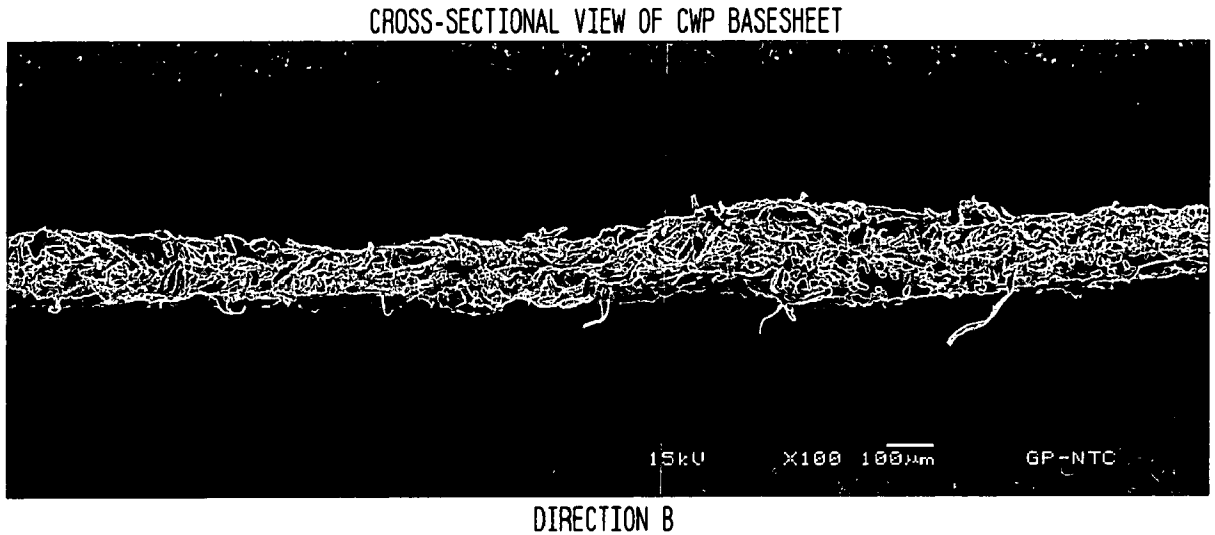
FIG. 34 (PRIOR ART)
Figure 41:
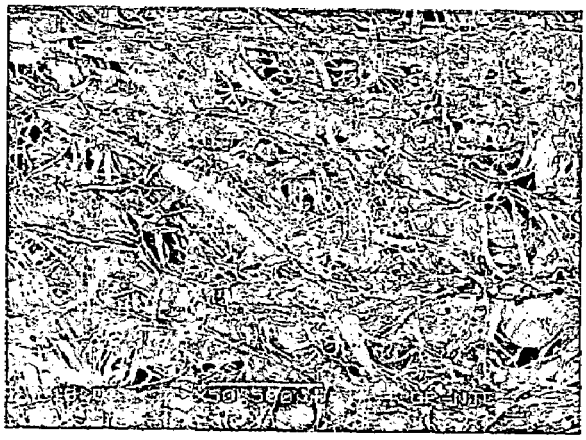
FIG. 41 (PRIOR ART)
FIG. 41 is a photomicrograph of the surface of a conventional wet-pressed sheet.
Figure 42:
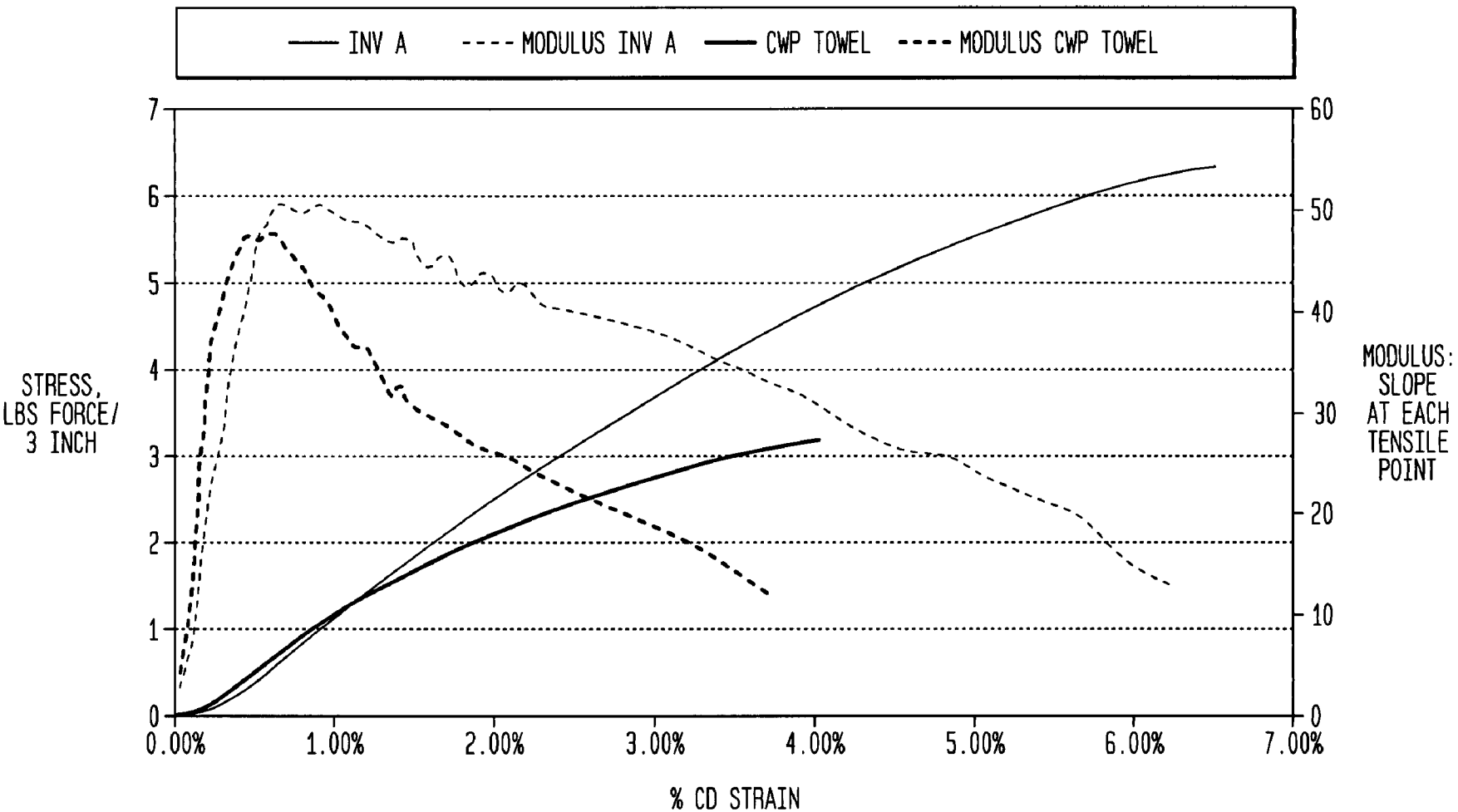
FIGS. 42, 43 and 44 include plots of applied stress versus CD strain and modulus versus CD strain for absorbent sheet of the invention and conventional wet-pressed sheet.
Figure 43:
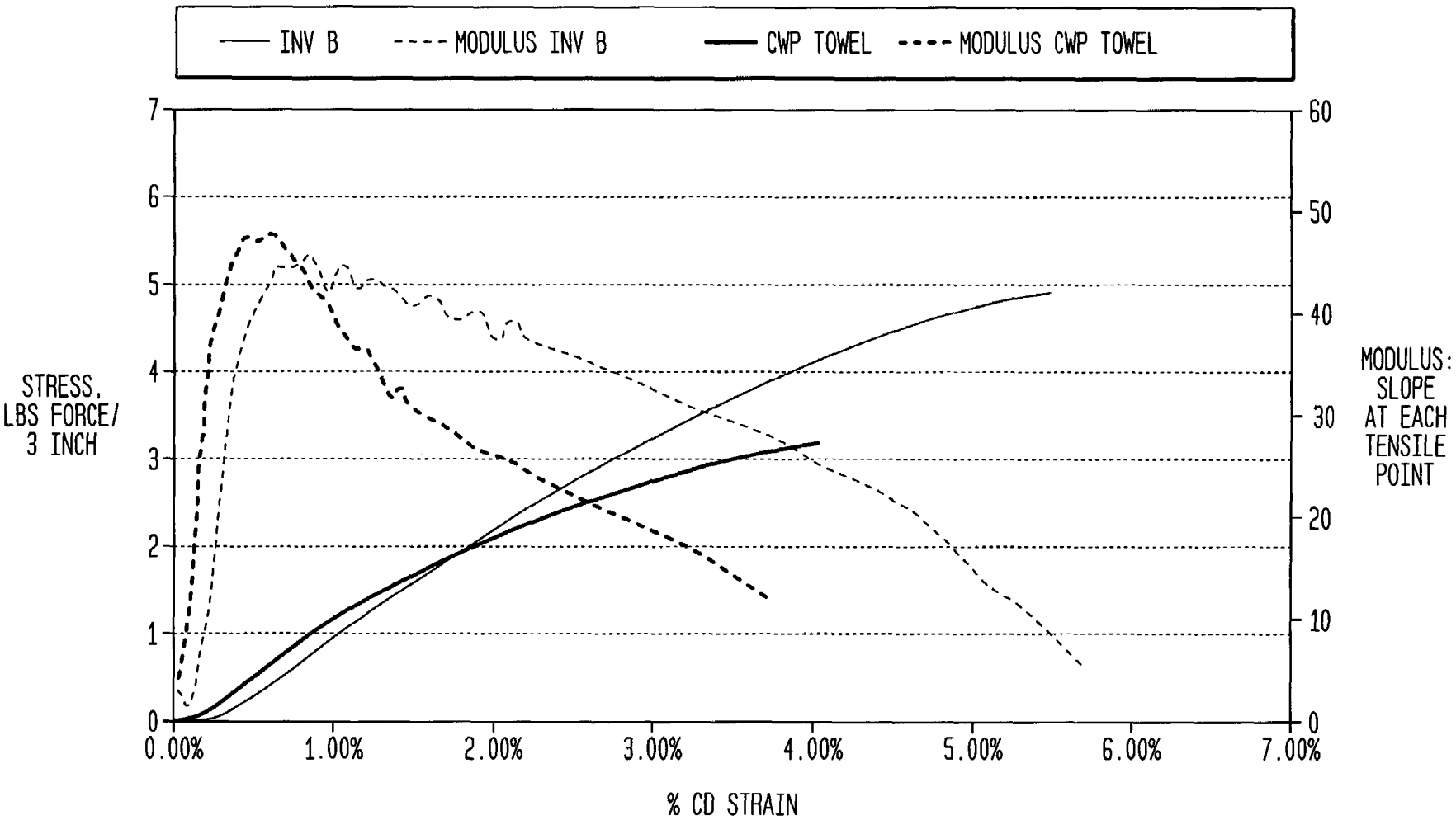
Figure 44:
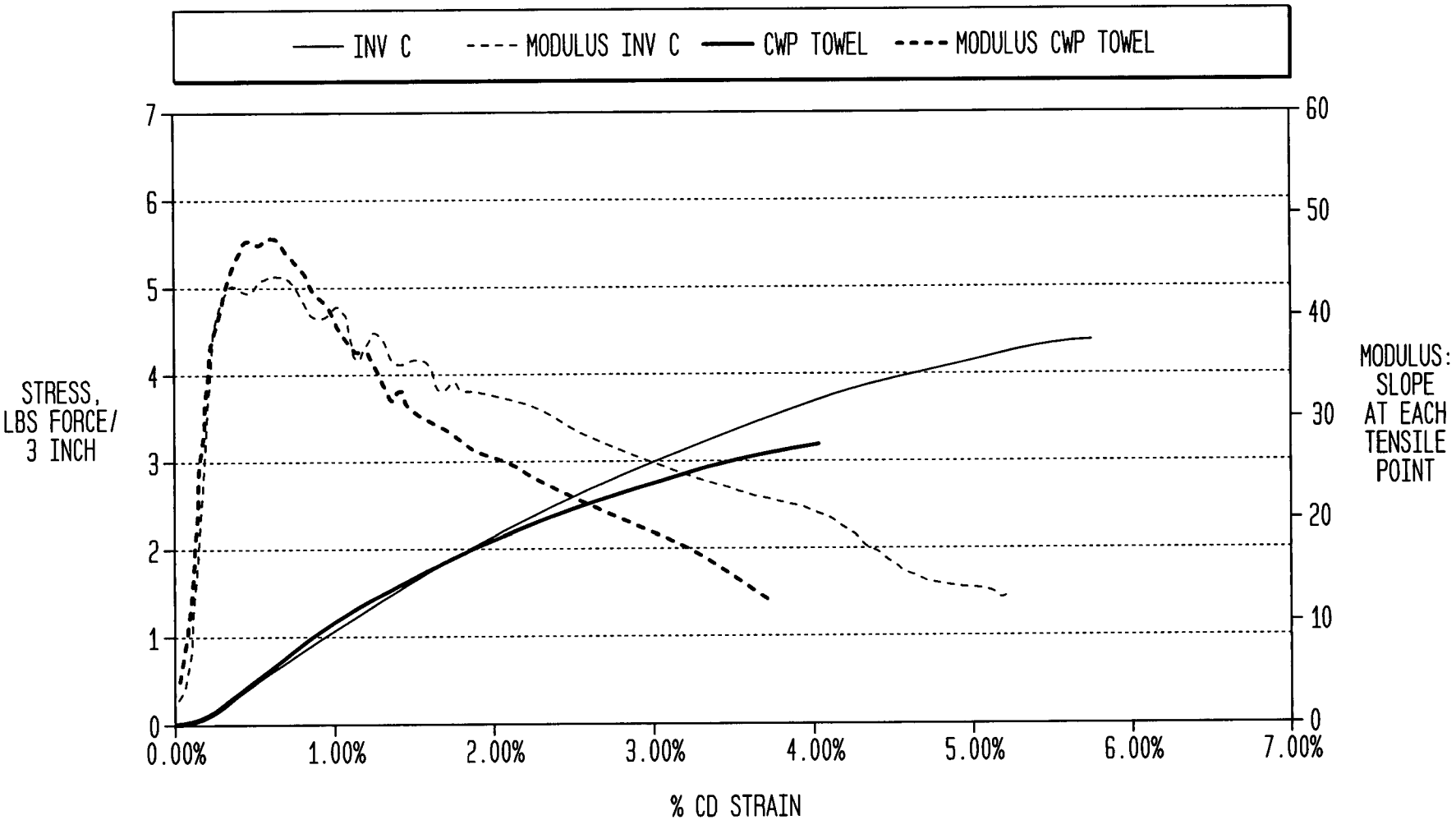
Figure 45:
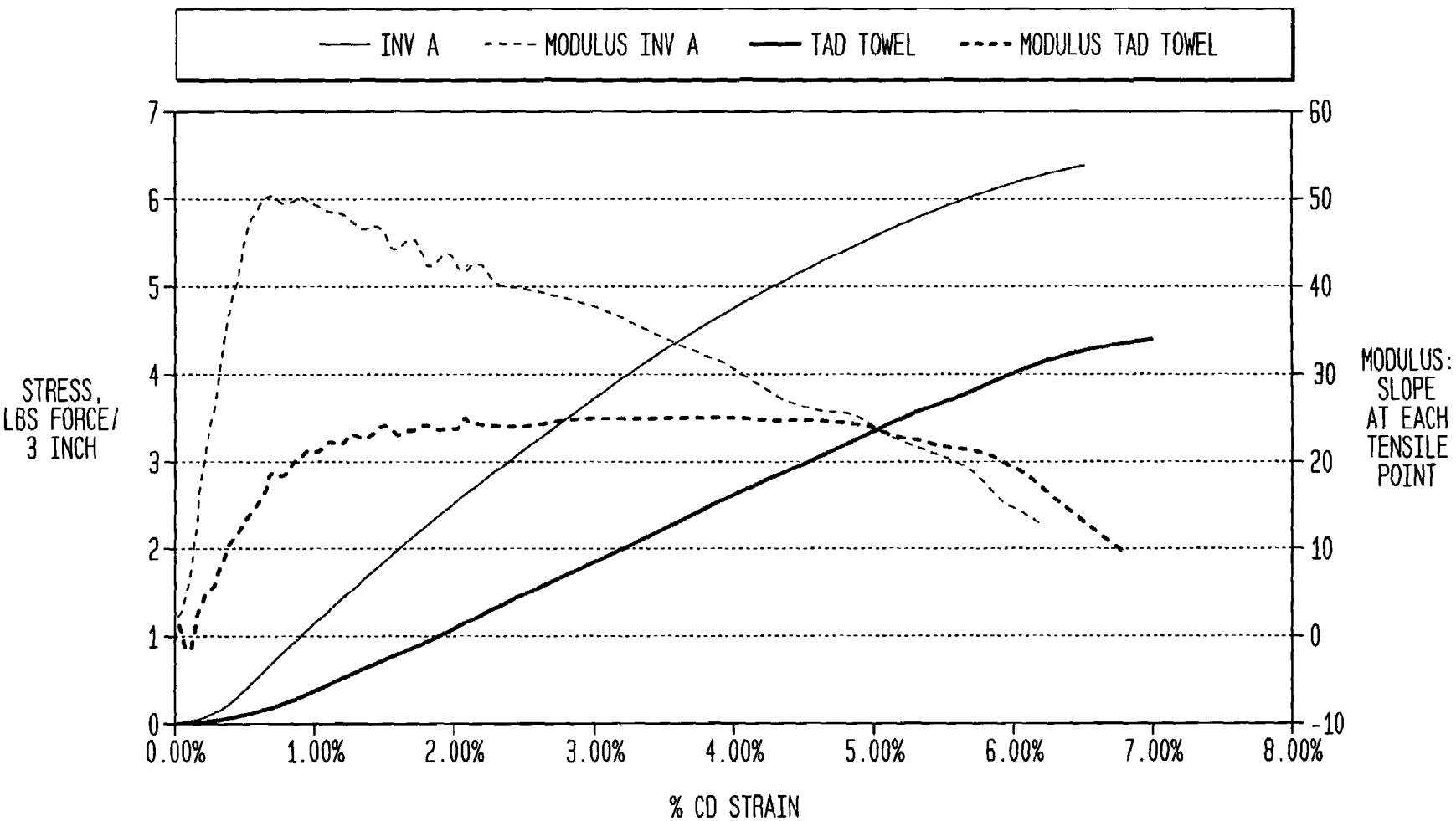
FIGS. 45, 46 and 47 include plots of applied stress versus CD strain and modulus versus CD strain for another absorbent sheet of the invention and conventional throughdried sheet.
Figure 46:
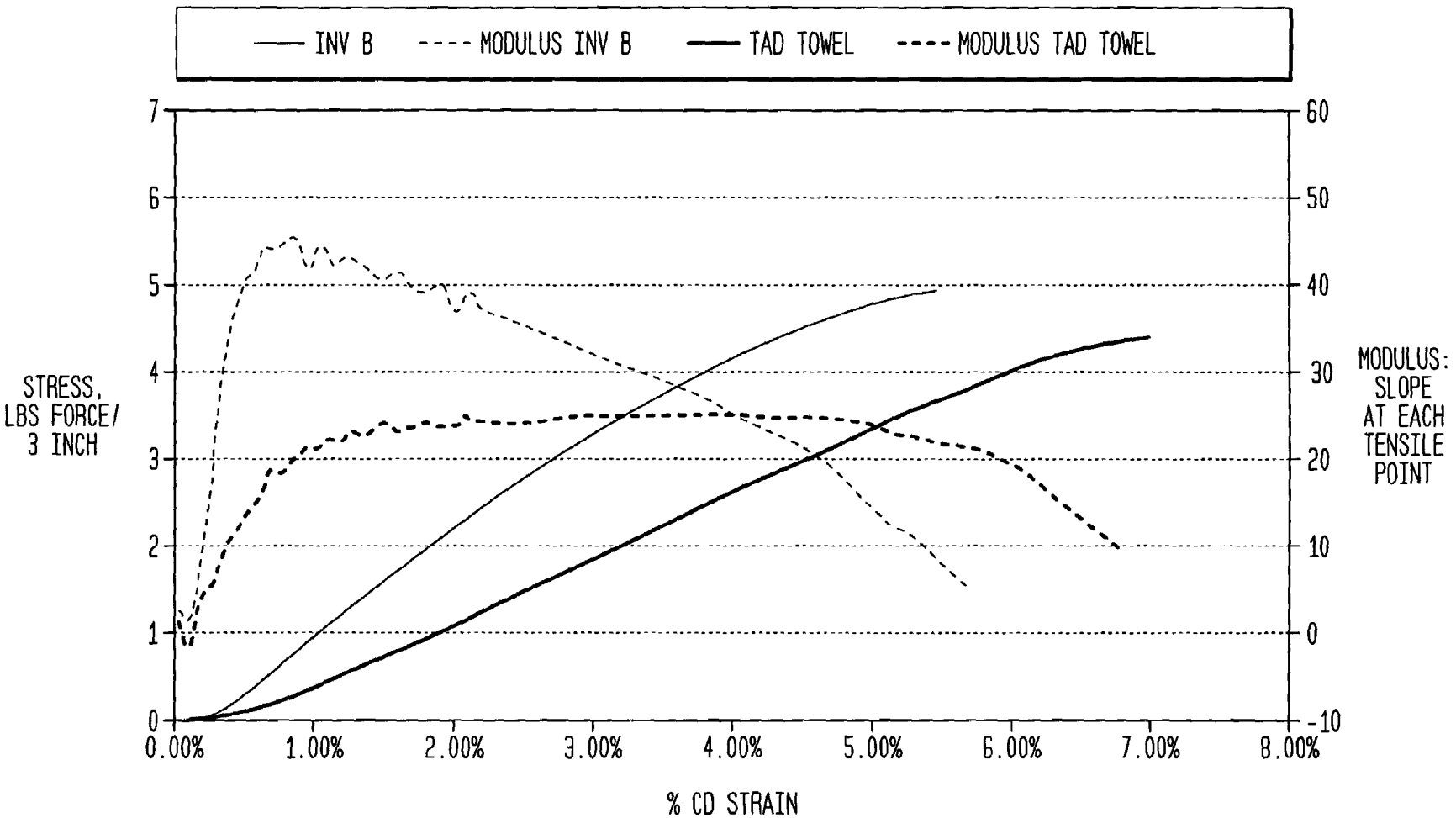
Figure 47:
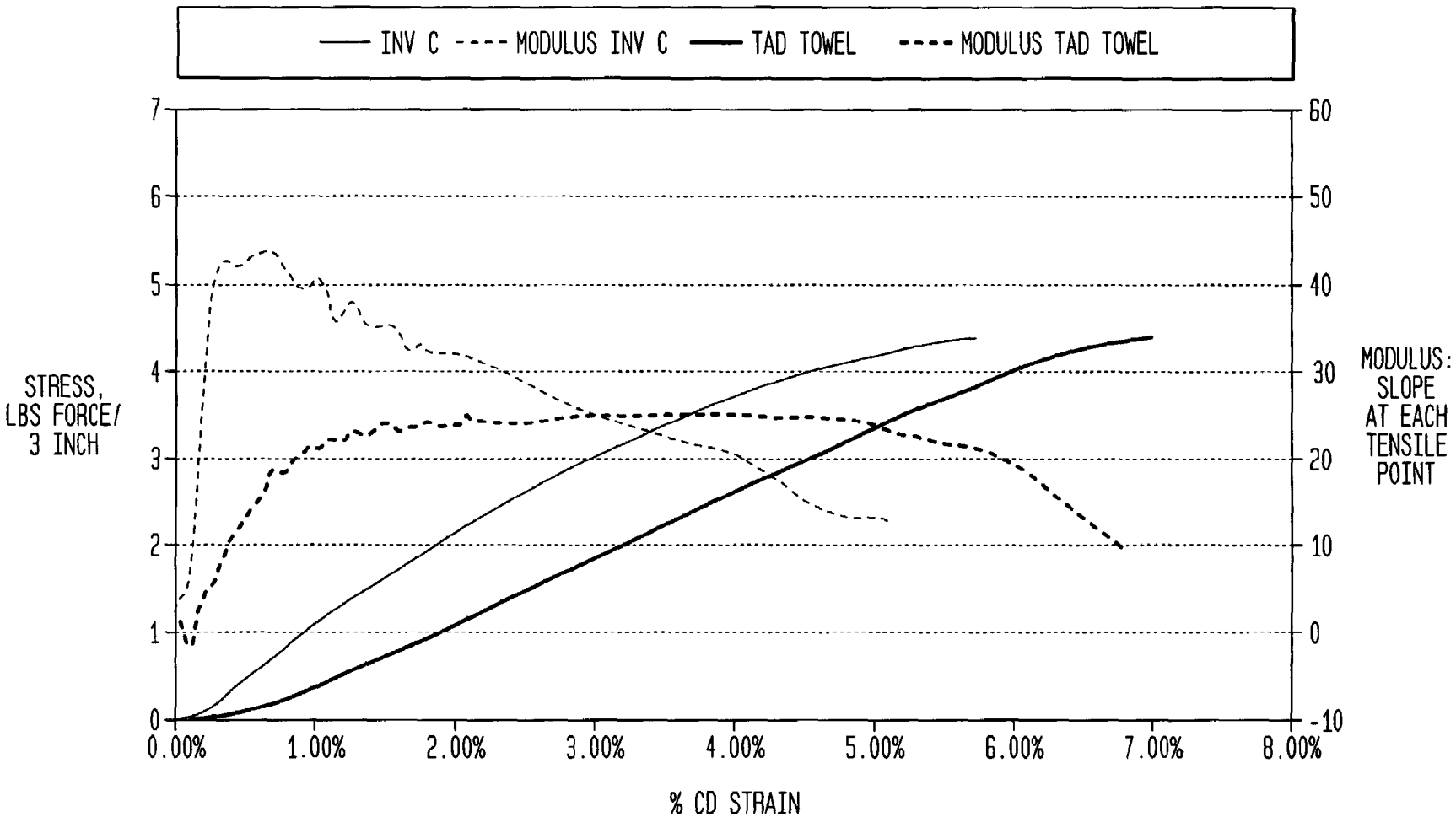
Figure 48:
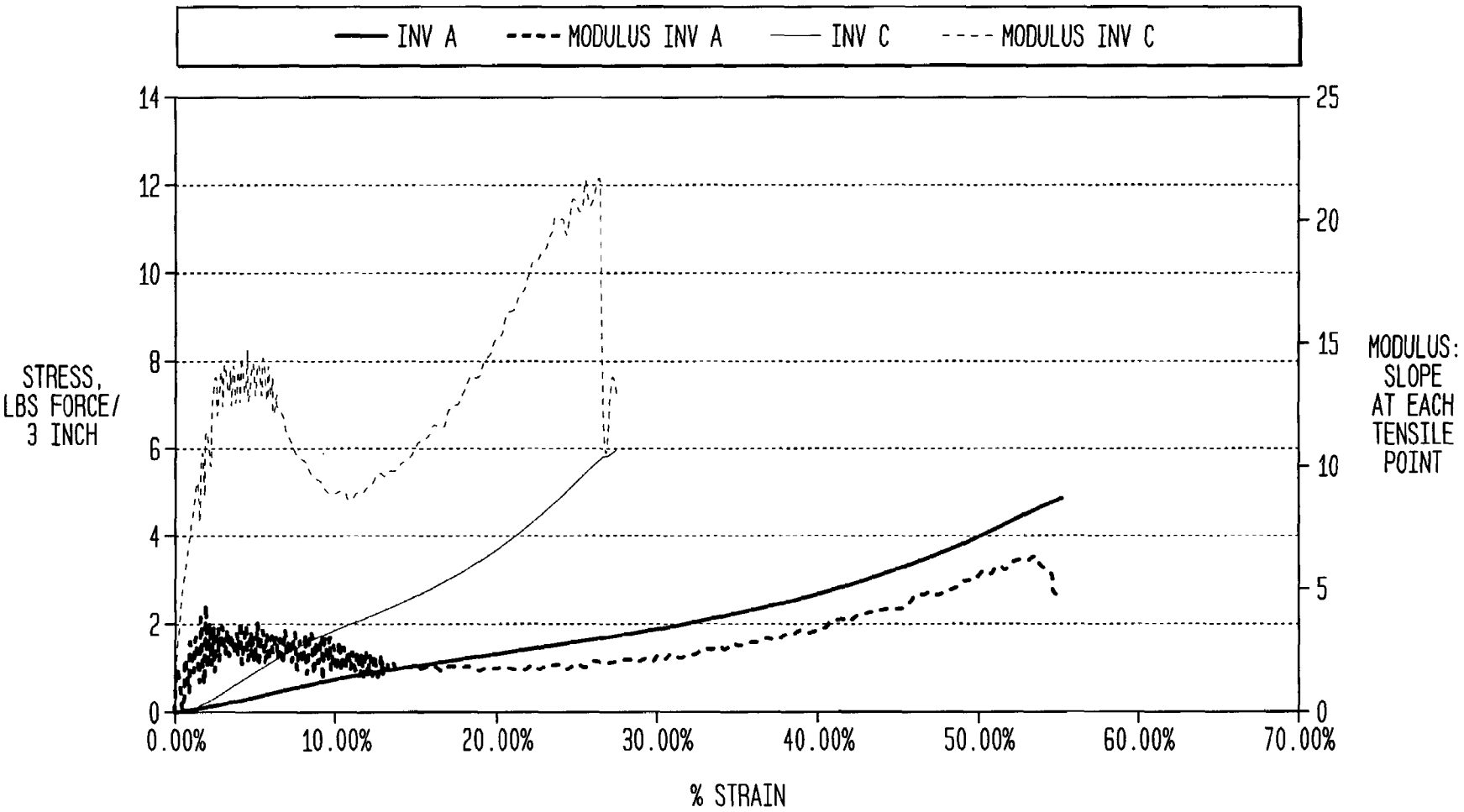
FIGS. 48 and 49 include plots of applied stress versus MD strain and modulus versus MD strain for various sheets of the invention.
Figure 49:
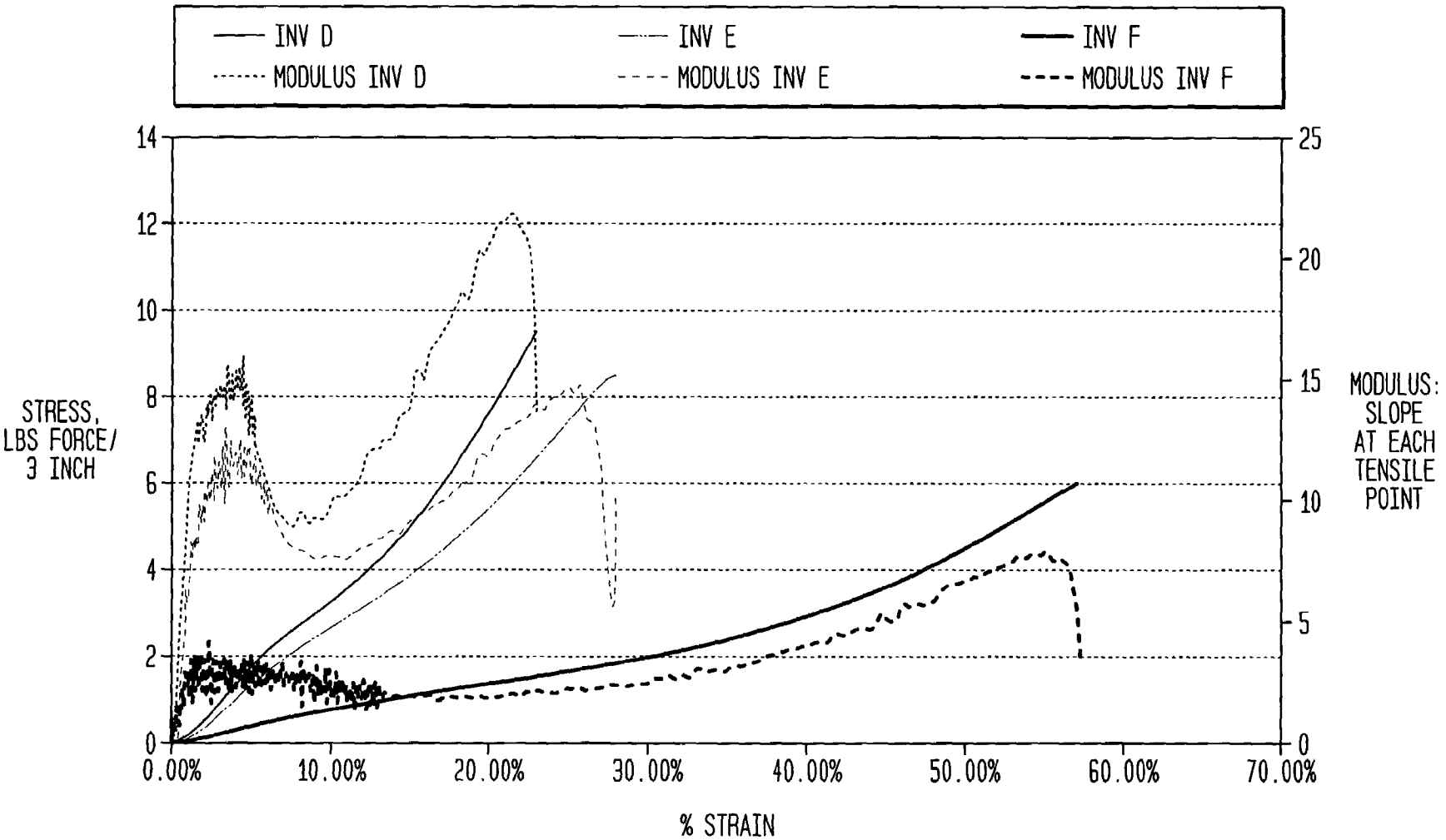
Figure 50:
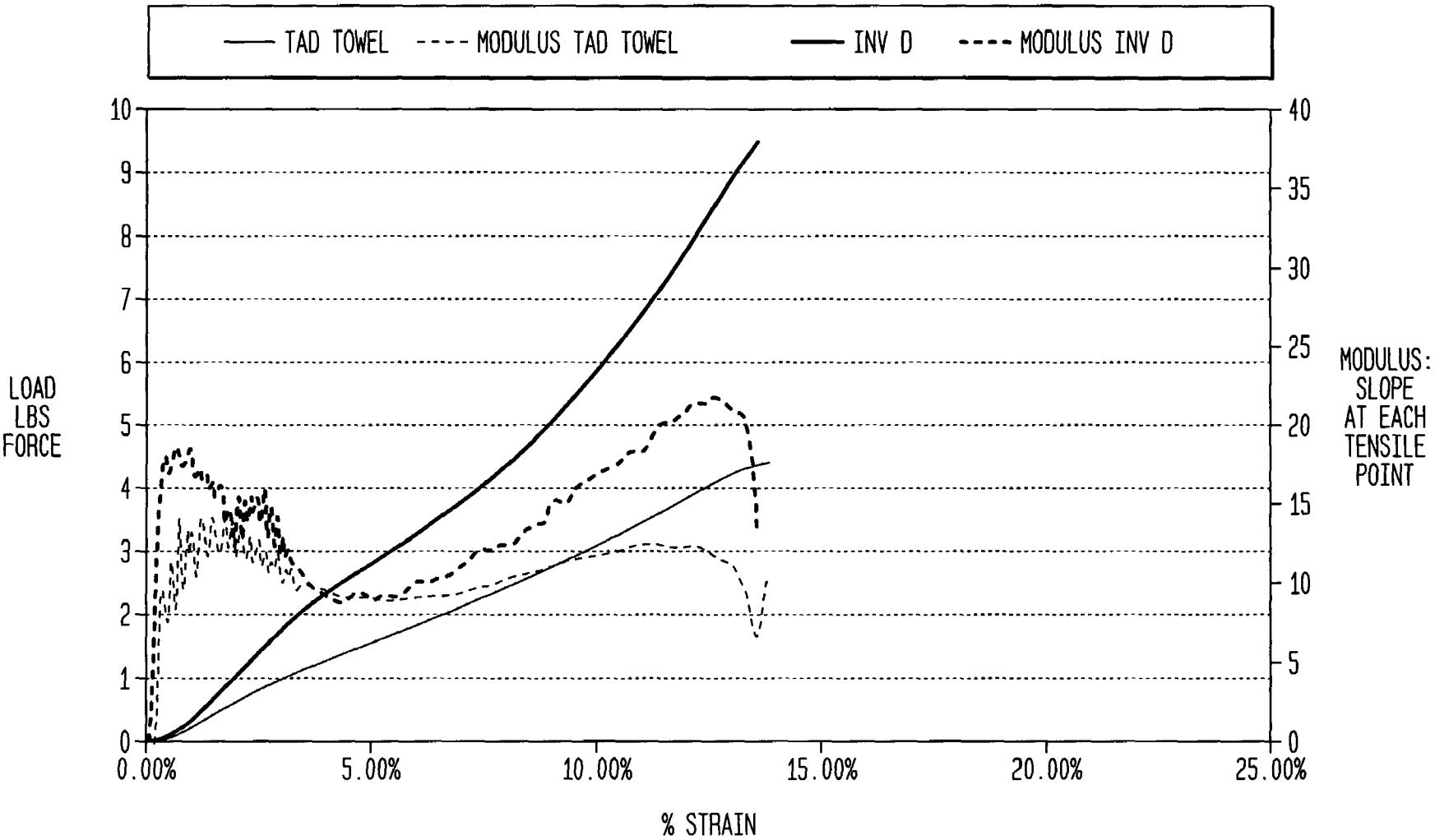
FIGS. 50, 51 and 52 include plots of applied stress versus MD strain and modulus versus MD strain for various products of the invention of relatively lower stretch at break values and conventional wet-pressed products and throughdried products.
Figure 51:
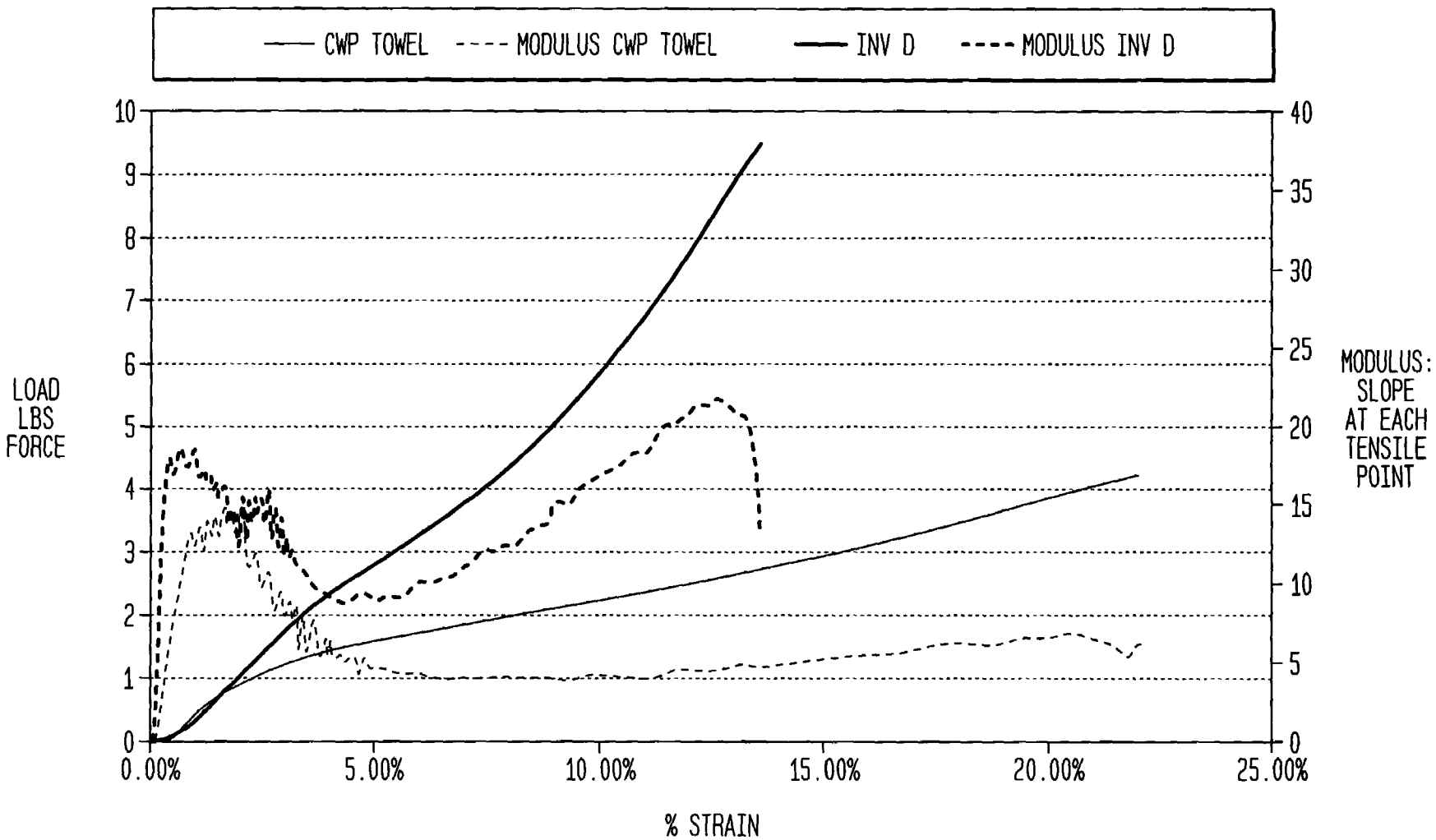
Figure 52:
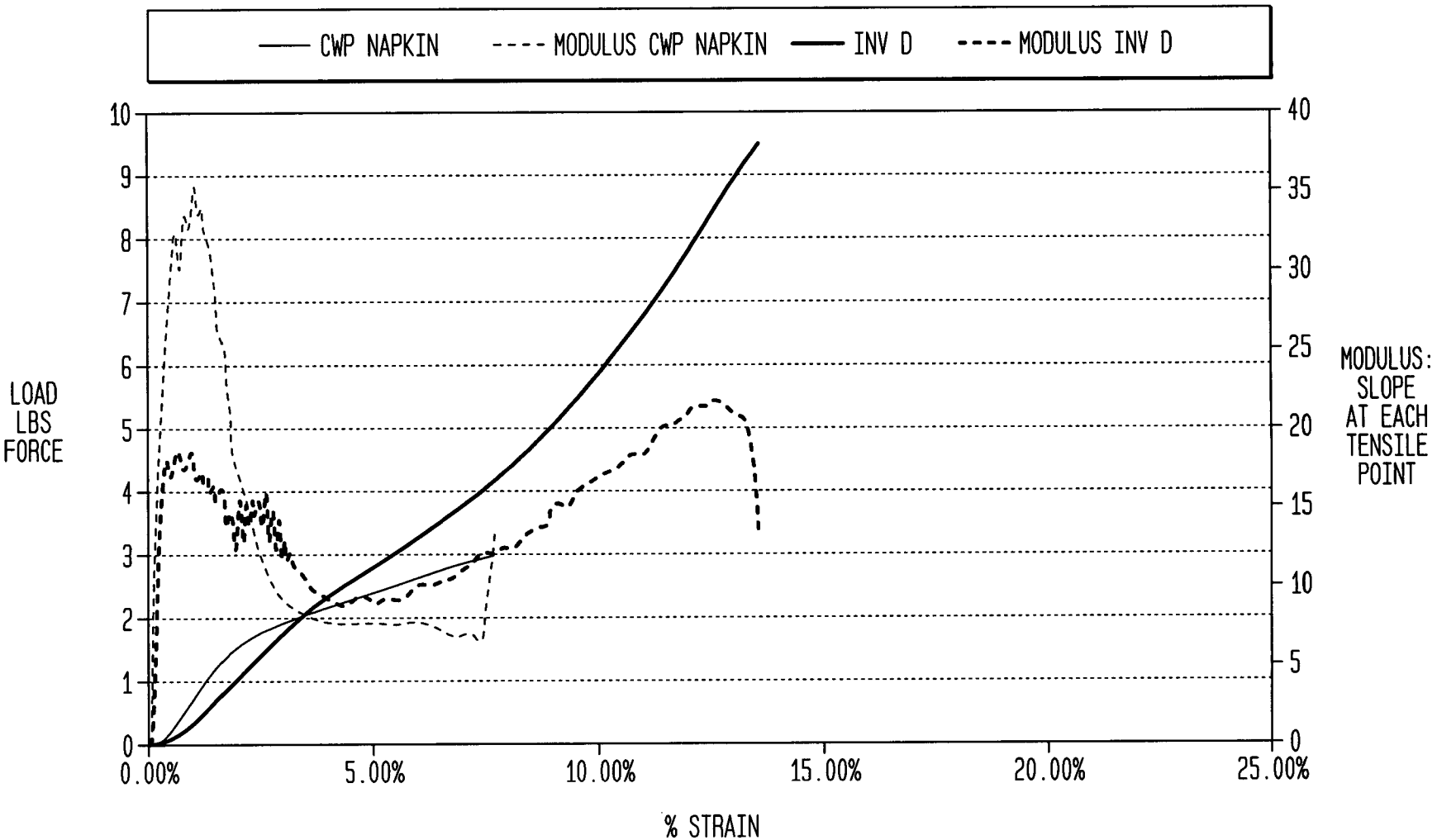
Figure 53:
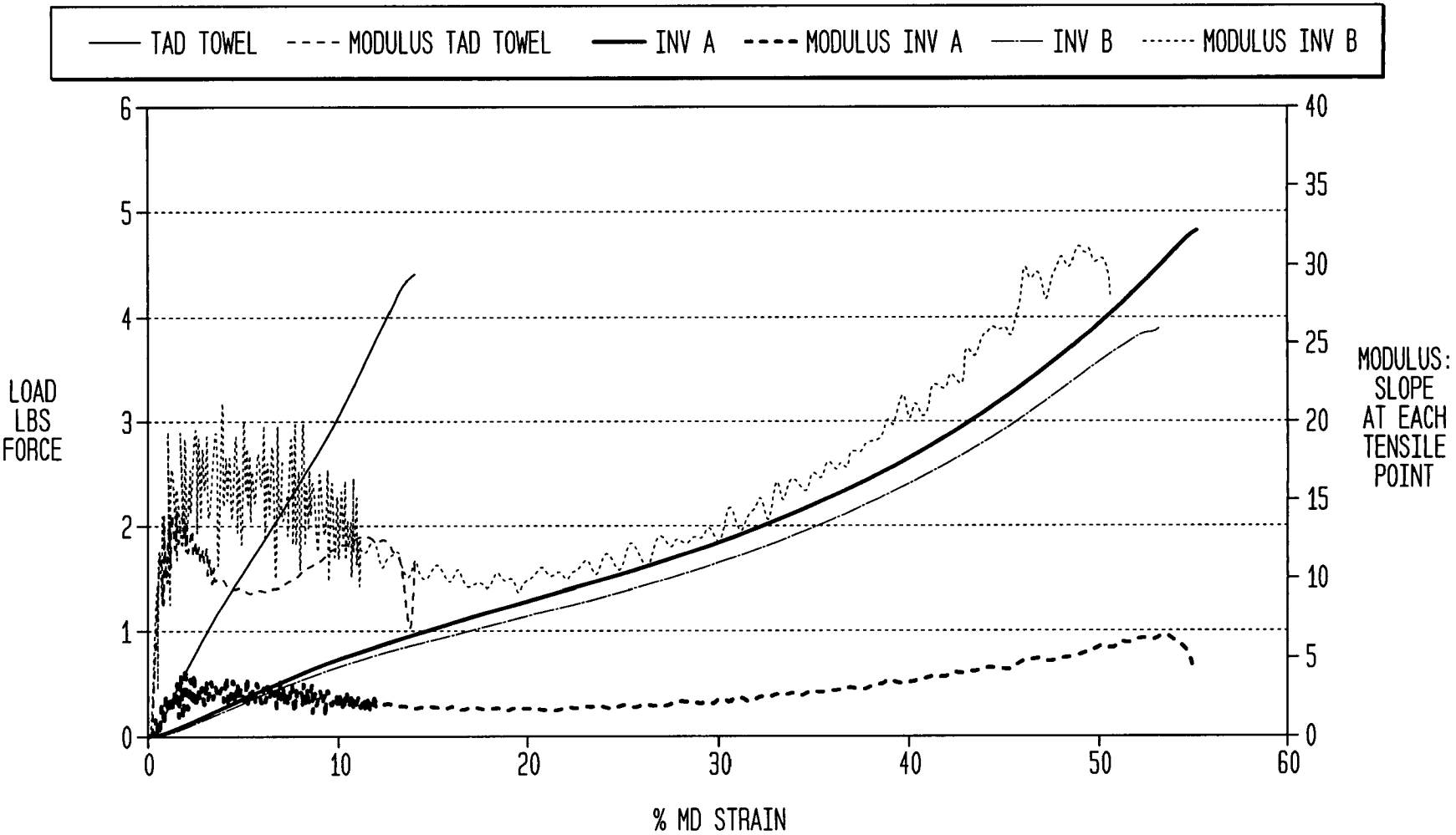
FIGS. 53, 54 and 55 include plots of applied force versus MD strain and modulus versus MD strain for various products of the invention of relatively higher stretch at break values and conventional wet-pressed products and throughdried products.

FIGS. 33 and 34 are sectional photomicrographs (100×) along the machine-direction (Direction A) and cross-machine-direction (Direction B) of a web produced by conventional wet pressing, without a high impact fabric crepe as provided by the invention. FIG. 41 is a photomicrograph (50×) of the air side surface of the web. It is seen in these photographs that the microstructure of the web is relatively closed or dense without large interstitial volume between fibers.

Figure 35:
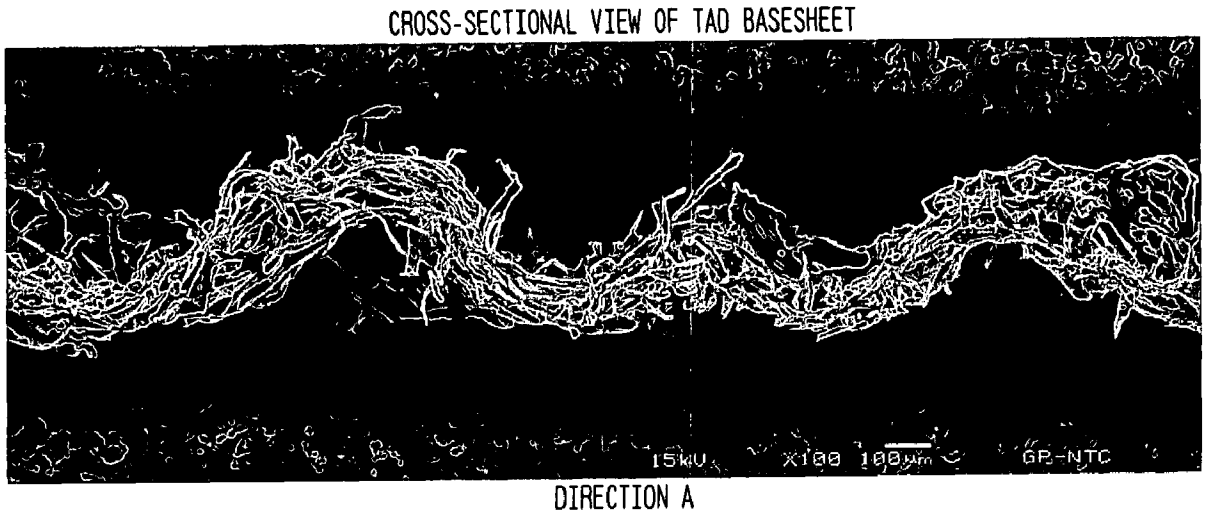
FIG. 35 (PRIOR ART)
FIGS. 35 and 36 are cross-section photomicrographs of a conventional thorughdried web along the machine-direction and cross-direction, respectively.
Figure 36:
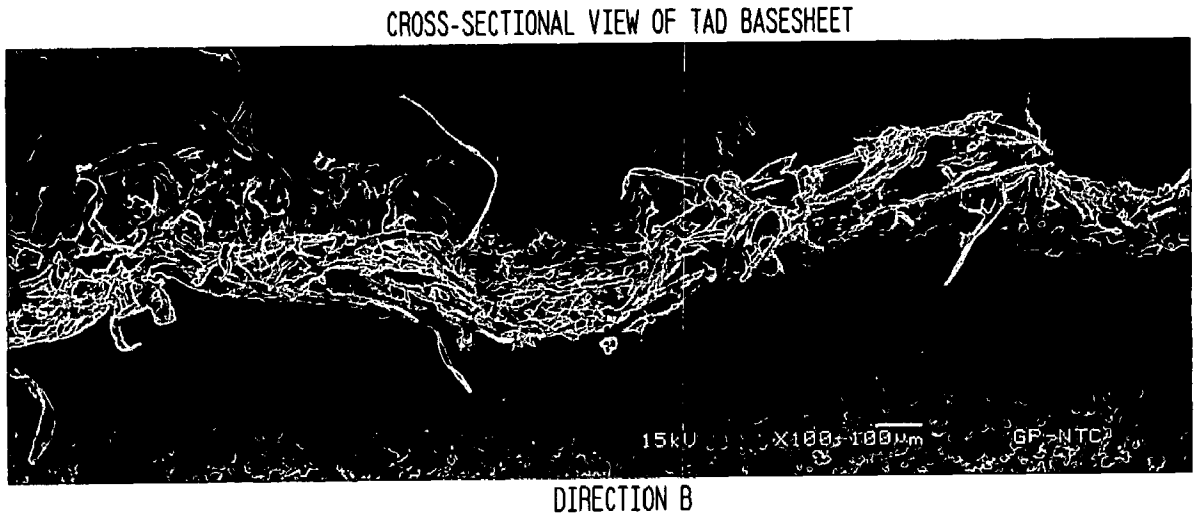
FIG. 36 (PRIOR ART)
Figure 39:
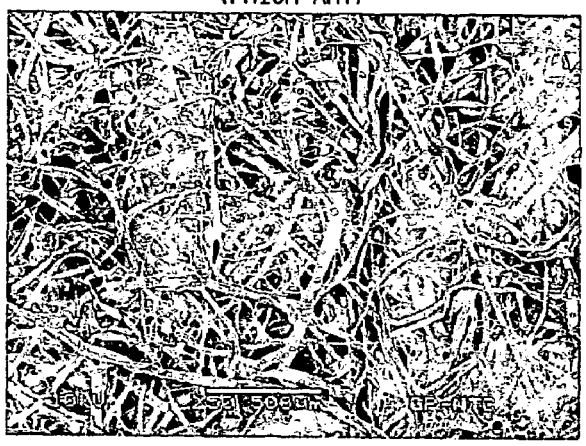
FIG. 39 (PRIOR ART)
FIG. 39 is a photomicrograph of the surface of a conventional throughdried sheet.

In contrast, there is shown in FIGS. 35, 36 and 39 like photomicrographs of a web prepared by conventional TAD processing. Here it is seen that the microstructure of the web is relatively open with large interstitial volumes between fibers.

Figure 37:
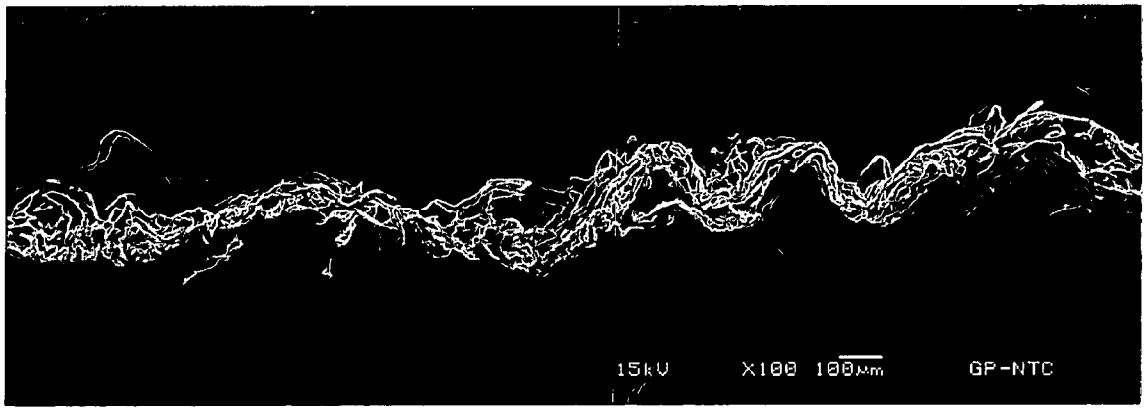
FIGS. 37 and 38 are cross-section photomicrographs along the machine-direction and cross-direction, respectively, of a high impact fabric creped web of the invention.
Figure 38:
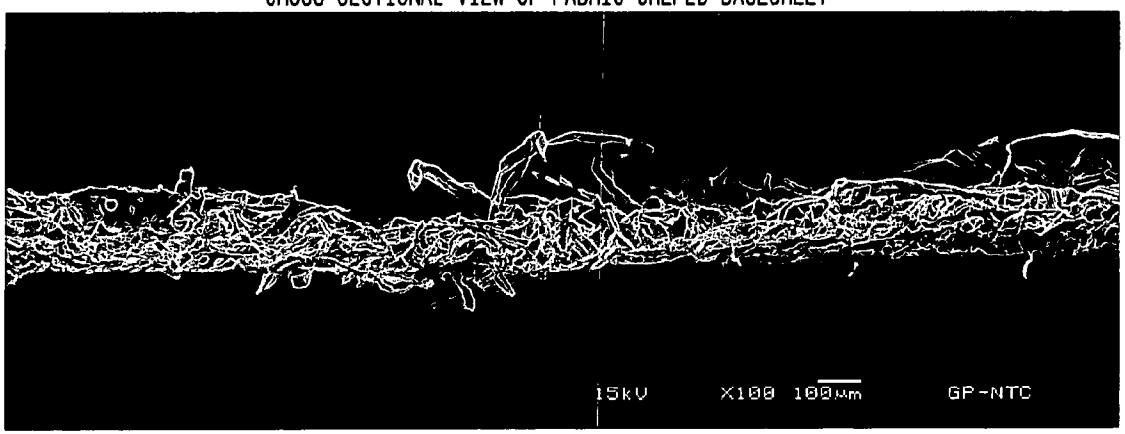
Figure 40:
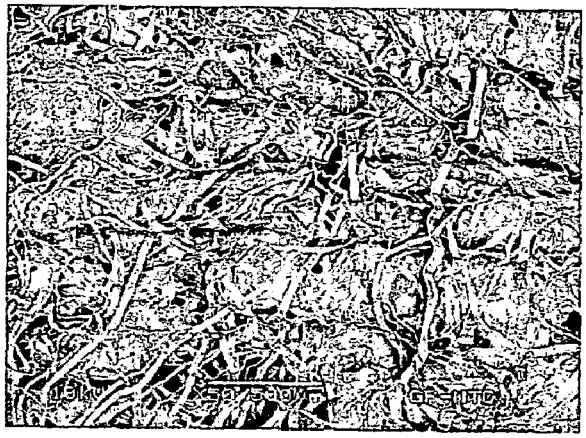
FIG. 40 is a photomicrograph of the surface of a high impact fabric creped sheet prepared in accordance with the invention.

FIGS. 37 and 38 are photomicrographs (100×) along the machine-direction (Direction A) and cross-machine-direction (Direction B) of a web produced by high impact fabric creping on a papermachine such as FIG. 20. FIG. 40 is a surface view (50×) of the web. Here it is seen that the web has an open microstructure like the TAD web of FIGS. 35, 36 and 39 with large interstitial volume between fibers, consistent with the elevated levels of absorbency observed in the finished product.

Thus, densification inherent in conventional wet-press processes is reversed by high impact fabric creping. Conveniently, the fabric creped web can be dried by applying the web to a drying drum with a suitable adhesive and creping the web therefrom while preserving and enhancing the desirable properties of the web.

In FIGS. 42 through 55 there are shown stress/strain relationships for products of the invention, as well as conventional CWP and TAD products wherein it is seen the products of the invention exhibit unique CD modulus characteristics and large MD stretch values particularly. Stress is expressed in g/3" (as in tensile at break) strain is expressed in % (as in stretch at break) values. It is noted in connection with FIGS. 42, 43, 44, 45, 46 and 47 that the CD modulus of the products of the invention behaves somewhat like CWP products at low strain, reaching a peak value at a strain of less than one percent; however unlike CWP products, high modulus is sustained at CD strains of 3-5 percent. Typically, products of the invention exhibit a maximum CD modulus at less than 1 percent strain and sustain a CD modulus of at least 50 percent of the peak value observed to a CD strain of at least about 4 percent. The CD modulus of CWP product decays more quickly from its peak modulus as CD strain increases, whereas conventional TAD products do not exhibit a peak CD modulus at low CD strains.

Figure 54:
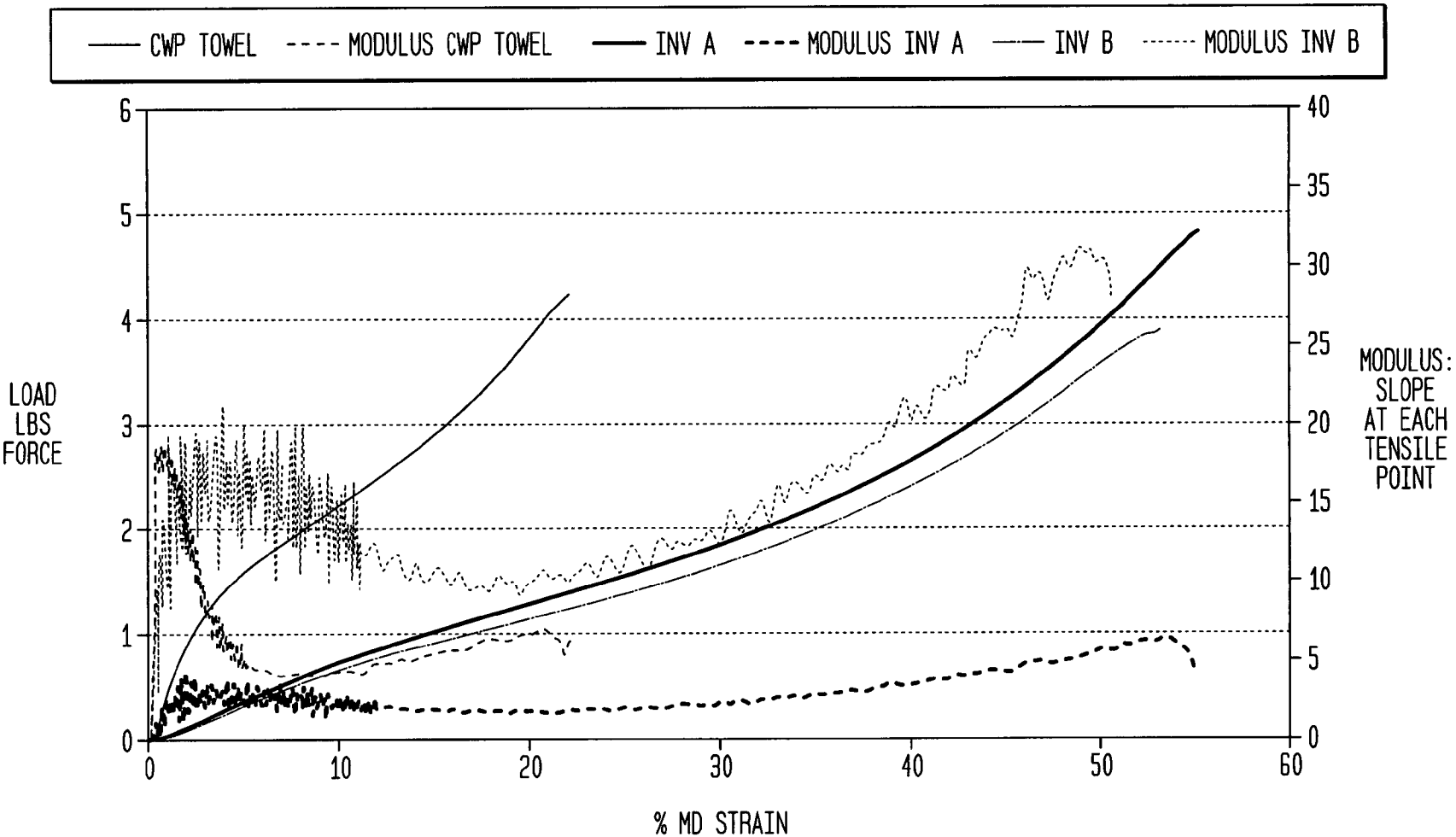
Figure 55:
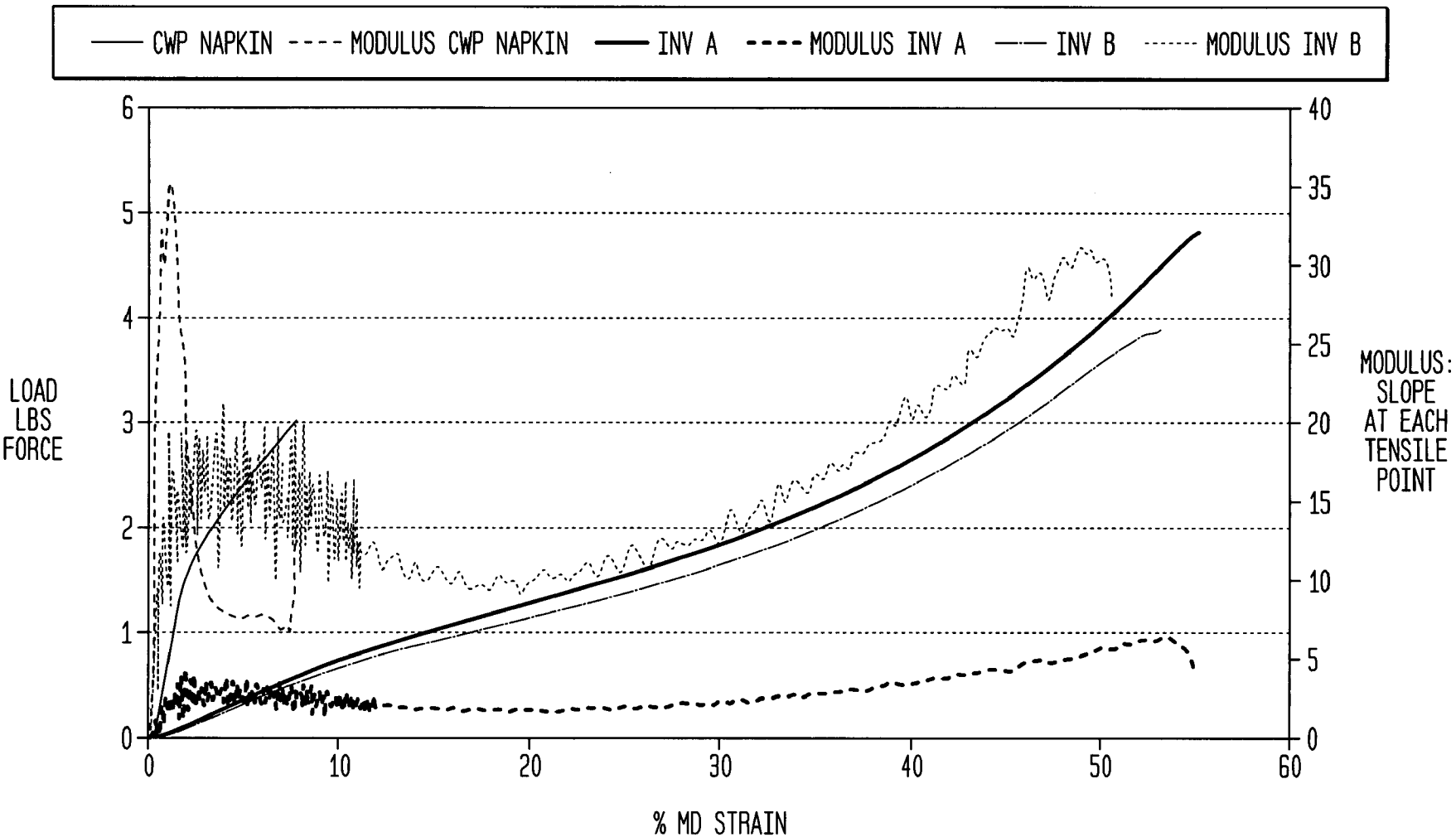

The machine-direction modulus of the products of the invention likewise exhibits unique behavior at varying levels of strain in many cases; FIGS. 48 through 55 show MD tensile behavior. It can be seen in FIGS. 48 through 55 that the modulus at break for some of the sheets is 1.5-2 times the initial MD modulus (the initial MD modulus being taken as the maximum MD modulus below about 5% strain). Sample B seen in FIG. 54 is particularly striking wherein the product exhibits an MD modulus at break of nearly twice the initial modulus of the sheet. It is believed that this high modulus at high stretch may explain the surprising runnability observed under conditions of high MD stretch with webs of the present invention.

The influence of the "hardness" of the creping roll, that is roll 70 (FIG. 19, FIG. 20) is seen in tables 7 and 8. As noted above the "hardness" of this roll influences the length of the creping nip. Results appear in Tables 7 and 8 below for various creping ratios. While the roll hardness exhibited some influence on the sheet properties, that influence was somewhat overwhelmed by the influence of fabric creping ratio on the properties of the sheet.

TABLE 7

"Soft" (P + J 80) Crepe Roll, 21 Mesh Fabric

| | | | | |
|---|---|---|---|---|
| Fabric Crepe Ratio | 1.13 | 1.28 | 1.45 | 1.60 |
| Caliper | 109 | 129 | 134 | 132 |
| GMT | 2450 | 1167 | 1215 | 905 |
| MD/CD | 3.56 | 4.54 | 1.83 | 1.47 |
| SAT Capacity | 475 | 617 | 632 | 688 |
| Jet/Wire Ratio | 0.94 | 0.83 | 0.94 | 0.84 |
| Yankee Hood Temp. | 850 | 857 | 855 | 900 |
| Reel Moisture | 1.3 | 1.5 | 1.7 | 2.3 |
| Basis Weight | 25.6 | 25.7 | 25.1 | 24.6 |
| Specific Volume | 8.3 | 9.8 | 10.4 | 10.5 |
| Specific SAT | 5.7 | 7.4 | 7.8 | 8.6 |
| Specific GMT | 769 | 359 | 398 | 296 |

TABLE 8

"Hard" (P + J 30) Crepe Roll, 21 Mesh Fabric

| | | | | |
|---|---|---|---|---|
| Fabric Crepe Ratio | 1.13 | 1.27 | 1.44 | 1.61 |
| Caliper | 94 | 116 | 126 | 128 |
| GMT | 2262 | 1626 | 1219 | 934 |
| MD/CD | 3.41 | 2.38 | 1.98 | 1.66 |
| SAT Capacity | 396 | 549 | 591 | 645 |
| Jet/Wire Ratio | 0.94 | 0.96 | 0.95 | 0.94 |
| Yankee Hood Temp. | 890 | 875 | 875 | 875 |
| Reel Moisture | 1.5 | 1.6 | 1.5 | 2.4 |
| Basis Weight | 24.0 | 23.8 | 23.5 | 23.6 |
| Specific Volume | 7.6 | 9.5 | 10.4 | 10.6 |
| Specific SAT | 5.1 | 7.1 | 7.7 | 8.4 |
| Specific GMT | 774 | 573 | 410 | 310 |

It will be appreciated from the foregoing that modifications to specific embodiments and further advantages of the present invention are readily apparent to one of skill in the art. For example, one could use a non-porous belt with a pattern rather than a creping fabric. Throughout this specification and claims creping belt should be understood to comprehend both fabrics and non porous structures. Initial trials using a vacuum molding box on the creping fabric demonstrate that the penalty for not using (or being able to use) a molding box is relatively small. Therefore, a solid impermeable belt could be used in place of the creping fabric. The material that an impermeable belt is composed of would allow it to be engraved either mechanically or by a laser. Such engraving techniques are well known and permit the structure of the voids to be optimized in any number of ways: sheet caliper, absorbency, fabric creping efficiency, percent "open" area presented to the sheet, strength development (continuous lines), esthetic value to final consumer, ability to clean, long life, uniform pressing profile and so forth.

Inasmuch as the fabric creping step greatly influences the final properties of the basesheet, final dry creping is not required to produce high quality, soft, absorbent basesheets. Therefore, if convenient, the use of single tier drying runs over a relatively large number of dryer cans to final dry the wet, fabric creped basesheet may be used. Of particular benefit is the ability to cheaply and efficiently convert an existing flat papermachine to produce relatively high quality tissue and towel basesheets. Neither Yankee dryer, nor an intermediate dryer need be added to the process. Typically, all that is required is a redesign of the existing press section and sheet travel path; along, with perhaps, a minor rebuild of the wet end to accommodate the lower basis weights and higher former speeds associated with the inventive process of the present invention.

In a still yet further embodiment, the sheet, following the fabric creping step, is final dried on a TAD fabric by passing it over a honeycomb roll designed to dry by pulling heated air through the sheet. In this embodiment, the invention could be used to rebuild an existing conventional asset or to rebuild an existing TAD machine for reduced operating costs.

A further advantage of sheet produced in accordance with the invention is that especially at relatively high delta speeds during fabric creping, those sheets without wet strength exhibit SAT absorption values comparable with those that contain large amounts of wet strength chemical. Since conventional sheets without wet strength additives tend to collapse when wet, it appears that the process of the invention develops a sheet structure that does not collapse when wet even without wet strength chemicals. Such structure may result from an unusually high percentage of the fibers being arranged axially in the z-direction of the sheet; that is, fibers that tend to be stacked up in a fashion that the sheet structure is prevented from collapsing even when wet thereby keeping sufficient void volume available for water holding capacity. In other observed structures, large numbers of fibers extending largely in the CD direction appear to be stacked one upon another forming structures extending for several fiber thicknesses, i.e., the z-direction. Conventional sheets tend to elongate when wetted, whereas we have observed a lower tendency for the sheets of the present invention to elgonate when wetted.

A still further attribute of the products of the invention is that the products tend to have low or no lint. Because most of the water holding capacity and the low modulus, high stretch characteristics of the inventive sheets are developed in the fabric creping step when the sheet is still relatively wet and because this fabric creping step has more effect than just molding the sheet—actual structural changes have occurred at the fiber level—little more sheet degradation is needed or occurs at the dry creping blade. As a result, the potential for dust is significantly reduced because potential dust particles generated in the fabric creping step are strongly bonded to the sheet during the final drying step. In typical cases there is provided a relatively low level of dry creping (due to the low level of overall sheet bonding to the creping cylinder) that does not release many fibers, fines, or other particles that constitute the lint or dust that is usually present in soft tissues and towels. Heretofore we had not observed such a low level of lint associated with such a highly softened tissue or towel as is possible with the products of the invention. This combination of characteristics is especially desirable in soft tissues and towels for use as lens wipers, window cleaners, and other uses where high dust levels are objectionable.

Basesheets made by way of the inventive process may be used in different grades of product. In typical paper making operations, each final product requires a specific grade of basesheet to be made in a papermachine. However, it is possible with the process of the invention to produce a wide array of products from a single basesheet so long as the desired products have suitable basis weight, tensile, absorbency, opacity and softness properties. Lower quality products or lower basis weight products can utilize the same basesheet from the papermachine as does the highest quality grade. In converting, the lesser grades are produced by simply "pulling out" more of the high quality sheet stretch until the desired targets are obtained as is illustrated below in connection with tissue products. Because of the unique properties of the basesheet, papermachines can run fewer grades at significantly higher levels of efficiency. The technology thus affords the opportunity to fine tune the processes to the highest levels of operating efficiencies and lowest cost while affording converting operations the flexibility and efficiency needed to meet customer orders with minimal inventories or down time due to grade changing.

The sheets of the invention exhibit high stretch, yet are easy to wind. Typically, sheets exhibiting high MD stretch are not easy to wind unless they have a high initial modulus. Similarly, sheets exhibiting low MD tensile experience many breaks in winding or other processing. The sheets made in accordance with the present invention wind well, without breaks, at very high (>50%) stretches and low (<300 grams/3 inch) tensile. The unique properties make the sheets suitable for grades or uses not normally considered; examples include diaper (or feminine care) liners where the web can experience high snap loads during processing but yet require low Z-direction porosity to retain the powdered super absorbent material often used in these product forms. Because of the very low modulus values and the low lint shedding of the sheets of the invention, they can provide unique skin wiping and skin care basesheets. They exhibit high "surface void volume" to trap material being wiped from the skin while at the same time providing high Z-direction "cushion" to distribute the wiping pressure over larger areas thus reducing the abrasive nature of the paper on the skin being wiped. The high drapability of these sheets adds to effectiveness as a skin wiper and the perception of overall softness.

The invention is especially useful for producing tissue in a variety of grades and provides product options not previously possible with compactively dewatered products, or through-dried products where the expense, both in terms of initial investment and operating costs is much higher. In general, conventional one-ply tissues of high quality do not exhibit MD stretch in excess of 25%. This invention is capable of MD stretch values much greater than 25% while maintaining excellent runability on the papermachine and in converting. This runability may be enhanced with headbox stratification technology if so desired. Conventional tissues made by a CWP process, unless embossed, do not exhibit a characteristic pattern such as that of a TAD fabric. The present invention exhibits patterning from the creping fabric and thus can be a substitute for TAD basesheet. The fabric creping process allows for changing of the amounts of reel and fabric crepe that are put into the sheet at a given overall crepe ratio. Like conventional TAD processes, this permits trading off softness and absorbency with no effect on overall productivity. Unlike conventional TAD processes, the fabric creping process of the present invention does not require a wet strength additive to realize the increased absorbency. As previously noted, we believe that this feature is due to the "stacking" of the fibers in the fabric creping step. When compared to conventional uncreped, through air dried technology, the present invention offers considerably more flexibility as the creping ratio may be changed independently of the reel speed.

Numerous tissue product forms may be produced from the same papermachine basesheet. For example, a super premium tissue could be made exhibiting MD stretch values in excess of 25%. By increasing the degree of pullout in a converting section, both the basis weight and the MD stretch values could be reduced but still remain above 25% to result in a product of slightly lower performance. Other grades could be produced by pulling out more of the stretch. For example, the sheet on the reel of the papermachine could exhibit a basis weight of 25 lbs/ream and MD stretch of 45%. Assuming a normal converting pullout of 4%, the finished basesheet would exhibit a basis weight of 24 lbs/ream and MD stretch of 39% and would be marketed as a super premium tissue. Using the same basesheet but changing the converting pullouts would result in the products shown in Table 9.

TABLE 9

Product Possibilities from Basesheet of 25 lbs bwt and 45% MD Stretch

| Description | Pull Out in Conv | Basis Weight | MD Stretch |
|---|---|---|---|
| Super Premium | 4% | 24 | 39 |
| Premium | 14% | 22 | 27 |
| Regular | 24% | 20 | 17 |
| Special | 38% | 18 | 5 |

The ability to dramatically alter the tensile ratios also allows the production of very unique tissues. For example, marketing research shows that there are minimum CD tensiles that the consumer associates with adequate strength. In conventional CWP and TAD processes, this CD tensile strength defines the range of MD tensiles for acceptable product. In some cases these conventional processes can produce a final product tensile ratio of about 1:1 (MD/CD=1.1). The tensiles of the sheets exhibit a strong relationship to the softness of the sheets. Sheets made using the present invention exhibit unexpected tensile strength behaviors. For example, it is quite easy to produce sheets where the CD is twice the MD (MD/CD=0.5). The high MD and CD stretch values that result from the fabric creping step allow efficient converting operation at tensile values far below what is expected from conventional tissues while maintaining the consumer perception of adequate strength. A typical conventional sheet exhibits a sensory softness value of 18 at tensiles of 1600 by 700 grams or a GMT of 1060 grams. With this invention, a sheet of similar weight could be made at tensiles of 600 by 600 by taking advantage of the stretch properties. The sheet's 600 grams GMT would yield a basesheet with softness significantly above the value of 18. Using this approach the amount of surface applied "softening and lotioning" ingredients could be significantly reduced. For example, some products require as much as 40 lbs/ton of these ingredients. Reducing them to some nominal value like 10 lbs/ton could save costs of at least $40 per ton and as much as $100/ton of product.

The nature of the high MD stretch of the sheets made with the present invention also allows for the overall tensiles to be reduced to levels below that normally considered appropriate for reliable running on papermaking and converting machines. For example, in the above example the 600×600 gram (MD/CD tensile) sheet could be reduced to levels typically seen in one of the two-plies of a two-ply product. In this case, those tensiles values could be further reduced to something on the order of 400×400. This reduction is possible only because of the very high MD stretch values that could be put into the sheet and make it very "elastic" and thus able to resist the snap breaks typically seen in sheets that are of lower stretch values. In the practice of the present invention, dropping the tensiles to this low level can be accomplished with chemicals such as debonders and softeners thus making for a very soft, yet functional, tissue that can be made with a wide variety of different types of fibers, especially low-cost fibers.

Very strong, but soft tissue can be made using the process of the present invention because the observed bending stiffness of these sheets is very low due to the inherently low modulus values of the sheets with high stretch, both MD and CD. Softness of the products can further be enhanced by proper fiber preparation. Long fibers are important for strength generation but often contribute to stiffness and gritty feel. This can be overcome in the process by refining the long fibers to a relatively low freeness value, preferably with minimal fiber shortening. At the same time, hardwood (or softness) fibers could have debonder applied to them at relatively high consistencies in the stock preparation area. This debonder addition should be sufficient to significantly reduce the handsheet tensile but not so high as to completely impede bonding. Then these two fibers are combined either homogeneously or stratified in the headbox. In this manner, the softwood fibers bond to form an open network of long fibers that exhibit high tensile and stretch. The hardwood fibers preferentially bond to the long fiber network and not to themselves. These debonded fibers attach on the outside of the sheet giving a luxurious tactile property while high tensiles are maintained. In this process, the final tensile of the sheet will be controlled by the ratio of the softwood and hardwood fibers used. The debonded outer surface minimizes the need to apply lotions and softeners while at the same time reducing the impact on the papermachine especially the dry creping step.

Similarly, premium tissue products can be produced using significant amounts of recycled fibers. Since these fibers can be treated in ways similar to virgin fibers, these sheets exhibit high levels of softness while maintaining an environmentally friendly technology position.

Creping fabric designs can be changed to significantly alter the properties of the sheets. For example, finer fabrics produce sheets with very smooth surface features but at lower caliper generation. Coarser fabrics impart a stronger fabric pattern and are capable of producing higher caliper sheets exhibiting greater two-sidedness. However, higher calipers allow for greater calendering to smooth the surface while maintaining the pattern. In this manner, the invention gives the potential to produce soft, strong sheets with or without significant patterns in them.

Typically in CWP tissues, as the caliper is increased at a given basis weight, there comes a point where softness inevitably deteriorates. As a general rule when this ratio, expressed as a caliper, in microns, measured with 12 plies divided by basis weight in grams per square meter, exceeds 95, softness usually exhibits perceptible deterioration with increasing caliper. We have found that this invention can produce ratios at least as high as 120 with no observed deterioration in softness. It is believed that even higher values are readily achieved. As a general rule, TAD basesheets of similar weights of the invention can match the caliper achieved at a given basis weight, but the softness properties are inferior. This is due to the fact that in the invention the basesheet is creped twice at consistencies where the interfiber bonding is significantly influenced; once at the fabric and once off the Yankee drying cylinder. While some TAD sheets are similarly twice creped, the initial "rush transfer" fabric creping step seen in conventional TAD is done at lower consistencies than as is the case with the present invention. Both TAD and UCTAD rely on a "rush transfer" type of "fabric crepe" typically at consistencies of 25 percent or less. Higher consistencies make it much more difficult to achieve fabric "filling" and achievement of the caliper desired with these technologies. However, at low consistencies the fibers, even though they may not be pressed in the process, still exhibit considerable bonding capability through the free water present and the Campbell's forces during drying. In the TAD process the sheet is debonded with a conventional creping blade off the Yankee dryer. In both the TAD and UCTAD processes, this bonding can be (and usually is) reduced using chemicals that are applied either at the wet end or as a topical addition somewhere in the process. These chemicals can add considerably to the cost of the paper being made. With respect to the present invention, fabric creping is typically carried out in consistencies in the 40-50% range and at consistencies as high as about 60%. In comparison with consistencies of 25% used for TAD, 40 and 50% consistencies represent ½ to ⅓ the available free water to affect the bonding during drying. The sheet, disrupted by the fabric creping at these higher consistencies exhibits a lower tendency to rebond and reduces or eliminates the need for chemical debonders which add expense and often interfere with efficient blade creping making it more difficult to achieve high softness values.

Generally, high softness in a one-ply basesheet relies heavily on excellent formation to get the maximum sheet tensile strength available in the fibers being used. In the process of this invention, the "formation" of the sheet is altered in the fiber re-arranging (or redistributing) fabric creping step. Therefore, the extra effort and expense associated with carefully controlled formation can be, in some respects, bypassed. While there is a limit as to how "poor" this formation can be, it is realistic to say that "average" formation is more than adequate in most cases since fiber is rearranged on a microscopic scale during fabric creping. In this way, there is considerable rebuild expense that can be saved along with operating costs by not installing high-flow headboxes required to achieve superior formation characteristics.

Two-sidedness is always an issue in one-ply products. Both TAD and uncreped TAD basesheets exhibit varying degrees of two-sidedness. This is often addressed by calendering to reduce to the tactile differences from the fabric and air sides of the sheet. Calendering reduces the caliper of the sheet and in extreme cases, calendering reduces caliper to the point where the finished product specifications cannot be achieved. In TAD and uncreped through air dried processing, the fabric design is key to the amount of caliper that can be achieved. While high caliper sheets are possible with these TAD and UCTAD technologies, the appearance can become course and may not be suitable for premium products. With respect to the present invention, the caliper of the sheets are largely controlled by the amount of fabric creping applied. When relatively "fine" fabrics are used, sheets can exhibit high caliper without coarse appearance, making them better premium basesheets. Further, these finer fabrics exhibit less two-sidedness at a given caliper and then require less calendering to make them acceptable to premium users.

There is shown in Table 10 below a comparison of two-ply CWP tissue, single-ply TAD tissue and single-ply tissue made in accordance with the present invention.

TABLE 10

| | Tissue Comparison | | | | |
|---|---|---|---|---|---|
| Process | CWP | TAD | TAD | FC (INV) | FC (INV) |
| Number of Plies | 2 | 1 | 1 | 1 | 1 |
| Basis Weight | 22.8 | 21.0 | 19.2 | 22.9 | 23.1 |
| Caliper | 68.3 | 83.3 | 83.2 | 85.9 | 77.9 |
| MD Dry Tensile | 1316 | 731 | 733 | 645 | 543 |
| CD Dry Tensile | 428 | 467 | 534 | 469 | 427 |
| GMT | 748 | 584 | 625 | 549 | 481 |
| MD Stretch | 16.4 | 21.9 | 12.1 | 42.5 | 41.0 |
| CD Stretch | 5.6 | 8.7 | 8.0 | 6.7 | 6.6 |
| Perf. Tensile | 536 | 325 | 481 | 321 | 312 |
| CD Wet Tensile | 26 | 186 | 163 | — | — |
| GM Modulus | 29.6 | 14.8 | 15.2 | 11.5 | 9.9 |
| Friction | 0.424 | 0.365 | 0.540 | 0.534 | 0.544 |
| Sheet Count | ~400 | ~400 | ~400 | ~400 | ~400 |
| Roll Diameter | 4.83 | 4.99 | 4.88 | 4.91 | 4.92 |
| Roll Compression | 15.6 | 14.4 | 12.4 | 5.7 | 14.4 |
| Softness | 16.4 | 18.8 | 17.9 | 16.4 | 17.0 |

It can be seen from Table 10 that the single-ply tissue of the present invention is comparable to and in many respects superior to TAD single-ply tissue. Moreover, the single-ply tissue of the invention is comparable and in many respects superior to, two-ply CWP tissue.

The present invention likewise offers the advantages described above in connection with single-ply tissue for premium two-ply tissue products. Here again, two-ply tissues of high quality generally do not exhibit MD stretch values in excess of 25%; but with the present invention, MD stretch values of much greater than 25% are readily achieved while maintaining excellent runnability on the papermachine and in converting. When compared to uncreped TAD processes which require a change of speed in the reel to change the rush transfer speed and which have no creping step to increase softness, two-ply tissue made in accordance with the present invention offers considerably more flexibility in product design. Two-ply tissue may be made in a variety of grades from a single basesheet as shown in Table 11.

TABLE 11

Two-ply Product Possibilities from Basesheet of 12.5 lbs bwt and 45% MD stretch

| Description | Pull Out in Conv | Basis Weight | MD Stretch |
|---|---|---|---|
| Super Premium | 4% | 24 | 39 |
| Premium | 14% | 22 | 27 |
| Regular | 24% | 20 | 17 |
| Special | 38% | 18 | 5 |

While conventional processes can produce high quality sheets, the caliper potential of the present invention is surprisingly high since softness deterioration at elevated caliper/basis weight ratios is not seen as it is seen in conventional compactively dewatered products at a caliper/basis weight ratio of 95 or so.

While the invention has been described in connection with numerous examples and features, modification to the embodiments illustrated within the spirit and scope of the invention, set forth in the appended claims, will be readily apparent to those of skill in the art.

What is claimed is:

1. A method of making a belt-creped absorbent cellulosic sheet comprising:

a) compactively dewatering a papermaking furnish to form a nascent web having an apparently random distribution of papermaking fiber;

b) applying the dewatered web having the apparently random fiber distribution to a translating transfer surface moving at a transfer surface speed;

c) belt-creping the web from the transfer surface at a consistency of from about 30 to about 60 percent utilizing a patterned creping belt, the creping step occurring under pressure of 20 pounds per linear inch or more in a belt creping nip defined between the transfer surface and the creping belt wherein the belt is traveling at a belt speed slower than the speed of said transfer surface, the belt pattern, nip parameters, velocity delta and web consistency being selected such that the web is creped from the transfer surface and redistributed on the creping belt to form a web with a reticulum having a plurality of interconnected regions of different local basis weights including at least (i) a plurality of fiber enriched pileated regions of high local basis weight, interconnected by way of (ii) a plurality of lower local basis weight linking regions whose fiber orientation is biased toward the direction between pileated regions; and d) drying the web.

wherein the method is further characterized in that: (i) the web has an absorbency of at least 4.5g/g up to an absorbency in g/g of about 0.9 times the specific volume of the web in cc/g and a CD stretch of at least about 5% up to about 20%; or (ii) the velocity delta at the creping nip is at least 100 feet per minute up to about 2000 fpm; or both (i) and (ii).

2. The method according to claim 1, operated at a Fabric Crepe of at least about 20 percent up to 80 percent.

3. The method according to claim 1, operated at a Fabric Crepe of at least about 40 percent.

4. The method according to claim 1, operated at a Fabric Crepe of at least about 60 percent.

5. The method according to claim 1, wherein the web has a CD stretch of from about 5 percent to about 10 percent.

6. The method according to claim 1, wherein the web has a CD stretch of from about 6 percent to about 8 percent.

7. The method according to claim 1, wherein the web has an MD stretch of at least about 15 percent up to 80 percent.

8. The method according to claim 7, wherein the web has an MD stretch of at least about 30 percent.

9. The method according to claim 7, wherein the web has an MD stretch of at least about 55 percent.

10. The method according to claim 7, wherein the web has an MD stretch of at least about 75 percent.

11. The method according to claim 1, wherein the web has an MD/CD tensile ratio of less than about 1.1 and at least about 0.5.

12. The method according to claim 1, wherein the web exhibits an MD/CD tensile ratio of from about 0.5 to about 0.9.

13. The method according to claim 1, wherein the web exhibits an MD/CD tensile ratio of from about 0.6 to about 0.8.

14. The method according to claim 1, wherein the web is belt-creped at a consistency of from about 35 percent to about 55 percent.

15. The method according to claim 1, wherein the web is belt-creped at a consistency of from about 40 percent to about 50 percent.

16. The method according to claim 1, wherein the creping nip pressure is from about 40 PLI to about 80 PLI.

17. The method according to claim 1, wherein the creping nip pressure is from about 50 PLI to about 70 PLI.

18. The method according to claim 1, wherein the creping belt is supported in the creping nip with a backing roll having a surface hardness of from about 20 to about 120 on the Pusey and Jones hardness scale.

19. The method according to claim 1, wherein the creping belt is supported in the creping nip with a backing roll having a surface hardness of from about 25 to about 90 on the Pusey and Jones hardness scale.

20. The method according to claim 1, wherein the creping nip extends over a distance of at least about 1/16" up to about 2".

21. The method according to claim 1, wherein the creping nip extends over a distance of at least about 1/8" up to about 2".

22. The method according to claim 1, wherein the creping nip extends over a distance of from about 1/2" to about 2".

23. A method of making a belt-creped absorbent cellulosic sheet comprising:

a) compactively dewatering a papermaking furnish to form a nascent web having an apparently random distribution of papermaking fiber;

b) applying the dewatered web having the apparently random fiber distribution to a translating transfer surface moving at a transfer surface speed;

c) belt-creping the web from the transfer surface at a consistency of from about 30 to about 60 percent utilizing a patterned creping belt, the creping step occurring under pressure of 20 pounds per linear inch or more in a belt creping nip defined between the transfer surface and the creping belt wherein the belt is traveling at a belt speed slower than the speed of said transfer surface by at least 100 feet per minute and wherein the speed of the belt is slower than the speed of said transfer surface by a velocity delta of up to 2000 feet per minute, the belt pattern, nip parameters, velocity delta and web consistency being selected such that the web is creped from the transfer surface and redistributed on the creping belt, d) drying the web;

wherein the web has an absorbency of at least 5 g/g up to an absorbency in g/g of about 0.9 times the specific volume of the web in cc/g.

24. The method according to claim 23, wherein the web has an absorbency of at least about 6 g/g.

25. The method according to claim 23, wherein the web has an absorbency of at least about 7 g/g.

26. The method according to claim 23, wherein the web has an absorbency of at least about 8 g/g.

27. A method of making a fabric-creped absorbent cellulosic sheet comprising:

a) compactively dewatering a papermaking furnish to form a nascent web;

b) applying the dewatered web to the surface of a rotating transfer cylinder rotating at a transfer surface speed such that the surface velocity of the cylinder is at least about 1000 fpm;

c) fabric-creping the web from the transfer cylinder at a consistency of from about 30 to about 60 percent under pressure of 20 pounds per linear inch or more in a high impact fabric creping nip defined between the transfer cylinder and a creping fabric traveling at a fabric speed slower than said surface velocity of the transfer cylinder by at least 100 feet per minute and wherein the fabric speed is slower than the speed of said transfer surface by a velocity delta of up to 2000 feet per minute, wherein the web is creped from the cylinder and rearranged on the creping fabric; and d) drying the web, wherein the web has an absorbency of at least about 5 g/g up to an absorbency in g/g of about 0.9 times the specific volume of the web in cc/g and a CD stretch of at least about 4 percent up to about 20 percent.

28. The method according to claim 27, wherein the surface velocity of the transfer cylinder is at least about 2000 fpm up to about 6000 fpm.

29. The method according to claim 27, wherein the surface velocity of the transfer cylinder is at least about 4000 fpm up to about 6000 fpm.

30. The method according to claim 27, wherein the web has an absorbency of from about 5 g/g to about 12 g/g.

31. The method according to claim 27, wherein the absorbency of the web (g/g) is at least about 0.7 times the specific volume of the web (cc/g) up to an absorbency in g/g of about 0.9 times the specific volume of the web in cc/g.

32. The method according to claim 27, wherein the absorbency of the web (g/g) is from about 0.75 to about 0.9 times the specific volume of the web cc/g).

33. The method according to claim 27, wherein the aqueous furnish includes a wet strength resin.

34. The method according to claim 27, wherein the wet strength resin comprises a polyamide-epicholorohydrin resin.

35. The method according to claim 27, wherein the web is dewatered by wet pressing it with a papermaking felt while applying the web to the transfer cylinder.

36. The method according to claim 35, wherein the step of wet-pressing the web with a papermaking felt while applying it to the transfer roll is carried out in a shoe press.

37. The method according to claim 27, wherein the transfer roll is a shoe press roll and the nascent web is further dewatered by wet-pressing the web while applying it to the transfer roll.

38. The method according to claim 27, further comprising the steps of forming a nascent web on a forming fabric, transferring the nascent web to a papermaking felt and dewatering the web by wet pressing it between the papermaking felt and the transfer cylinder.

39. The method according to claim 27, wherein the fabric creping nip extends over a distance corresponding to at least twice the distance between wefts of the creping fabric up to a distance corresponding to 40 times the distance between the wefts of the creping fabric.

40. The method according to claim 27, wherein the fabric creping nip extends over a distance corresponding to at least 4 times the distance between wefts of the creping fabric up to a distance corresponding to 40 times the distance between the wefts of of the creping fabric.

41. The method according to claim 27, wherein the fabric creping nip extends over a distance corresponding to at least 10 times the distance between wefts of the creping fabric up to a distance corresponding to 40 times the distance between the wefts of of the creping fabric.

42. The method according to claim 27, wherein the fabric creping nip extends over a distance corresponding to at least 20 times the distance between wefts creping fabric up to a distance corresponding to 40 times the distance between the wefts of of the creping fabric.

43. A method of making single-ply tissue comprising:

a) compactively dewatering a papermaking furnish to form a nascent web having an apparently random distribution of papermaking fiber;

b) applying the dewatered web having the apparently random fiber distribution to a translating transfer surface moving at a transfer surface speed;

c) belt-creping the web from the transfer surface at a consistency of from about 30 to about 60 percent utilizing a patterned creping belt, the creping step occurring under pressure of 20 pounds per linear inch or more in a belt creping nip defined between the transfer surface and the creping belt wherein the belt is traveling at a belt speed slower than the speed of said transfer surface by at least 100 feet per minute and wherein the speed of the belt is slower than the speed of said transfer surface by a velocity delta of up to 2000 feet per minute, the belt pattern, nip pressure, velocity delta and web consistency being selected such that the web is creped from the transfer surface and redistributed on the creping belt to form a web with a reticulum having a plurality of interconnected regions of different local basis weights including at least (i) a plurality of fiber enriched pileated regions of high local basis weight, interconnected by way of (ii) a plurality of lower local basis weight linking regions whose fiber orientation is biased toward the direction between pileated regions and (iii) wherein the Fabric Crepe is greater than about 25% up to 80%;

d) drying the web to form a basesheet having an MD stretch greater than about 25% up to 80% and a characteristic basis weight; and e) converting the basesheet into a single-ply tissue product wherein the single-ply tissue product has a basis weight lower than the basesheet prior to conversion and an MD stretch lower than the MD stretch of the basesheet prior to conversion.

44. The method according to claim 43, wherein the product is calendered.

45. The method according to claim 43, wherein the product has a 12-ply caliper (microns) to basis weight (gms/m$^2$) ratio of greater than about 95 and up to about 120.

46. A method of making multi-ply tissue comprising:

a) compactively dewatering a papermaking furnish to form a nascent web having an apparently random distribution of papermaking fiber;

b) applying the dewatered web having the apparently random fiber distribution to a translating transfer surface moving at a transfer surface speed;

c) belt-creping the web from the transfer surface at a consistency of from about 30 to about 60 percent utilizing a patterned creping belt, the creping step occurring under pressure of 20 pounds per linear inch or more in a belt creping nip defined between the transfer surface and the creping belt wherein the belt is traveling at a belt speed slower than the speed of said transfer surface by at least 100 feet per minute and wherein the speed of the belt is slower than the speed of said transfer surface by a velocity delta of up to 2000 feet per minute, the belt pattern, nip parameters, velocity delta and web consistency being selected such that the web is creped from the transfer surface and redistributed on the creping belt to form a web with a reticulum having a plurality of interconnected regions of different local basis weights including at least (i) a plurality of fiber enriched pileated regions of high local basis weight, interconnected by way of (ii) a plurality of lower local basis weight linking regions whose fiber orientation is biased toward the direction between pileated regions and (iii) wherein the Fabric Crepe is greater than about 25% up to 80%;

d) drying the web to form a basesheet having an MD stretch greater than about 25% up to 80% and a characteristic basis weight; and e) converting the basesheet into a multi-ply tissue product with n plies made from the base sheet, n being 2 or 3, wherein the multiply product has an MD stretch lower than the MD stretch of the basesheet.

47. The method according to claim 46, wherein n=2 such that the tissue product is a two-ply tissue product.

48. The method according to claim 46, wherein the basesheet has an MD stretch of at least about 30%.

49. The method according to claim 46, wherein the basesheet has an MD stretch of at least about 40%.

50. The method according to claim 46, wherein the product is calendered.

51. The method according to claim 46, wherein the product has a 12-ply caliper (microns) to basis weight (gms/m$^2$) ratio of greater than about 95.

52. The method according to claim 46, wherein the product has a 12-ply caliper (microns) to basis weight (gms/m$^2$) ratio of greater than about 95 and up to about 120.

53. A method of making a belt-creped absorbent cellulosic sheet comprising:

a) applying a papermaking furnish to a papermaking felt in contact with a forming roll provided with vacuum;

b) at least partially dewatering the papermaking furnish by application of vacuum from the forming roll on the papermaking felt to form a nascent web having a generally random distribution of papermaking fiber;

c) compactively dewatering the nascent web having a generally random distribution of papermaking fiber;

d) applying the dewatered web having a generally random fiber distribution to a translating transfer surface moving at a transfer surface speed;

e) belt-creping the web from the transfer surface at a consistency of from about 30 to about 60 percent utilizing a patterned creping belt, the creping step occurring under pressure in a belt creping nip defined between the transfer surface and the creping belt wherein the belt is traveling at a belt speed slower than the speed of said transfer surface by at least 100 feet per minute and wherein the speed of the belt is slower than the speed of said transfer surface by a velocity delta of up to 2000 feet per minute, the belt pattern, nip parameters, velocity delta and web consistency being selected such that the web is creped from the transfer surface and redistributed on the creping belt to form a web with a reticulum having a plurality of interconnected regions of different local basis weights including at least (i) a plurality of fiber enriched pileated regions of high local basis weight, interconnected by way of (ii) a plurality of lower local basis weight linking regions whose fiber orientation is biased along the direction between pileated regions; and f) drying the web;

wherein the web has an absorbency of at least about 4.5 g/g up to an absorbency in g/g of about 0.9 times the specific volume of the web in cc/g and a CD stretch of at least about 5% up to about 20%.

54. The method of claim 53, carried out on a 3-fabric papermachine.

55. The method according to claim 54, wherein the step of drying the web comprises applying the web to a Yankee dryer.

56. The method according to claim 55, wherein the step of applying the web to the Yankee dryer comprises utilizing a poly(vinyl alcohol) containing adhesive.

57. The method according to claim 53, wherein the papermaking felt is inclined upwardly.

58. The method according to claim 53, further comprising a pressure roll configured to urge the papermaking felt against the forming roll.

59. The method according to claim 58, wherein the pressure roll has a surface hardness of from about 20 to about 120 on the Pusey and Jones hardness scale.

60. The method according to claim 58, wherein the pressure roll has a surface hardness of from about 25 to about 90 on the Pusey and Jones hardness scale.

61. A method of making a belt-creped absorbent cellulosic sheet comprising:

a) compactively dewatering a papermaking furnish to form a nascent web having an apparently random distribution of papermaking fiber;

b) applying the dewatered web having the apparently random fiber distribution to a translating transfer surface moving at a transfer surface speed;

c) belt-creping the web from the transfer surface at a consistency of from about 30 to about 60 percent utilizing a patterned creping belt, the creping step occurring under pressure in a belt creping nip defined between the transfer surface and the creping belt wherein the belt is traveling at a belt speed slower than the speed of said transfer surface, the belt pattern, nip parameters, velocity delta and web consistency being selected such that the web is creped from the transfer surface and redistributed on the creping belt to form a web with a reticulum having a plurality of interconnected regions of different local basis weights including at least (i) a plurality of fiber enriched pileated regions of high local basis weight, interconnected by way of (ii) a plurality of lower local basis weight linking regions whose fiber orientation is biased toward the direction between pileated regions; and d) drying the web;

wherein the web has a CD stretch of from about 5 percent to about 20 percent, and an absorbency of at least 5 g/g up to an absorbency in g/g of about 0.9 times the specific volume of the web in cc/g.

62. The method according to claim 61, wherein the web has a CD stretch of from about 5 percent to about 10 percent.

63. The method according to claim 61, wherein the web has a CD stretch of from about 6 percent to about 8 percent.

64. The method according to claim 61, wherein the web has an absorbency of at least about 6 g/g.

65. The method according to claim 61, wherein the web has an absorbency of at least about 7 g/g.

66. The method according to claim 61, wherein the web has an absorbency of at least about 8 g/g.

67. A method of making a belt-creped absorbent cellulosic sheet comprising:

a) compactively dewatering a papermaking furnish to form a nascent web having an apparently random distribution of papermaking fiber;

b) applying the dewatered web having the apparently random fiber distribution to a translating transfer surface moving at a transfer surface speed;

c) belt-creping the web from the transfer surface at a consistency of from about 30 to about 60 percent utilizing a patterned creping belt, the creping step occurring under pressure in a belt creping nip defined between the transfer surface and the creping belt wherein the belt is traveling at a belt speed slower than the speed of said transfer surface, the belt pattern, nip parameters, velocity delta and web consistency being selected such that the web is creped from the transfer surface and redistributed on the creping belt to form a web with a reticulum having a plurality of interconnected regions of different local basis weights including at least (i) a plurality of fiber enriched pileated regions of high local basis weight, interconnected by way of (ii) a plurality of lower local basis weight linking regions whose fiber orientation is biased toward the direction between pileated regions; and d) drying the web;

wherein the web has a CD stretch of from about 5 percent to about 20 percent, an absorbency of at least 5 g/g up to an absorbency in g/g of about 0.9 times the specific volume of the web in cc/g, and an MD/CD tensile ratio of less than about 1.1 and at least about 0.5.

68. The method according to claim 67, wherein the web exhibits an MD/CD tensile ratio of from about 0.5 to about 0.9.

69. The method according to claim 67, wherein the web exhibits an MD/CD tensile ratio of from about 0.6 to about 0.8.

70. The method according to claim 67, wherein the web has a CD stretch of from about 6 percent to about 8 percent.

71. A method of making a belt-creped absorbent cellulosic sheet comprising:

a) compactively dewatering a papermaking furnish to form a nascent web having an apparently random distribution of papermaking fiber;

b) applying the dewatered web having the apparently random fiber distribution to a translating transfer surface moving at a transfer surface speed;

c) belt-creping the web from the transfer surface at a consistency of from about 30 to about 60 percent utilizing a patterned creping belt, the creping step occurring under pressure of 20 pounds per linear inch or more in a belt creping nip defined between the transfer surface and the creping belt wherein the belt is traveling at a belt speed slower than the speed of said transfer surface, the belt pattern, nip parameters, velocity delta and web consistency being selected such that the web is creped from the transfer surface and redistributed on the creping belt to form a web with a reticulum having a plurality of interconnected regions of different local basis weights including at least (i) a plurality of fiber enriched pileated regions of high local basis weight, interconnected by way of (ii) a plurality of lower local basis weight linking regions whose fiber orientation is biased toward the direction between pileated regions; and d) drying the web;

wherein the method is further characterized in that: (i) the web has an absorbency of from about 5 g/g to about 12 g/g; or (ii) the velocity delta at the creping nip is at least 100 feet per minute up to about 2000 fpm; or both (i) and (ii).

72. A method of making a belt-creped absorbent cellulosic sheet comprising:

e) compactively dewatering a papermaking furnish to form a nascent web having an apparently random distribution of papermaking fiber;

f) applying the dewatered web having the apparently random fiber distribution to a translating transfer surface moving at a transfer surface speed;

g) belt-creping the web from the transfer surface at a consistency of from about 30 to about 60 percent utilizing a patterned creping belt, the creping step occurring under pressure of 20 pounds per linear inch or more in a belt creping nip defined between the transfer surface and the creping belt wherein the belt is traveling at a belt speed slower than the speed of said transfer surface by at least 100 feet per minute and wherein the speed of the belt is slower than the speed of said transfer surface by a velocity delta of up to 2000 feet per minute, the belt pattern, nip parameters, velocity delta and web consistency being selected such that the web is creped from the transfer surface and redistributed on the creping belt, d) drying the web;

wherein the web has an absorbency of from about 5 g/g to about 12 g/g.

* * * * *

UNITED STATES PATENT AND TRADEMARK OFFICE

CERTIFICATE OF CORRECTION

PATENT NO. : 7,399,378 B2
APPLICATION NO. : 10/679862
DATED : July 15, 2008
INVENTOR(S) : Steven L. Edwards et al.

It is certified that error appears in the above-identified patent and that said Letters Patent is hereby corrected as shown below:

In Col. 6, line 36, change "cc/g" to --(cc/g)--;
In Col. 7, line 11, change "alcohol and" to --alcohol) and--;
In Col. 7, line 26, change "50 lbs." to --50 (lbs.--;
In Col. 10, line 33, change "thorughdried" to --throughdried--;
In Col. 11, line 39, change "are" to --is--;
In Col. 11, line 53, change "(SEMS)" to --(SEMs)--;
In Col. 12, line 36, change "and" to --in--;
In Col. 14, line 31, change "(73.4)" to --(73.4 °F)--;
In Col. 14, line 45, change "cup" to --Cup--;
In Col. 14, line 51, change "cup" to --Cup--;
In Col. 14, line 53, delete "a";
In Col. 14, line 59, change "+0.0.1" to --± -0.0.1--;
In Col. 15, line 15, delete ")" after "England";
In Col. 15, line 16, insert --(-- before "Part";
In Col. 15, line 21, change "Lt.," to --Ltd.,--;
In Col. 16, line 6, change "1'100%." to --1 x 100%.--;
In Col. 18, line 46, insert --as-- after "such";
In Col. 20, line 45, change "'255" to --042--;
In Col. 20, line 57, change "bons" to --bon--;
In Col. 21, line 32, change "Essen Germany" to --Essen, Germany--;
In Col. 22, line 7, change "Epsy" to --Espy--;
In Col. 22, line 7-8, change "Alkaline-Curing Polymeric Amine-Epichlorohydrin Resins" to --"Alkaline-Curing Polymeric Amine-Epichlorohydrin Resins"--;
In Col. 22, line 30, change "phathalic" to --phthalic--;
In Col. 22, line 35, change the first instance of "amine" to --amines--;
In Col. 22, line 42, delete the first instance of "of";
In Col. 23, line 40, change "those." to --those--;
In Col. 24, line 46, change "degrees" to --degree--;
In Col. 24, line 48, change "degree" to --degrees--;

Signed and Sealed this
First Day of March, 2011

David J. Kappos

David J. Kappos
*Director of the United States Patent and Trademark Office*

In Table 1, 2nd line after heading, delete "," after "Hydrolysis";
In Table 1, 2nd line after heading, delete "Max.$^{3}$" and insert --Max.--;
In Col. 25, line 42, change "molybdenium" to --molybdenum--;
In Col. 27, line 49, change "form" to --from--;
In Col. 28, line 31, change "by desirable" to --be desirable--;
In Col. 29, line 48, delete "28";
In Col. 30, line 11, change "modem" to --modern--;
In Col. 30, line 15, change "ph" to --pli--;
In Col. 42, line 28, change "tables" to --Tables--;
In Col. 46, line 15, change "two-plies" to --two plies--;
In Col. 48, line 16, delete "to";
In Col. 48, line 23, change "course" to --coarse--;
In Col. 51, line 52, change "web cc/g)" to --web (cc/g)--;
In Col. 52, line 20, delete the 2nd instance of "of";
In Col. 52, line 25, delete the 2nd instance of "of";